US007030848B2

(12) United States Patent
Sato et al.

(10) Patent No.: US 7,030,848 B2
(45) Date of Patent: Apr. 18, 2006

(54) LIQUID CRYSTAL DISPLAY

(75) Inventors: Ichiro Sato, Kyoto (JP); Katsuhiko Kumagawa, Osaka (JP); Hiroyuki Yamakita, Osaka (JP); Kazunori Komori, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 540 days.

(21) Appl. No.: 10/107,535

(22) Filed: Mar. 28, 2002

(65) Prior Publication Data

US 2002/0196220 A1 Dec. 26, 2002

(30) Foreign Application Priority Data

Mar. 30, 2001 (JP) ..... 2001-098659
Nov. 14, 2001 (JP) ..... 2001-348513

(51) Int. Cl.
*G09G 3/36* (2006.01)

(52) U.S. Cl. ..... 345/95; 345/99; 345/94

(58) Field of Classification Search ..... 345/87, 345/88, 89, 94, 97, 99, 95
See application file for complete search history.

(56) References Cited

U.S. PATENT DOCUMENTS 5,400,048 A * 3/1995 Shimada et al. ..... 345/97
6,115,014 A 9/2000 Aoki et al.
6,703,993 B1 * 3/2004 Miura et al. ..... 345/87

FOREIGN PATENT DOCUMENTS

| | | |
|---|---|---|
| GB | 2 351 835 A | 1/2001 |
| JP | 08-051633 | 2/1996 |
| JP | 11-258573 | 9/1999 |

OTHER PUBLICATIONS

T. Verhulst, "*Analytical Modeling of Active-Matrix Driving of Liquid Crystals With Spontaneous Polarization,*" Jpn. J. Appl. Phys., vol. 36, No. 2, Feb. 1997, pp. 720-729.
H. Nakamura, et al, "*Late-News Paper: A Novel Wide-Viewing-Angle Motion Picture LCD*" SID 1998 Digest, pp. 143-146.

* cited by examiner

*Primary Examiner*—Kent Chang
(74) *Attorney, Agent, or Firm*—McDermott Will & Emery LLP

(57) ABSTRACT

Disclosed is a liquid crystal display capable of ensuring brightness necessary for achieving satisfactory display by increasing ratio of light-emitting time to one frame period. A liquid crystal display is adapted to have a period (non-video signal write period) required for writing non-video signals different from video signals onto all the pixels before a video signal write period. In the non-video signal write period, the non-video signals are written onto the respective pixels, thereby starting response of the liquid crystal before the start of the video signal write period. In the non-video signal write period, a backlight is turned off, and thereby image degradation is prevented even when the non-video signals are written onto the respective pixels.

5 Claims, 44 Drawing Sheets

Tc
Ta gate line on (N-1)-th row
applied voltage
pixel voltage gate line on N-th row
applied voltage
pixel voltage light-emitting time
light emission
time scan timing
gate line 31A
gate line 31B
gate line on (N-1)-th row
gate line on N-th row source line transmittance
pixel on 1st row
pixel on 2nd row
pixel on (N-1)-th row
pixel on N-th row light-emitting time
light emission
light emission
Th
Th
Ta1 Ta2
Tb
Ta1 Ta2
Tb
one sub-frame period
one sub-frame period
time scan timing
gate line 31A
gate line 31B
gate line on (N-1)-th row
gate line on N-th row source line transmittance
pixel on 1st row
pixel on 2nd row
pixel on (N-1)-th row
pixel on N-th row light-emitting time
light emission
light emission
Tc
Ta1
Ta2
Tb
Th
Tc
Ta1
Ta2
Tb
Th
one sub-frame period
one sub-frame period
time

LIQUID CRYSTAL DISPLAY

FIELD OF THE INVENTION

The present invention relates to a liquid crystal display. More particularly, the present invention relates to a liquid crystal display capable of ensuring sufficient light-emitting time in one frame period.

DESCRIPTION OF THE RELATED ART

In recent years, active matrix type liquid crystal displays (hereinafter simply expressed as liquid crystal displays) have been widely used as displays for use in notebook or desktop computers.

The conventional liquid crystal displays generally employ a color filter method in which white light is adapted to travel through color filters of three primary colors, i.e., red, green, and blue provided for respective pixels, thereby conducting color display. In the liquid crystal display using such color filter method, because display is conducted for each set of three pixels, i.e., red, green, and blue pixels as described above, its resolution is as high as ⅓ of the number of pixels included in a liquid crystal display panel of the liquid crystal displays. For this reason, a liquid crystal display panel including (640×3×480) pixels is only capable of displaying an image with (640×480) resolution according to VGA standard. For the same reason, a liquid crystal display panel including (800×3×600) pixels is only capable of displaying an image with (800×600) resolution according to SVGA standard. In other words, to attain an image with a resolution, the pixels which are three times as many as the resolution are needed.

As a solution to this, liquid crystal displays of a field sequential color method have been studied. Differently from the conventional color filter method, in this field sequential color method, light is emitted by time division of one pixel by three primary colors, thereby conducting color display. To be a greater detail, one frame period is time-divided into three sub-frame periods, and red, green, and blue light-emitting diodes (LEDs) included in a backlight are adapted to emit light in the respective sub-frame periods, thereby displaying an image according to respective colors. Such field sequential color method eliminates the need for color filters and attains the resolution equal to the number of the pixels included in the liquid crystal display panel.

FIGS. 42A–42D are timing charts showing an example of display's drive mechanism in the liquid crystal display according to the conventional field sequential color method. FIG. 42A shows timing at which scan signals are output to gate lines of the liquid crystal display panel, FIG. 42B shows waveforms of video signals output to a source line, FIG. 42C shows change in transmittance of pixels on rows of the liquid crystal display panel, and FIG. 42D shows light-emitting time of LEDs of a backlight. Here, display is conducted in red and green sub-frame periods and not in the blue sub-frame period. FIGS. 42A–42D illustrate that the liquid crystal display panel has N-row pixels. The signal waveforms of FIG. 42B are illustrated for the purpose of easier understanding of the display's drive mechanism and actual signal waveforms are not limited to those of FIG. 42B.

As shown in FIG. 42A, in the liquid crystal display, scan signals are sequentially output to the gate lines on 1st through N-th rows in each of the sub-frame periods, thereby turning on switching devices connected to the respective gate lines, to cause video signals corresponding to red, green, or blue output to the source lines are written to the respective pixel electrodes. As a result, as shown in FIG. 42C, the transmittance of the pixels on the respective rows of the liquid crystal display panel increases or decreases. As shown in FIG. 42D, the backlight causes the red, green, and blue LEDs to sequentially emit light during part of the respective sub-frame periods.

The video signals thus written to the respective pixel electrodes are signals generated by compressing the red, green, or blue video signals externally input to ⅓ or less in the time-axis direction.

As should be understood from FIGS. 42A–42D, in the liquid crystal display of the conventional field sequential color method, after an elapse of a period (hereinafter referred to as a video signal write period) Ta required for writing the video signals to all the pixels and a period (hereinafter referred to as a liquid crystal response period) Tb required for the liquid crystal to fully respond in the pixels associated with the gate line (gate line on N-th row in FIG. 40) to which the scan signal is lastly output, the LEDs of the backlight emit light. Therefore, if the response speed of the liquid crystal is slow, namely, the liquid crystal response period Tb is long, then LED light-emitting time Th is correspondingly short. Consequently, the light-emitting time Th of the LEDs necessary for sufficient brightness cannot be ensured.

As a solution to this, the LEDs could be adapted to emit light before the elapse of the liquid crystal response period Tb. FIGS. 43A–43D are timing charts showing an example of display's drive mechanism of the liquid crystal display according to the conventional field sequential color method in the case where the LEDs are adapted to emit light before the elapse of the liquid crystal response period Tb.

Referring to FIG. 43D, the light-emitting time Th in each of the sub-frame periods is longer than that of FIG. 42D. Thereby, sufficient brightness can be ensured.

Nevertheless, as shown in FIG. 43C, the liquid crystal in the pixels corresponding to the gate line to which the scan signal is lastly output, i.e., the gate line on the N-th row, starts to respond latest. This results in a luminance gradient in which the luminance of the pixels decreases along the scan direction in a plane of the liquid crystal display panel, as shown in FIG. 43. For this reason, luminance variation occurs on a display screen and an image quality is degraded. Here, the "scan direction" is defined as the direction along which the scan signals are sequentially output to the respective gate lines. That is, when the scan signals are sequentially output to the gate lines on 1st to N-th gate lines, the scan direction goes from 1st to N-th row.

In addition, in the field sequential color method, color breaking is generated in display of a moving image. The color breaking refers to a phenomenon in which non-existent color is observed in an outline of an image. This is due to the fact that when viewer's eyes follow a moving object in the case where the LEDs emit light in the order of red, green and blue, a front end of the object is observed as red and a rear end is observed as blue. The detailed description of the color breaking is disclosed in Publication of Unexamined Patent Application No. Hei. 8-51633.

This color breaking is reduced by increasing the number of sub-frame periods in one frame period. This is because the increase in the number of sub-frame periods can reduce a period during which a single color is perceived and a LED light-emitting interval of each color.

However, when the number of the sub-frame periods is increased, the number of times the scan signals are output in one frame period is increased, and therefore, the ratio of the video signal write period Ta to each frame period is increased. Correspondingly, the light-emitting time Th in the respective sub-frame periods is reduced. Consequently, it is impossible to ensure brightness necessary for satisfactory display.

SUMMARY OF THE INVENTION

The present invention has been developed for obviating the above-mentioned problems and an object of the present invention is to provide a liquid crystal display capable of ensuring brightness necessary for achieving satisfactory display by increasing ratio of light-emitting time to each frame period.

Another object of the present invention is to provide a liquid crystal display capable of reducing color breaking by increasing the number of sub-frame periods in one frame period.

To achieve the above-described objects, according to the present invention, there is provided a liquid crystal display comprising: an array substrate having a plurality of gate lines and a plurality of source lines arranged to cross each other, pixel electrodes provided in matrix, and switching devices respectively provided as corresponding to the pixel electrodes, for switching between a conductive state and a non-conductive state between the pixel electrodes and the source lines according to scan signals supplied through the gate lines to allow writing of video signals supplied through the source lines to the pixel electrodes; an opposing substrate disposed opposite to the array substrate; a liquid crystal layer disposed between the array substrate and the opposing substrate and containing filled liquid crystal; a counter electrode provided on one of the opposing substrate and the array substrate, for generating potential difference between the counter electrode and the pixel electrodes, thereby driving the liquid crystal; and an illuminating device including a light source for emitting lights of a plurality of colors, wherein one frame period of the video signals is composed of a plurality of sub-frame periods, and the illuminating device is controlled to emit light of one of the plurality of colors to the liquid crystal layer in each sub-frame period, and predetermined signals are written onto the pixel electrodes in the order of first writing and second writing in at least one sub-frame period, for allowing the video signals associated with the at least one sub-frame period to be supplied to the pixel electrodes to cause the liquid crystal to be driven to thereby allow image corresponding to the video signals to be displayed.

With such constitution, e.g., by conducting the first writing to enable the liquid crystal to respond in advance in the case where the video signals are written onto the pixel electrodes by the second writing, the response period of the liquid crystal can be made shorter than that of the conventional example. Consequently, it is possible to ensure light-emitting time in one frame period longer than that of the conventional example and attain sufficiently bright and satisfactory display.

In the liquid crystal display, non-video signals different from the video signals may be written onto at least part of the pixel electrodes in the first writing and the video signals may be written onto the respective pixel electrodes in the second writing. When the non-video signals are written onto the respective pixel electrodes in this manner, the liquid crystal responds before application of display signal voltage to these pixel electrodes. Consequently, it is possible to make the light-emitting time in one frame period longer than that of the conventional example.

In this case, the liquid crystal may be OCB-mode (Optically Self-Compensated Birefringence mode) liquid crystal, or otherwise may be liquid crystal having spontaneous polarization. These liquid crystals are extremely quick in response as compared to the liquid crystal of the conventional TN-mode (Twisted-Nematic mode). This makes it possible that the response period of the liquid crystal can be further reduced.

In the liquid crystal display, voltage corresponding to the non-video signals may be 0 V or larger and not larger than an intermediate voltage between voltage for white display and voltage for black display. This achieves high-speed response of the liquid crystal in transition from high to low voltage.

In the liquid crystal display, first non-video signals near voltage for black display and second non-video signals near voltage for white display may be written to the pixel electrodes in this order in the first writing.

Also, in the liquid crystal display, the non-video signals may be written onto the pixel electrodes associated with all the gate lines substantially at the same timing in the first writing. The application of the first non-video signal voltage can provide a sharp moving image and prevent the liquid crystal from backward transition of the bend alignment to the spray alignment in the OCB mode.

Also, in the liquid crystal display, the plurality of gate lines may be divided into a plurality of blocks and scan signals may be output to the gate lines of each block substantially at the same timing in the first writing, for allowing the non-video signals to be written onto the pixel electrodes associated with the gate lines of each block substantially at the same timing. Thereby, the video display of the present invention can be realized with a simple circuit configuration.

In the liquid crystal display, the illuminating device may be adapted to emit light from one main surface thereof and have luminance distribution in which luminance decreases according to scan direction in a plane of the main surface. This makes it possible to correct the luminance gradient in the plane of the liquid crystal display panel, which has been already described with reference to FIG. 44. Consequently, the occurrence of the luminance variation can be suppressed even when the illuminating device is lighted before the elapse of the response period of the liquid crystal.

In the liquid crystal display, part of image to be displayed may be displayed in the sub-frame period by the first writing, and whole image to be displayed may be displayed by the first writing and the second writing.

Thereby, by writing of the video signals associated with part of the image by the first writing to enable the liquid crystal to respond in advance before display of whole image by the second writing, the response period of the liquid crystal can be made shorter than that of the conventional example. This makes it possible to ensure sufficiently long light-emitting time in one frame period and sufficiently bright and satisfactory image as compared to the conventional example.

In this case, for the purpose of further reducing the response period of the liquid crystal, the liquid crystal may be OCB-mode liquid crystal or liquid crystal having spontaneous polarization.

In the liquid crystal display, a video signal to be written onto one of a plurality of adjacent pixel electrodes in the direction in which the gate lines are arranged may be written onto the plurality of pixel electrodes in the first writing and video signals maybe written onto the remaining pixel electrodes of the plurality of pixel electrodes in the second writing.

Also, in the liquid crystal display, the same signal may be written onto a plurality of adjacent pixel electrodes in the direction in which the gate lines are arranged in the first writing, and video signals may be respectively written onto the plurality of pixels in the second writing.

Further, the same signal may be one of a video signal corresponding to the highest voltage and a video signal corresponding to the lowest voltage of the video signals to be respectively written onto the plurality of pixel electrodes.

Furthermore, the same signal may be a signal having an average of the video signals to be respectively written onto the plurality of pixel electrodes. Since the first writing makes it possible for the liquid crystal of respective pixels to evenly respond, the response period of the liquid crystal can be reduced without significant image degradation by mere simple calculations.

In the liquid crystal display, the same signal may be one of the video signals to be respectively written onto the plurality of pixel electrodes.

Also, in the liquid crystal display, the same signal may be a video signal to be written onto pixel electrodes associated with a gate line on odd row of the plurality of pixel electrodes in one of two continuous sub-frame periods and may be a video signal to be written onto pixel electrodes associated with a gate line on even row of the plurality of pixel electrodes in the other sub-frame period. This is preferable, because image degradation, if any, would not occur only in one of odd and even rows.

In the liquid crystal display, signals corresponding to voltage with the same polarity may be written in the first writing and the second writing. Since this makes it possible to reduce voltage difference between the signals written in the first writing and second writing, less charging is satisfactory for the pixel electrodes onto which the signals are written.

In the liquid crystal display, signals may be sequentially written onto respective pixel electrodes associated with the gate lines in one of predetermined two continuous sub-frame periods in a given order and the signals may be written onto the respective pixel electrodes associated with the gate lines in the order which is reverse of the given order. Thereby, even in the presence of the luminance gradient according to the scan direction, its gradient direction would vary for each sub-frame period, and consequently, image degradation is hardly perceived.

In the liquid crystal display, a period during which the scan signals continue to be output to the respective gate lines in the first writing is longer than a period during which the scan signals continue to be output to the respective gate lines in the second writing.

In the liquid crystal display, white display signals may be written onto at least part of the pixel electrodes in the first writing and then a video signal to be written onto one of a plurality of adjacent pixel electrodes in the direction in which the gate lines are arranged may be written in the first writing, and video signals may be written onto the remaining pixel electrodes of the plurality of pixel electrodes in the second writing. In this case, the liquid crystal may be OCB-mode liquid crystal.

In the liquid crystal display, black display signals may be written onto part of pixel electrodes and video signals may be written onto the remaining pixel electrodes in the first writing, and the video signals may be written onto part of the pixel electrodes and the black display signals may be written onto the remaining pixel electrodes in the second writing.

In the liquid crystal display, black display signals are written after the video signals are written in the first writing and the second writing.

In the liquid crystal display, the black display signals may be written onto pixel electrodes associated with a plurality of gate lines substantially at the same timing. This can reduce the write period, and correspondingly makes the light-emitting time longer.

For the purpose of reducing of the response period of the liquid crystal, the liquid crystal may be OCB-mode liquid crystal, or otherwise the liquid crystal may be liquid crystal having spontaneous polarization.

In the liquid crystal display, black is displayed in pixels corresponding to the same gate line over predetermined plural continuous sub-frame periods.

In the liquid crystal display, the one frame period may be composed of sub-frame periods greater in number than colors of light emitted by the light source.

In the liquid crystal display, the illuminating device may be controlled to emit light of different colors in two continuous sub-frame periods.

In the liquid crystal display, the illuminating device may be controlled to allow sub-frame periods of specified one color of the plurality of colors in one frame period to be greater in number than sub-frame periods of the other colors.

In the liquid crystal display, the number of the gate lines to which the scan signals are supplied in writing of the black display signals may be varied according to color of sub-frame periods.

In the liquid crystal display, the illuminating device may have a light source for emitting light of red, green, and blue, and the illuminating device may be controlled to allow the gate lines to which the scan signals are supplied to be the greatest in number in the sub-frame period of green and to be the least in number in the sub-frame period of blue.

In the liquid crystal display, the illuminating device may have a light source for emitting light of red, green, and blue, and the illuminating device may be controlled to emit one of light of a color of red, green, and blue and light of a combination of at least two colors of red, green, and blue to the liquid crystal layer in each sub-frame period.

In the liquid crystal display, the illuminating device may have a light source for emitting light of at least red, blue, and green, and the illuminating device may be controlled to emit light of one of the colors to the liquid crystal layer in each sub-frame period.

According to the present invention, there is also provided a liquid crystal display comprising: an array substrate having a plurality of gate lines and a plurality of source lines arranged to cross each other, pixel electrodes provided in matrix, switching devices respectively provided as corresponding to the pixel electrodes, for switching between a conductive state and a non-conductive state between the pixel electrodes and the source lines according to scan signals supplied through the gate lines to allow writing of video signals supplied through the source lines to the pixel electrodes, and color filters of red, green and blue; an opposing substrate disposed opposite to the array substrate; a liquid crystal layer disposed between the array substrate and the opposing substrate and containing filled liquid crystal; a counter electrode provided on one of the opposing substrate and the array substrate, for generating potential difference between the counter electrode and the pixel electrodes, thereby driving the liquid crystal; and an illuminating device including a light source for emitting white light, wherein the illuminating device is controlled to emit white light to the liquid crystal layer in part of each frame period of the video signals, and predetermined signals are written onto the pixel electrodes in the order of first writing and second writing in each frame period, for allowing the video signals associated with the frame period to be supplied to the pixel electrodes to cause the liquid crystal to be driven to thereby allow image corresponding to the video signals to be displayed in this case, the liquid crystal display, the liquid crystal may be OCB-mode liquid crystal.

With the above constitution, it is possible to realize a liquid crystal display according to a blinking backlight method, capable of ensuring sufficiently long light-emitting time in one frame period.

This object as well as other objects, features and advantages of the invention will become more apparent to those skilled in the art from the following description taken with reference to the accompanying drawings.

BRIEF DESCRIPTION OF THE DRAWINGS

FIGS. 5A–5D are timing charts showing an example of display's drive mechanism of the liquid crystal display according to the first embodiment, in which FIG. 5A shows timings at which scan signals are output to gate lines of a liquid crystal display panel, FIG. 5B shows waveforms of signals output to a source line of the liquid crystal display panel, FIG. 5C shows change in transmittance of pixels on respective rows of the liquid crystal display panel, and FIG. 5D shows light-emitting time of the LEDs of the backlight;

FIGS. 7A, 7B are views for explaining set values of the non-video signal voltage, in which FIG. 7A is a graph showing the voltage applied to the liquid crystal display panel when transitioning from a gray scale to a lower gray scale and FIG. 7B is a graph showing the associated transmittance of the liquid crystal display panel;

FIGS. 8A, 8B are views for explaining set values of the non-video signal voltage, in which FIG. 8A is a graph showing the voltage applied to the liquid crystal display panel when transitioning from a gray scale to a higher gray scale and FIG. 8B is a graph showing the associated transmittance of the liquid crystal display panel;

FIGS. 11A–11D are timing charts showing an example of display's drive mechanism of a liquid crystal display according to a second embodiment of the present invention, in which FIG. 11A shows timings at which the scan signals are output to the gate lines of the liquid crystal display panel, FIG. 11B shows waveforms of the signals output to a source line of the liquid crystal display panel, FIG. 11C shows change in transmittance in pixels on respective rows of the liquid crystal display panel, and FIG. 11D shows light-emitting time of LEDs of the backlight;

FIGS. 12A–12C are timing charts showing an example of display's drive mechanism of a liquid crystal display according to a third embodiment of the present invention, in which FIG. 12A shows timings at which the scan signals are output to the gate lines of the liquid crystal display panel, FIG. 12B shows waveforms of signals output to a source line of the liquid crystal display panel, FIG. 12C shows change in transmittance in pixels on respective rows of the liquid crystal display panel, and FIG. 12D shows light-emitting time of LEDs of the backlight;

FIGS. 13A–13C are timing charts showing an example of operation of a liquid crystal display according to a fourth embodiment of the present invention, in which FIG. 13A shows timings at which the scan signals are output to gate lines of a 1st block and change in pixel voltage of pixel electrodes associated with the gate lines, FIG. 13B shows timings at which scan signals are output to the gate lines of a 2nd block and change in pixel voltage of pixel electrodes associated with the gate lines, and FIG. 13C shows light-emitting time of the LEDs of the backlight;

FIGS. 14A–14C are timing charts showing another example of operation of the liquid crystal display according to the fourth embodiment, in which FIG. 14A shows timing at which the scan signal is output to a gate line on (N−1)-th row and change in pixel voltage of pixel electrodes (pixel electrodes on (N−1)-th raw) associated with the gate line, FIG. 14B shows timing at which the scan signal is output to a gate line on N-th row and change in pixel voltage of pixel electrodes (pixel electrodes on N-th row) associated with the gate line; and FIG. 14C shows light-emitting time of the LEDs of the backlight;

FIGS. 16A, 16B are views showing a constitution of a liquid crystal display according to a sixth embodiment of the present invention, in which FIG. 16A is a cross-sectional view schematically showing the constitution of the liquid crystal display and FIG. 16B is a plan view of a light guiding plate;

FIGS. 18A, 18B are views showing function in the case where a light source included in the liquid crystal display according to the sixth embodiment is divided into a plurality of blocks, in which FIG. 18A shows the luminance distribution in a plane of the light source and FIG. 18B shows light-emitting time in the respective blocks;

FIGS. 20A, 20B are timing charts showing an example of operation of the liquid crystal display according to the seventh embodiment, in which FIG. 20A is a diagram showing timings at which video signals are input to a source line, and FIG. 20B is a diagram showing timings at which the scan signals are output to respective gate lines;

FIGS. 21A–21C are diagrams showing how the liquid crystal in the pixels associated with the last gate line of the liquid crystal display responds, in which FIG. 21A shows timing at which the scan signal is output to the last gate line, FIG. 21B shows change in transmittance in pixels associated with the last gate line, and FIG. 21C shows light-emitting time of LEDs of the backlight;

FIGS. 22A, 22B are diagrams for explaining reduction of charging time of pixel electrodes in the liquid crystal display according to the seventh embodiment, in which FIG. 22A shows change in voltage applied to a pixel electrode in AC drive according to one-line inverting method and FIG. 22B shows change in the voltage in AC drive according to two-line inverting method employed in the seventh embodiment;

FIGS. 23A, 23B are timing charts showing another example of operation of the liquid crystal display according to a seventh embodiment of the present invention, in which FIG. 23A is a diagram showing timings at which video signals are input to a source line, and FIG. 23B is a diagram showing timings at which the scan signals are output to respective gate lines;

FIGS. 24A, 24B are timing charts showing another example of operation of the liquid crystal display according to the seventh embodiment, in which FIG. 24A is a diagram showing timings at which video signals are input to a source line, and FIG. 24B is a diagram showing timings at which the scan signals are output to respective gate lines;

FIGS. 25A, 25B are timing charts showing an example of operation of the liquid crystal display according to an eighth embodiment of the present invention, in which FIG. 25A is a diagram showing timings at which video signals are input to a source line, and FIG. 25B is a diagram showing timings at which the scan signals are output to respective gate lines;

FIGS. 26A, 26B are timing charts showing another example of the operation of the liquid crystal display according to the eighth embodiment, in which FIG. 26A is a diagram showing timings at which video signals are input to a source line, and FIG. 26B is a diagram showing timings at which the scan signals are output to respective gate lines;

FIGS. 27A–27D are timing cats showing an example of display's drive mechanism of the liquid crystal display according to a ninth embodiment of the present invention, in which FIG. 27A shows timings at which the scan signals are output to the gate lines of the liquid crystal display panel, FIG. 27B shows waveforms of signals output to a source line of the liquid crystal display panel, FIG. 27C shows change in transmittance of pixels on respective rows of the liquid crystal display panel, and FIG. 27D shows light-emitting time of the LEDs of the backlight;

FIGS. 29A–29D are timing charts showing an example of display's drive mechanism of a liquid crystal display according to a tenth embodiment of the present invention, in which FIG. 29A shows timings at which the scan signals are output to the gate lines of the liquid crystal display panel, FIG. 29B shows waveforms of signals output to a source line of the liquid crystal display panel, FIG. 29C shows change in transmittance of pixels on respective rows of the liquid crystal display panel, and FIG. 29D shows light-emitting time of the LEDs of the backlight;

FIGS. 30A, 30B are conceptual views showing an example of operation of the liquid crystal display according to an eleventh embodiment of the present invention, in which FIG. 30A represents image displayed in pixels associated with specified gate lines and FIG. 30B shows light-emitting time of LEDs of the backlight;

FIGS. 32A, 32B are conceptual views showing an example of operation of a liquid crystal display according to a twelfth embodiment of the present invention, in which FIG. 32A represents image displayed in pixels corresponding to specified gate lines and FIG. 32B shows light-emitting time of the LEDs of the backlight;

FIGS. 33A, 33B are conceptual views showing an example of operation of the liquid crystal display according to the twelfth embodiment, in which FIG. 33A represents image displayed in pixels corresponding to specified gate lines and FIG. 33B shows light-emitting time of the LEDs of the backlight;

FIGS. 34A, 34B are conceptual views showing an example of operation of a liquid crystal display according to a thirteenth embodiment of the present invention, in which FIG. 34A represents image displayed in pixels corresponding to specified gate lines and FIG. 34B shows light-emitting time of the LEDs of the backlight;

FIGS. 36A, 36B are conceptual views showing another example of operation of the liquid crystal display according to the thirteenth embodiment, in which FIG. 36A represents image displayed in pixels corresponding to specified gate lines and FIG. 36B shows light-emitting time of the LEDs of the backlight;

FIGS. 37A, 37B are conceptual views showing an example of operation of a liquid crystal display according to a fourteenth embodiment of the present invention, in which FIG. 37A represents image displayed in pixels corresponding to specified gate lines and FIG. 37B shows light-emitting time of the LEDs of the backlight;

FIGS. 38A, 38B are conceptual views showing another example of operation of the liquid crystal display according to the fourteenth embodiment, in which FIG. 38A represents image displayed in pixels corresponding to specified gate lines and FIG. 38B shows light-emitting time of the LEDs of the backlight;

FIGS. 39A, 39B are conceptual views showing an example of operation of a liquid crystal display according to a fifteenth embodiment of the present invention, in which FIG. 39A represents image displayed in pixels corresponding to specified gate lines and FIG. 39B shows light-emitting time of the LEDs of the backlight;

FIGS. 40A, 40B are conceptual views showing an example of operation of a liquid crystal display according to a sixteenth embodiment of the present invention, in which FIG. 40A represents image displayed in pixels corresponding to specified gate lines and FIG. 40B shows light-emitting time of the LEDs of the backlight;

FIGS. 41A, 41B are conceptual views showing an example of operation of a liquid crystal display according to a seventeenth embodiment of the present invention, in which FIG. 41A represents image displayed in pixels corresponding to specified gate lines and FIG. 41B shows light-emitting time of the LEDs of the backlight;

FIGS. 42A–42D are timing charts showing an example of display's drive mechanism in a liquid crystal display according to the conventional field sequential color method, in which FIG. 42A shows timings at which scan signals are output to gate lines of the liquid crystal display panel, FIG. 42B shows waveforms of video signals output to a source line, FIG. 42C shows change in transmittance of pixels on respective rows of the liquid crystal display panel, and FIG. 42D shows light-emitting time of LEDs of the backlight;

FIGS. 43A–43D are timing charts showing an example of display's drive mechanism of the liquid crystal display according to the conventional field sequential color method in the case where the LEDs are adapted to emit light before an elapse of a liquid crystal response period, in which FIG. 43A shows timings at which scan signals are output to gate lines of the liquid crystal display panel, FIG. 43B shows waveforms of video signals output to a source line, FIG. 43C shows change in transmittance of pixels on rows of the liquid crystal display panel, and FIG. 43 shows light-emitting time of LEDs of a backlight.

DETAILED DESCRIPTION OF THE PREFERRED EMBODIMENTS

Now, preferred embodiments of the present invention will be described with reference to accompanying drawings.

EMBODIMENT 1

Figure 1:
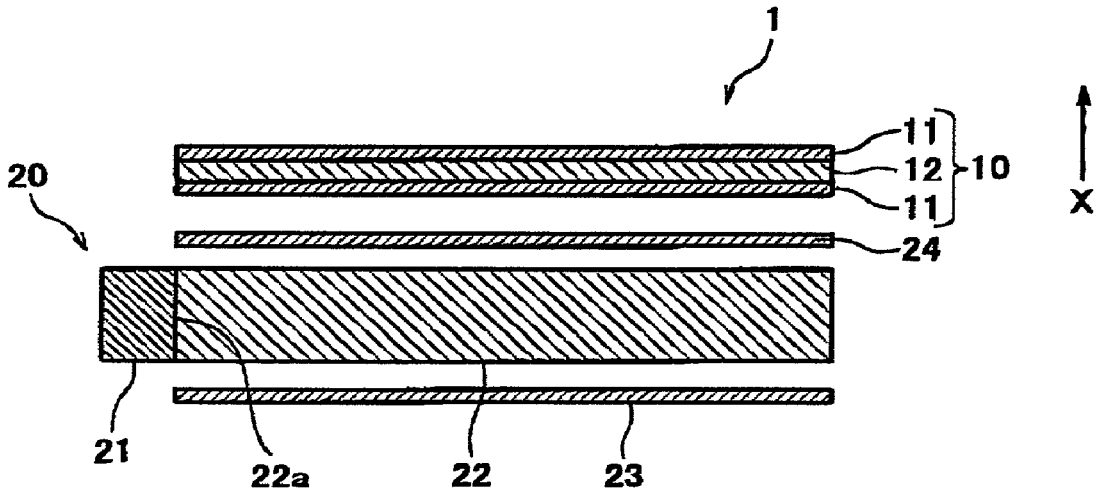
FIG. 1 is a cross-sectional view schematically showing a constitution of a liquid crystal display according to a first embodiment of the present invention.
Figure 2A:
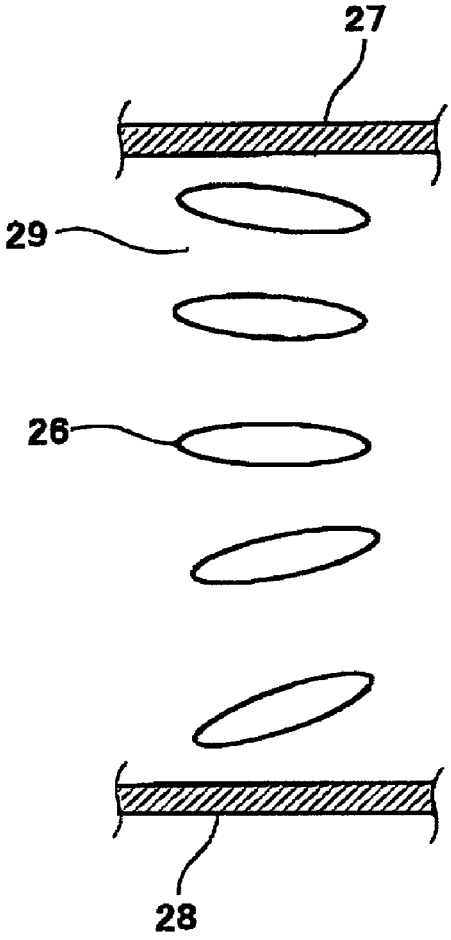
FIGS. 2A, 2B are cross-sectional views schematically showing alignment states of liquid crystal.
Figure 2B:
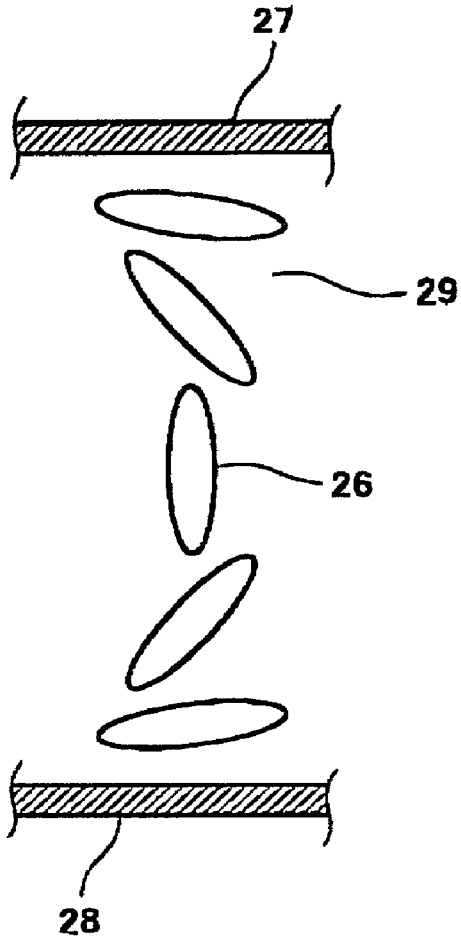

FIG. 1 is a cross-sectional view schematically showing a constitution of a liquid crystal display according to a first embodiment. FIGS. 2A, 2B are cross-sectional views schematically showing alignment state of liquid crystal filled into a liquid crystal layer included in the liquid crystal display. In these Figures, for the sake of convenience, a direction indicated by an arrow X indicates an upper side of a liquid crystal display 1.

Referring now to FIG. 1, the liquid crystal display 1 comprises a liquid crystal display panel 10 structured such that polarizers 11 are bonded to both sides of a liquid crystal cell 12. The liquid crystal cell 12 comprises two substrates, i.e., an upper substrate 27 and a lower substrate 28 disposed opposite to each other as spaced by a spacer (not shown) between them. A liquid crystal layer 29 contains liquid crystal 26 filled into a gap between the upper substrate 27 and the lower substrate 28.

The liquid crystal display panel 10 so constituted is so-called OCB-mode liquid crystal display panel, in which a given voltage is applied across the upper substrate 27 and the lower substrate 28 to cause the liquid crystal 26 to transition from spray alignment (FIG. 2A) to bend alignment (FIG. 2B), and in this bend alignment state, an image is displayed.

Figure 3:
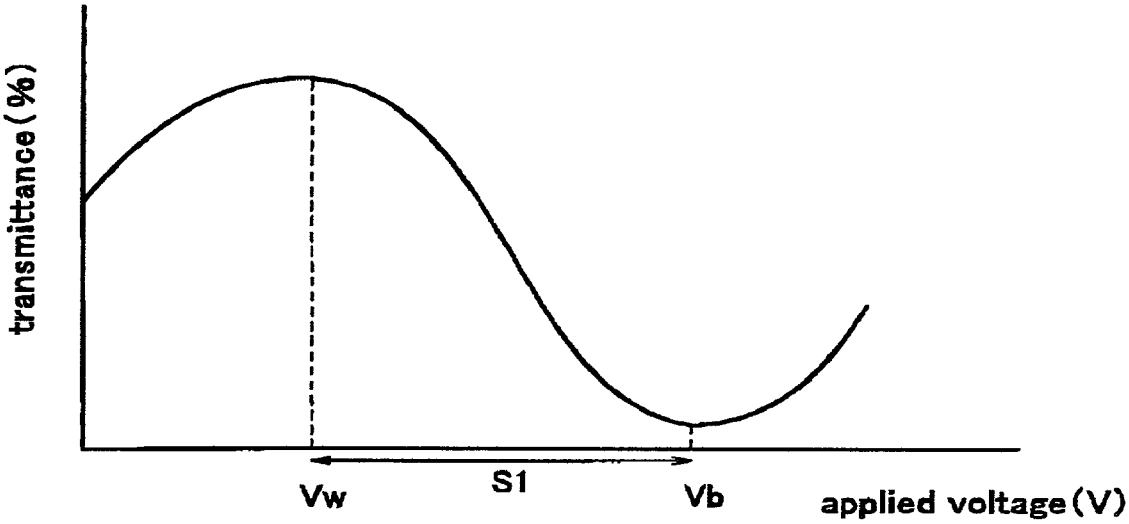
FIG. 3 is a graph showing relationship between transmittance and applied voltage of a liquid crystal display panel of a normally-white-mode of OCB-mode.

The liquid crystal display panel 10 is constituted such that white display is performed while relatively low voltage (approximately 1.5V–2V) is applied across the upper substrate 27 and the lower substrate 28 and black display is performed while relatively high voltage (approximately 4.5V–6.5V) is applied across these substrates. In brief, the liquid crystal display panel 10 is so-called normally-white-mode liquid crystal display panel. FIG. 3 is a graph showing applied voltage—transmittance characteristic of the liquid crystal display panel of the normally-white-mode of the OCB-mode. As shown in FIG. 3, in the normally white mode, a range S1 that the applied voltage could take for display includes a voltage for white display (hereinafter referred to as white display voltage) Vw as a lower limit and voltage for black display (hereinafter referred to as black display voltage) Vb as an upper limit.

A backlight 20 is provided below the liquid crystal display panel 10. The backlight 20 comprises a light guiding plate 22 made of transparent plastics, a light source 21 placed in the vicinity of an end face 22*a* of the light guiding plate 22 as opposed to the end face 22*a*, a reflector 23 placed below the light guiding plate 22, and a light diffusing sheet 24 provided above the light guiding plate 22.

The light source 21 of the backlight 20 is a LED array in which LEDs (light-emitting diodes) for emitting light of three primary colors —red, green, and blue, are sequentially and repeatedly arranged.

The light source is not limited to the aforesaid LEDs, although they are suitable as the light source 21 of the backlight 20 of the liquid crystal display of the present invention, because of ease of control for blinking or the like. By way of example, a cold cathode tube may be used as the light source 21 for the purpose of high luminance.

While this embodiment illustrates an edge-light type backlight in which the light source 21 is placed in the vicinity of the end face 22*a* of the light guiding plate 22 as opposed to the end face 22*a*, a backlight with the light source 21 placed below the light guiding plate 22, or otherwise, a planar backlight using an electro-luminescence (EL) light-emitting element, may be used.

In the backlight 20 so constituted, the light emitted from the light source 21 is incident on the light guiding plate 22 through the end face 22*a*. The incident light is multiple-scattered inside of the light guiding plate 22 and emanates from the entire upper surface thereof. In this case, the light leaking downward from the light guiding plate 22 and incident on the reflector 23 is reflected by the reflector 23 and returned to the inside of the light guiding plate 22. The light emanating from the light guiding plate 22 is diffused by the light diffusing sheet 24 and the resulting diffused light is incident on the liquid crystal display panel 10. Thereby, the liquid crystal display panel 10 is entirely and uniformly irradiated with red, green, or blue light.

Figure 4:
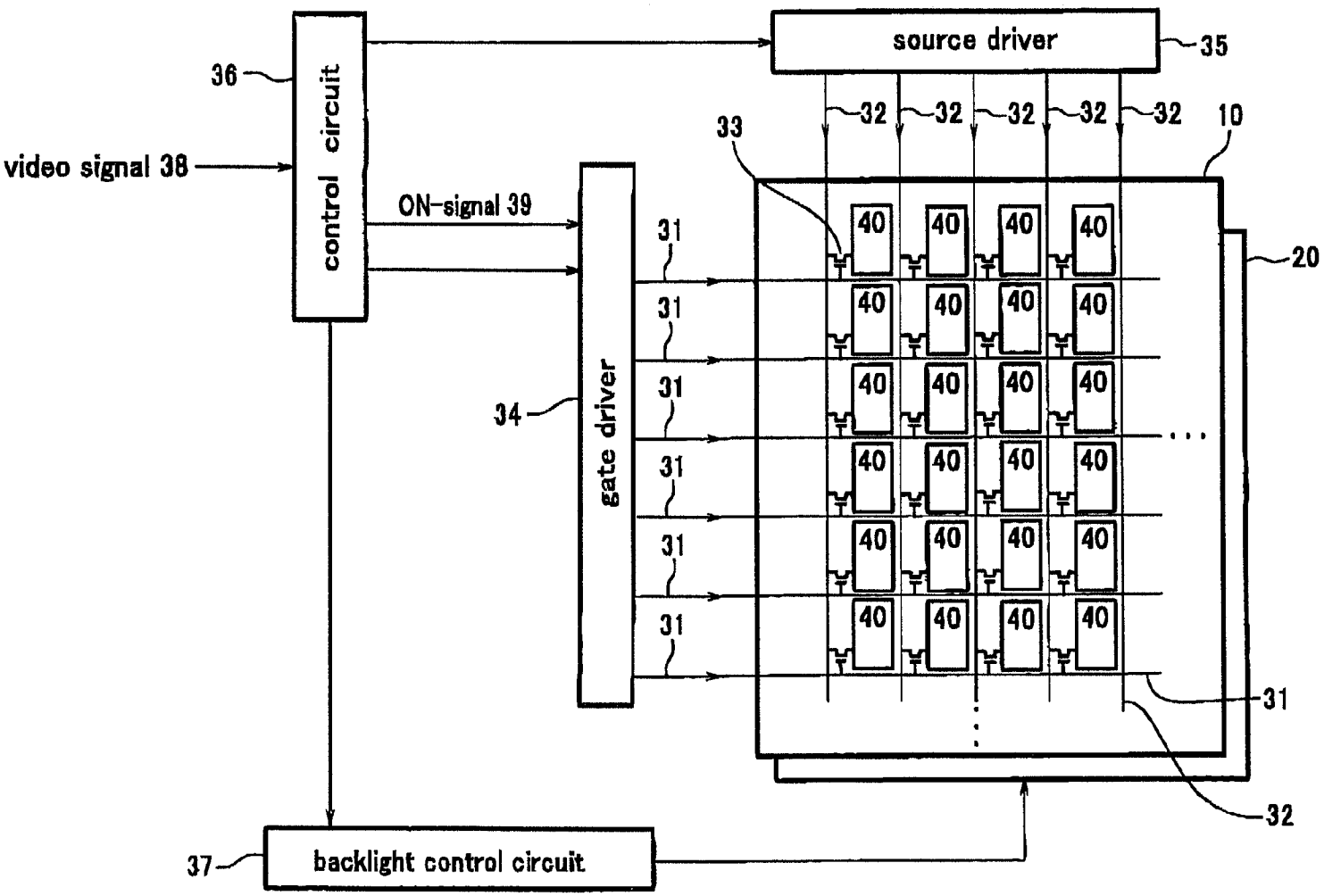
FIG. 4 is a block diagram showing the constitution of the liquid crystal display according to the first embodiment.

FIG. 4 is a block diagram showing a constitution of the liquid crystal display 1 according to the first embodiment. Referring to FIGS. 1, 2, 4, the liquid crystal display panel 10 is a well-known TFT (Thin Film Transistor) type display panel comprised of an opposing substrate (not shown) provided with counter electrodes (not shown) on an inner surface thereof, and an array substrate (not shown) provided with pixel electrodes 40, gate lines 31, source lines 32, and switching devices 33 on an inner surface of thereof, which are disposed opposite to each other with the liquid crystal layer 29 interposed therebetween. In the array substrate, the gate lines 31 and the source lines 32 are arranged to cross each other, and the pixel electrode 40 and the switching device 33 are provided for every pixel defined by the gate lines 31 and the source lines 32. The gate lines 31 and the source lines 32 are respectively driven by a gate driver 34 and a source driver 35, which are controlled by a control circuit 36.

The counter electrodes may be provided on the array substrate instead of the opposing substrate. That is, the liquid crystal display 1 may be constituted similarly to, e.g., an IPS (In-Plane-Switching) mode liquid crystal display.

In the liquid crystal display 150 constituted the control circuit 36 outputs a control signal to a backlight control circuit 37 to cause the LEDs to sequentially emit color lights in a given cycle. To perform display in synchronization with this light emission, the control circuit 36 converts a video signal 38 externally input into a field sequential collar video signal (video signal compressed in time-axis direction for the purpose of displaying an image in each sub-frame period) and then, according to the resulting converted video signal, outputs control signals to the gate driver 34 and the source driver 35, respectively. As a result, the gate driver 34 outputs scan signals corresponding to voltage for turning on the switching devices 33 to cause the pixel electrodes 40 and the source lines 32 to be conductive to the gate lines 31, thereby sequentially turning on the switching devices 33 of the respective pixels, and according to these timings, the source driver 35 sequentially writes the video signals to the pixel electrodes 40 of the respective pixels through the source lines 32.

To be a greater detail, the gate driver 34 outputs the scan signal to the gate line 31 on 1st row, thereby turning on the switching devices 33 connected to the gate line 31 on the 1st row. Upon the switching devices 33 being turned on, the video signals output from the source driver 35 to the respective source lines 32 are written onto the pixel electrodes 40 of the pixels on 1st row.

Then, the gate driver 34 outputs a signal corresponding to voltage for turning off the switching devices 33 to cause the pixel electrodes 40 and the source lines 32 to be non-conductive to the gate line 31 on 1st row, thereby turning off the switching devices 33 connected to the gate lines 31 on 1st row. Simultaneously, the gate driver 34 outputs the scan signal to the gate line 31 on 2nd row, thereby turning on the switching devices 33 connected to the gate line 31 on 2nd row. Thereby, as in the case of the 1st row, the video signals output from the source driver 35 to the respective source lines 32 are written onto the pixel electrodes 40 of the pixels on 2nd rows.

Thereafter, the same operation continues, and video signals are sequentially written to the pixel electrodes 40 of the pixels on respective rows, which generates potential difference between the counter electrodes and the pixel electrodes 40, thereby causing the liquid crystal 26 to be driven and transmittance of light emitted from the backlight 20 to be changed. As a result, an image corresponding to the video signal 38 is observed by a viewer.

Further, the control circuit 36 outputs an ON-signal 39 to the gate driver 34 in addition to the aforesaid control signals. The ON-signal 39 could take one of two values—High and Low. When the value of the ON-signal is Low, the gate driver 34 sequentially outputs the scan signals to the respective gate lines 31, upon reception of the ON-signal 39. Accordingly, in this case, the signals are sequentially written onto the pixel electrodes 40 for every row as in the case of normal display's drive mechanism.

Meanwhile, when the value of the ON-signal 39 is High, the gate driver 34 outputs the scan signals to all the gate lines 31 at the same timing, upon reception of the ON-signal 39. As a result, the signals are written onto the all the pixel electrodes 40 at the same timing.

Subsequently, operation of the liquid crystal display 1 of this embodiment will be described.

Figures 5A, 5B, 5C, 5D:
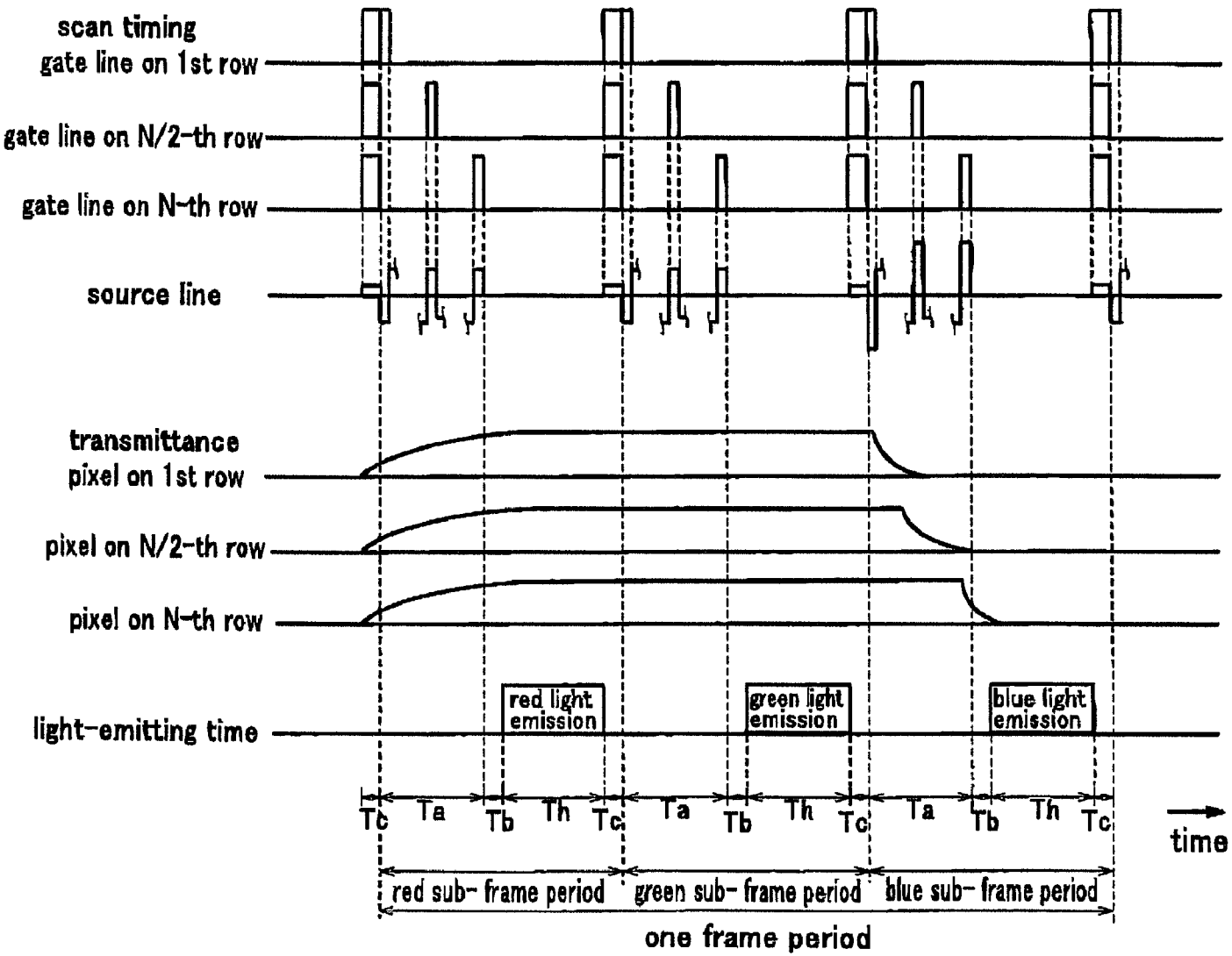

As described above, the control circuit 36 of the liquid crystal display 1 of this embodiment controls the source driver 35 to output signals given independent of the video signal 38 (hereinafter simply expressed as non-video signals) to the source lines 32. In synchronization with the non-video signals, the control circuit 36 outputs the ON-signal 39 having High value to the gate driver 34. Thereby, the non-video signals are written to all the pixel electrodes 40. In this embodiment, 1st writing is writing of the non-video signals and 2nd writing is writing of the video signals. Hereinbelow, this display's drive mechanism will be described with reference to FIG. 5. FIGS. 5A–5D are timing charts showing an example of the display's drive mechanism of the liquid crystal display 1 according to the first embodiment. FIG. 5A shows timings at which the scan signals are output to the gate lines of the liquid crystal display panel 10, FIG. 5B shows waveforms of signals output to a source line 12 of the liquid crystal display panel 10, FIG. 5C shows change in transmittance of pixels on respective rows of the liquid crystal display panel 10, and FIG. 5D shows light-emitting time of the LEDs of the backlight 20. Here, it is assumed that display is conducted during red and green sub-frame periods and is not during blue sub-frame period. The signal waveforms of FIG. 5B are illustrated for the purpose of easy understanding of the display's drive mechanism and actual signal waveforms are not limited to be those of FIG. 5B.

As shown in FIGS. 5A–5D, in the liquid crystal display 1, the period for the 1st writing i.e., the period Tc during which the non-video signals are written to all the pixels (hereinafter expressed as a non-video signal write period) is set before the video signal write period Ta for the 2nd writing. During the non-video signal write period Tc, the control circuit 36 controls the source driver 35 to output the non-video signals to the respective source lines 32 and outputs the ON-signal 39 having High value to the gate driver 34, which in turn outputs the scan signals to all the gate lines at the same timing (see FIG. 5A). In synchronization with this, the source driver 35 outputs the non-video signals to the respective source lines 32 (see FIG. 5B). As a result, the non-video signals are written onto all the pixel electrodes. When the non-video signals are thus written onto the pixel electrodes 40 of the respective pixels, the liquid crystal display panel 10 responds and is modulated before the start of the video signal write period Ta, as shown in FIG. 5C. This can reduce the liquid crystal response period Tb and therefore make the light-emitting time of the LEDs in respective sub-frame periods longer than that of the conventional example(see FIG. 5D).

As shown in FIG. 5D, during the non-video signal write period Tc, the backlight 20 is turned off. For this reason, degradation of image can be suppressed even if the given non-video signals are written to the pixels in the non-video signal write period Tc. In view of residual light or the like of the light source, by turning off the backlight 20 a certain time before the start of the non-video signal write period Tc, the degradation of the image can be further suppressed. It should be remembered that the LEDs of the backlight 20 may be adapted to emit light during part of the non-video signal write period Tc if improvement of luminance is the main aim and the degradation of image is permissible to some degrees.

Subsequently, voltage values of the non-video signals will be described with reference to FIG. 6. As mentioned previously, the liquid crystal display 1 of this embodiment comprises the normally-white-mode liquid crystal display panel 10, and therefore white display is performed while relatively low voltage is applied and black display is performed while relatively high voltage is applied.

In general, the response speed is higher in transition of low voltage to high voltage (Rising) than in transition of high voltage to low voltage (Falling). This is because energy is larger in application of high voltage than in application of low voltage. It is therefore desirable that the voltage applied to the liquid crystal display panel 10 as the non-video signal have a value enabling the liquid crystal to respond fast in Falling rather than in Rising.

Accordingly, in this embodiment, a voltage Vm between the white display voltage Vw and the black display voltage Vb is set as an upper limit of the range S2 that the voltage applied to the liquid crystal display panel 10 as the non-video signal (hereinafter expressed as non-video signal voltage) could take. By thus setting the non-video signal voltage to the voltage Vm or less, the difference between the white display voltage Vw and the non-video signal voltage becomes not larger than the difference between the black display voltage Vb and the non-video signal voltage. This advantageously achieves the fast response speed of the liquid crystal in Falling. By way of example, it is preferable that Vm=(Vw+Vb)/2.

Figure 6:
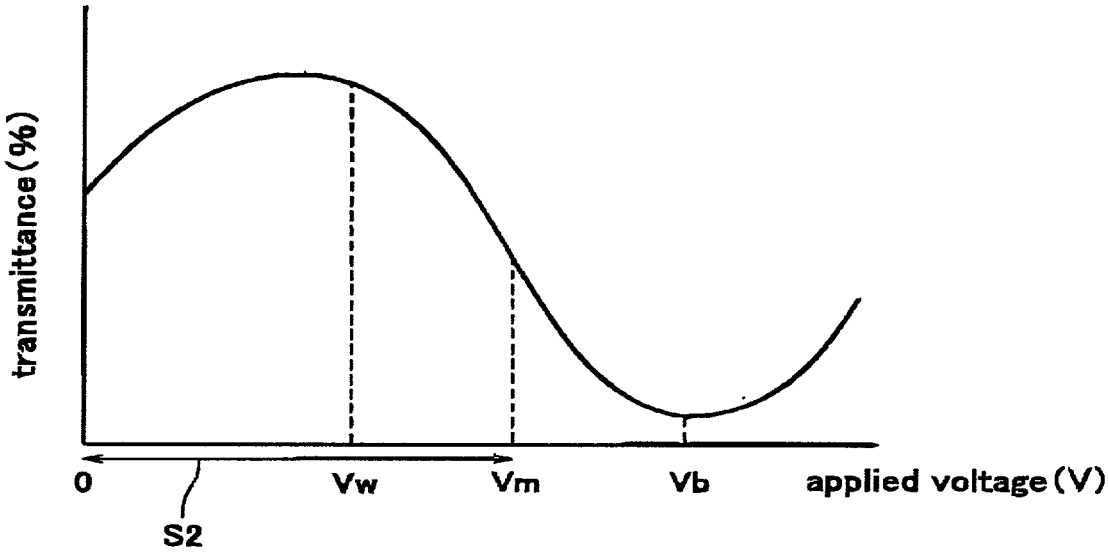
FIG. 6 is a graph showing a range that non-video signal voltage takes.

Meanwhile, a lower limit of the range S2 that the non-video signal voltage could take is 0V as shown in FIG. 6. As shown in FIG. 6, the white display signal voltage Vw is higher than 0V. By temporarily applying the voltage lower than the white display signal voltage Vw when white display is conducted, the liquid crystal 26 more quickly changes into the alignment state for white display. It is therefore desirable to set the lower limit of the range S2 to 0V.

By setting the non-video signal voltage within the range S2, the liquid crystal response period Tb of FIG. 5 can be reduced, and the light-emitting time Th of the LEDs can be made correspondingly longer. As a result, sufficient bright display is attained.

The value of the non-video signal voltage set within the range S2, varies depending on types of mode and liquid crystal materials. For instance, in modes such as TN (Twisted Nematic) or MVA (multi domain vertically Aligned), the response speed of the liquid crystal display panel is sometimes slowed in transition from intermediate gray scale to higher or lower gray scale than in transition from the highest gray scale (white display) to the lowest gray scale (black display) or otherwise transition from the lowest gray scale to the highest gray scale. Considering this fact, it is desirable to set the non-video signal voltage to allow the liquid crystal display panel to respond fast in transition from the intermediate gray scale to another gray scale, when the liquid crystal display 1 is applied to these modes.

Figure 7A:
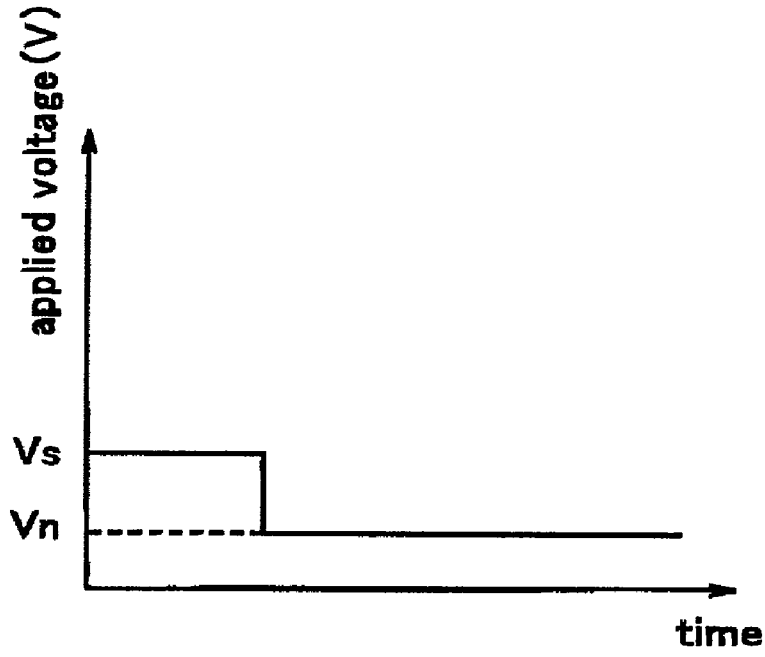
Figure 7B:
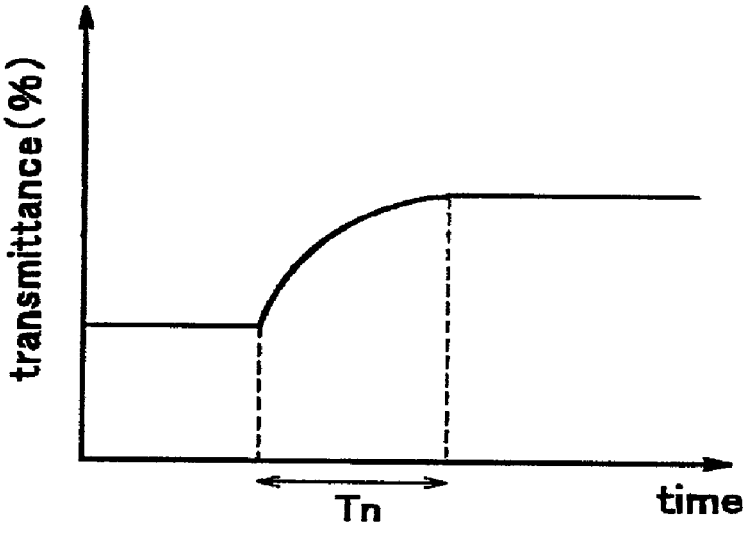
Figure 8A:
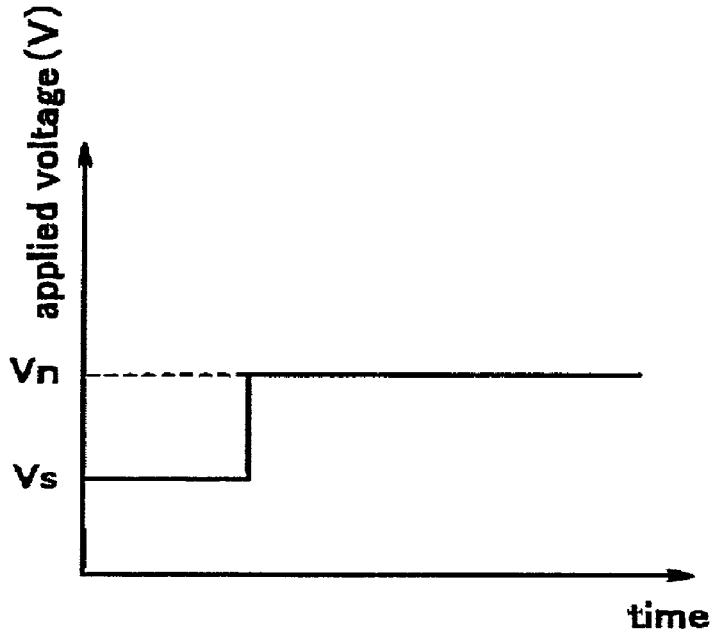
Figure 8B:
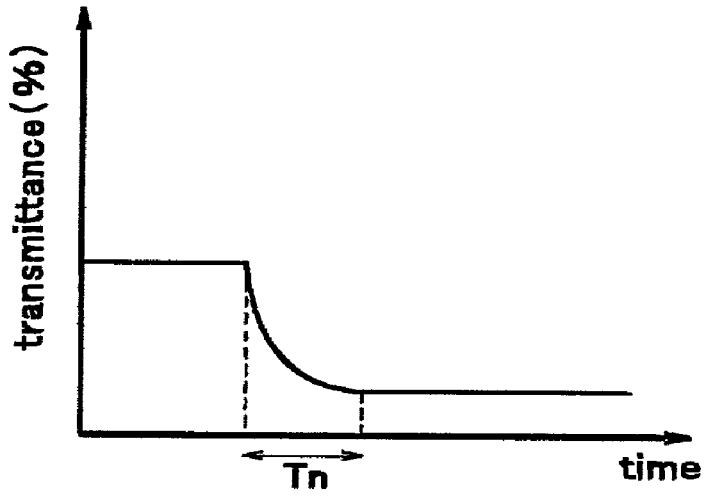

Accordingly, it is desirable to set the non-video signal voltage according to the following two objectives. FIGS. 7A, 7B and FIGS. 8A, 8B are views for explaining set values of the non-video signal voltage. FIG. 7A is a graph showing the voltage applied to the liquid crystal display panel 10 when transitioning from a gray scale to a lower gray scale and FIG. 7B is a graph showing the associated transmittance of the liquid crystal display panel 10. FIG. 8A is a graph showing the voltage applied to the liquid crystal display panel 110 when transitioning from a gray scale to a higher gray scale and FIG. 8B is a graph showing the associated transmittance of the liquid crystal display panel 10. In FIGS. 7A, 7B, BA, 8B, the non-video signal voltage applied in the non-video signal write period Tc is represented as Vs and a video signal voltage corresponding to a video signal of a gray scale n is represented as Vn. Also, time required for obtaining transmittance necessary for display in the gray scale n is represented as Tn.

The first objective is to improve the slowest response of the liquid crystal. In this case, first, times Tn when a gray scale transitions to another gray scale are measured in advance, and among them, the longest time Tnmax, namely, the slowest response of the liquid crystal, is identified. Then, the voltage enabling reducing of the identified time Tnmax, i.e., fastest response of the liquid crystal, is set as the non-video signal voltage Vs.

By achievement of the first objective, the slowest response of the liquid crystal can be improved. Consequently, display without luminance variation can be realized unlike in the conventional example.

The second objective is to quicken the response speed of the liquid crystal on average. In that case, similarly to the first objective, first, times Tn when a gray scale transitions to another gray scale are measured in advance, and the voltage enabling reduceing an average of the times Tn, is set as the non-video signal voltage Vs.

By achievement of the second objective, the response speed of the liquid crystal can be quicken on average. Therefore, brighter display can be achieved as compared to the conventional example although there is some luminance variation when the response is the slowest.

As mentioned previously, in accordance with this embodiment, even in the case where the video signal with a level at which liquid crystal respond late is written to the pixel electrodes of the respective pixels associated with the gate line to which the scan signal is output lastly, the predetermined non-video signal voltage is applied during the non-video signal write period Tc, thereby putting forward completion of the liquid crystal response period Th. This makes it possible that the light-emitting time Th of the LEDs of the backlight can be made longer, and therefore, brighter display can be conducted than the conventional example.

Figure 9:
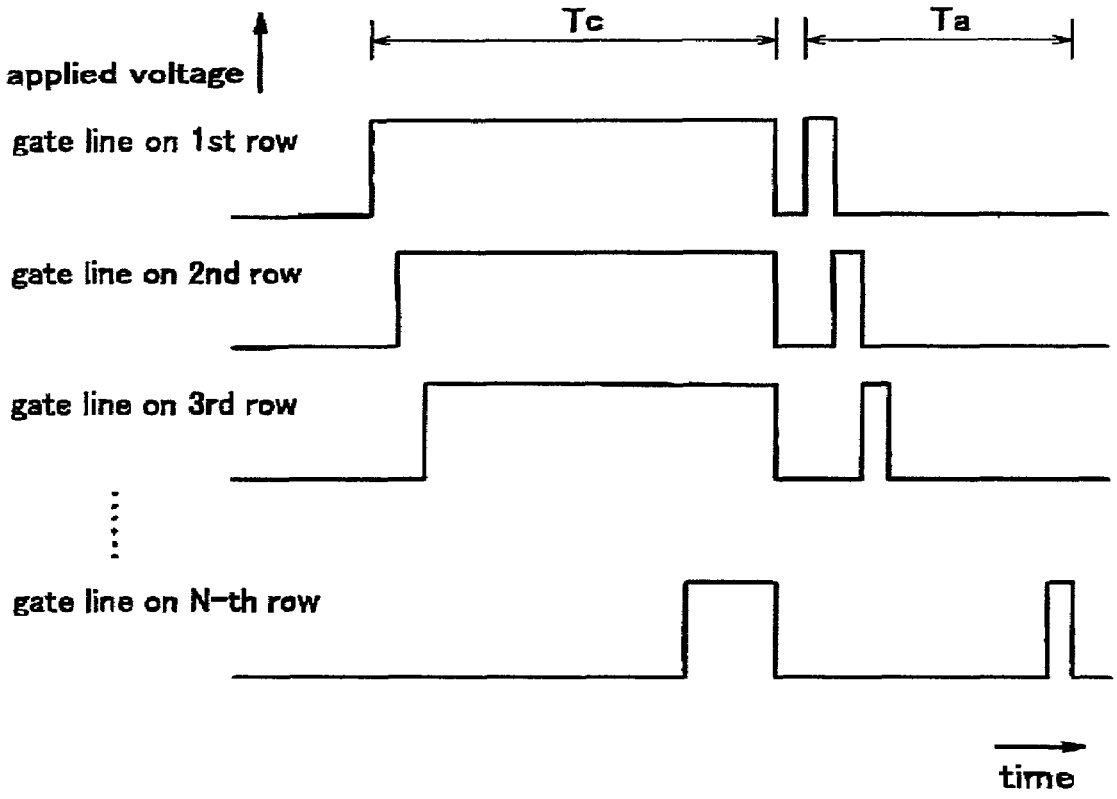
FIG. 9 is a timing chart showing another example of the operation of the liquid crystal display according to the first embodiment.

While all the gate lines 31 to which the scan signals are output at the same timing during the non-video signal write period Tc in the liquid crystal display 1, this is only illustrative. As an alternative, as shown in FIG. 9, the scan signals may be sequentially output to the gate lines from 1st to last during the non-video signal write period Tc. Since gate drivers adapted to sequentially output the scan signals to the gate lines have been commercially available, the above-mentioned constitution can be achieved without development a new gate driver.

Figure 10:
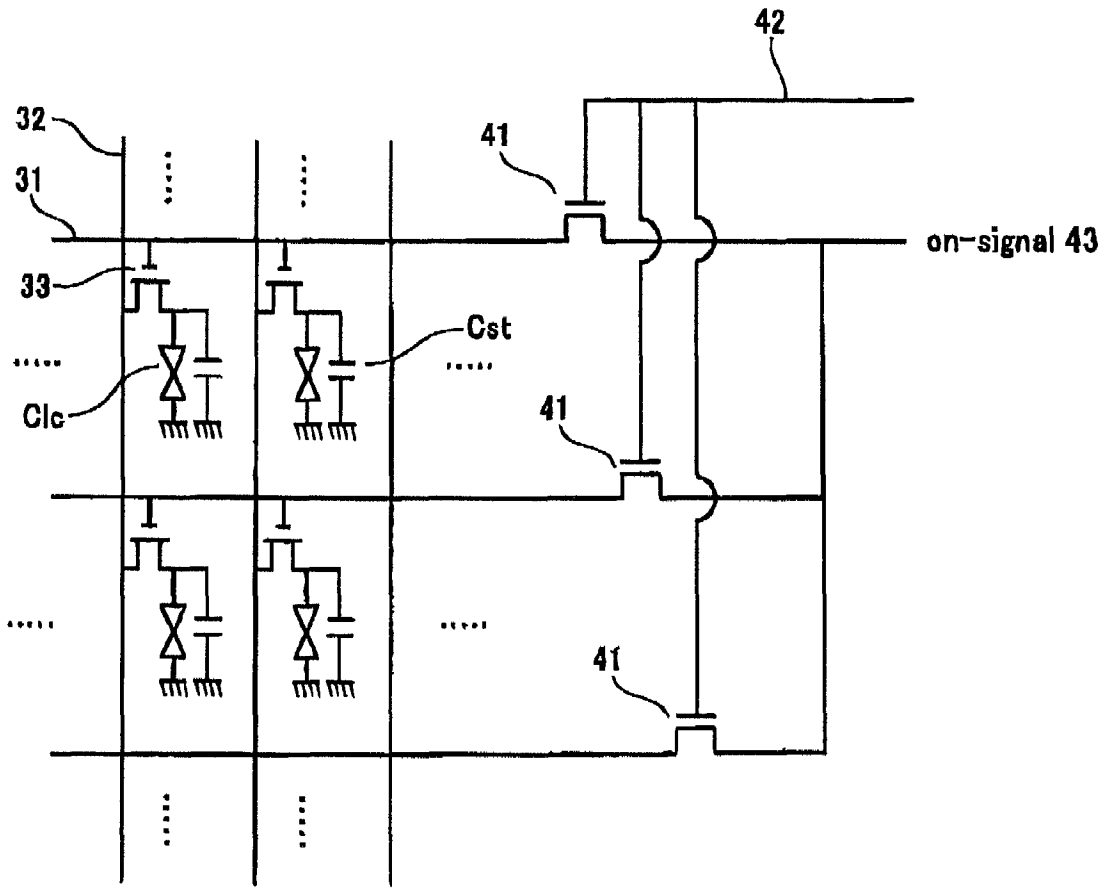
FIG. 10 is a circuit diagram showing an equivalent circuit of another example of the constitution of the liquid crystal display according to the first embodiment.

A further alternative is illustrated in FIG. 10. FIG. 10 is a circuit diagram showing an equivalent circuit of another configuration of the liquid crystal display panel 10 of the first embodiment. As shown in FIG. 10, in this configuration, switching devices 41 are each provided at a connected portion of a gate line 31 and a voltage supply line 42 on an inner surface of the array substrate. These switching devices 41 are turned on when the value of the ON-signal output from the voltage supply line 42 is High, and turned off when the value of the ON-signal is Low. When the switching devices 41 are turned on, on-signals 43 (scan signals) are output to the gate lines 31, thereby turning on the switching devices 33 connected to the gate lines 31. Thus, the scan signals can be output to all the gate lines 31 at the same timing. By outputting the scan signals in this manner, the switching devices 33 are turned on, thereby allowing the non-video signals output through the source lines 32 to be supplied to liquid crystal capacitor Clc and storage capacitor Cst.

Thus, by creating switching function in the array substrate, the existing gate driver can be used to realize the liquid crystal display of this embodiment. Therefore, low cost is realized by this configuration.

It should be noted that larger current is required to drive the switching devices 41 rather than drive the switching devices 33 provided in the respective pixels. So, in order to embody such configuration, a switching device using low-temperature poly-crystallization Si is preferably employed.

EMBODIMENT 2

A second embodiment illustrates a liquid crystal display in which the non-video signal write period of the first embodiment is divided into two periods and different non-video signal voltages are applied in these periods. In brief, the liquid crystal display is adapted to perform writing of two different non-video signals in the 1st writing. The constitution of the liquid crystal display of this embodiment is identical to that of the first embodiment, and as such, a detailed description is omitted.

Figures 11A, 11B, 11C, 11D:
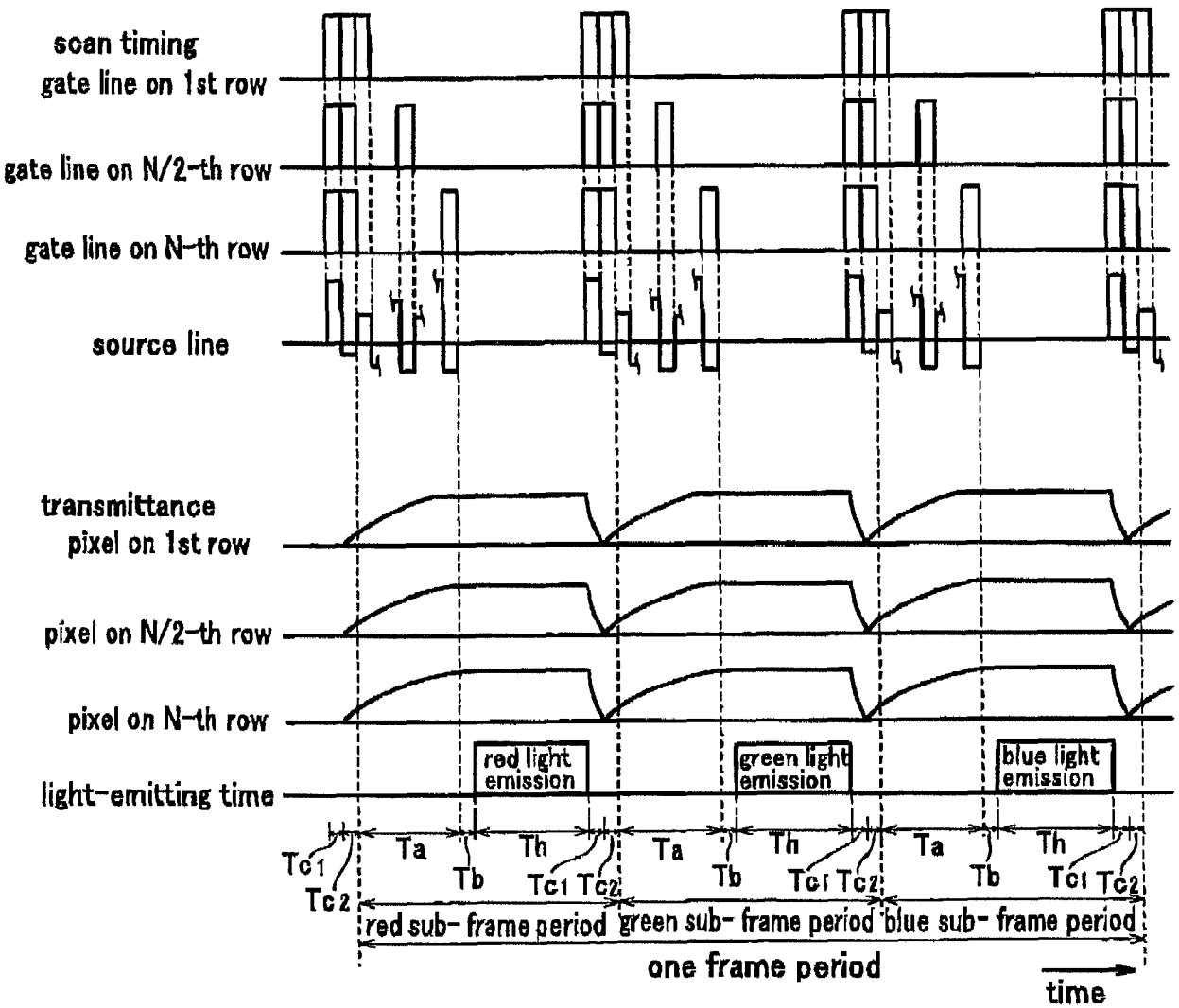

FIGS. 11A–11D are timing charts showing an example of display's drive mechanism of the liquid crystal display according to the second embodiment of the present invention. FIG. 11A shows timings at which the scan signals are output to the gate lines of the liquid crystal display panel. FIG. 11B shows waveforms of the signals output to a source line 32 of the liquid crystal display panel, FIG. 11C shows change in transmittance in pixels on respective rows of the liquid crystal display panel, and FIG. 11D shows light-emitting time of LEDs of a backlight. The signal waveforms of FIG. 11B are illustrated for easy understanding of the display's drive mechanism of this embodiment, and actual signal waveforms are not limited to those of FIG. 11B.

As shown in FIG. 11A, in the liquid crystal display, the non-video signal write period for 1st writing is set before the video signal write period Ta for 2nd writing. The non-video signal write period is divided into a 1st non-video signal write period Tc1 during which 1st non-video signals are written and a 2nd non-video signal write period Tc2 during which 2nd non-video signals are written. During the 1st non-video signal write period Tc1, a 1st non-video signal voltage near the black display voltage is applied, and during the 2nd non-video signal write period Tc2, a 2nd non-video signal voltage near the white display voltage is applied. Since the liquid crystal display of this embodiment comprises a normally-white-mode liquid crystal display panel, the 1st non-video signal voltage is set higher than the 2nd non-video signal voltage, or otherwise this may be reversed in the liquid crystal display comprising the normally-black-mode liquid crystal display panel.

Here, the 2nd non-video signal voltage serves to reduce the response period of the liquid crystal as in the case of the first embodiment, and its value is set in the manner described in the first embodiment.

When the 1st non-video signals and the 2nd non-video signals are written onto pixel electrodes of respective pixels in the 1st writing, as shown in FIG. 11C, in the liquid crystal display panel 10, just before the start of each of the sub-frame periods, transmittance falls once in the 1st non-video signal write period Tc1 and then increases in the 2nd non-video signal write period Tc2 because the liquid crystal responds and is modulated. Since the liquid crystal responds and is modulated before the start of the non-video signal write period Ta, the period required for the response is reduced as in the case of the first embodiment. Therefore, the light-emitting time in each sub-frame period can be made longer than that of the conventional example (see FIG. 11D).

The application of the 1st non-video signal voltage brings about the following three effects.

First, charging error (see J.J.A.P. Vol. 36, No.2, pp. 720 and SID'98 Digest, pp.143) caused by dielectric constant anisotropy can be prevented. This charging error is caused by the fact that different voltages are applied to the liquid crystal just before scanning even if the video signal voltage is equal. In accordance with this embodiment, the 1st non-video signal voltage near the black display voltage is applied and further, the 2nd non-video signal voltage near the white video signal voltage is applied, thereby substantially equalizing capacitance of the liquid crystal before application of the video signal voltage. Thereby, the occurrence of the charging error can be prevented.

Second, the response speed of the liquid crystal display panel in the mode in which response is slow in an intermediate gray scale, can be quickened. Specifically, the 1st non-video signal voltage is first applied to set the highest (or lowest) gray-scale voltage and then the 2nd non-video signal voltage is applied, thereby achieving fast response of the liquid crystal display panel even in the mode in which the response of intermediate gray-scale is slow, e.g., TN mode, MVA mode.

Third, backward transition in the OCB mode or the like can be prevented. As mentioned previously, generally, in the OCB mode, spray alignment (FIG. 2A) transitions to bend alignment (FIG. 2B) by application of high voltage, and in this state, an image is displayed. However, if a voltage near 0V is repeatedly applied, then the bend alignment sometimes backward transitions to the spray alignment, which makes it impossible to normally display the image. In accordance with the second embodiment, the application of the 1st non-video signal voltage (voltage larger than white display voltage Vw) enables prevention of such backward transition.

EMBODIMENT 3

In the first embodiment, one frame period is divided into three sub-frame periods. A third embodiment illustrates a liquid crystal display in which one frame period is divided into four sub-frame periods. The constitution of the liquid crystal display of this embodiment is identical to that of the first embodiment, and as such, a description is omitted.

Figures 12A, 12B, 12C, 12D:
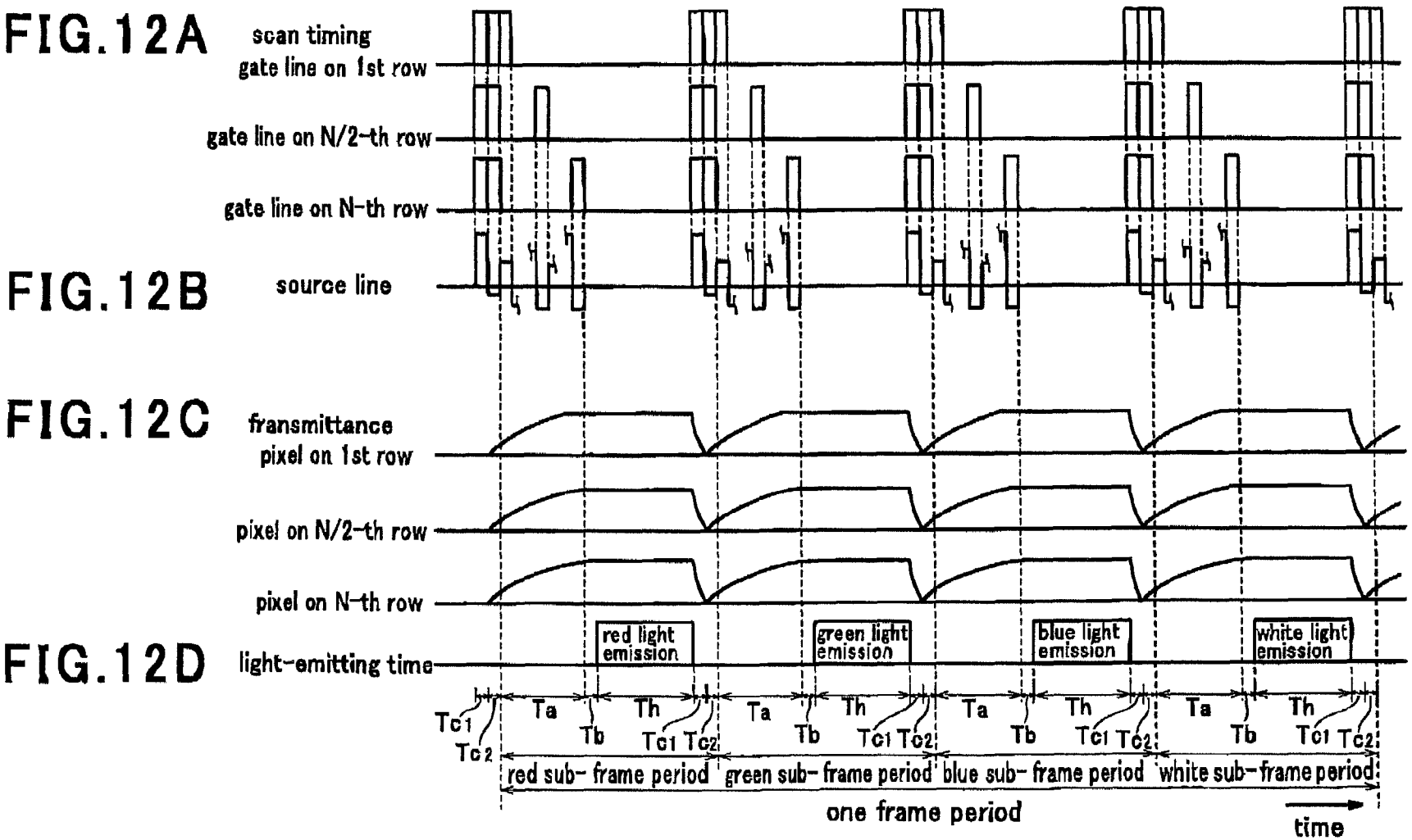

FIGS. 12A–12C are timing charts showing an example of display's drive mechanism of a liquid crystal display according to a third embodiment of the present invention. FIG. 12A shows timings at which the scan signals are output to the gate lines of the liquid crystal display panel, FIG. 12B shows waveforms of the signals output to a source line 32 of the liquid crystal display panel, FIG. 12C shows change in transmittance in pixels on respective rows of the liquid crystal display panel, and FIG. 12D shows light-emitting time of LEDs of a backlight. The signal waveforms of FIG. 12B are illustrated for easy understanding of the display's drive mechanism of this embodiment, and actual signal waveforms are not limited to those of FIG. 12B.

As shown in FIGS. 12A–12D, in the liquid crystal display of this embodiment, one frame period is time-divided into four sub-frame periods. Under the condition, the LEDs of the backlight emit red light, green light, and blue light, in respective ¼ sub-frame periods, and then all the LEDs emit red light, green light, and blue light during the remaining ¼ frame period, thereby emitting white light. This reduces color breaking.

Although white light is emitted in the 4th sub-frame period in this embodiment, LEDs may be alternatively adapted to at red light and green light for yellow light. Also, in that case, the color breaking can be prevented.

When the four sub-frame periods are provided in this way, sufficient brightness cannot be conventionally ensured because of short light-emitting time of the LEDs in one frame period, although the color breaking can be lessened. Accordingly, as shown in FIGS. 12A–12D, similarly to the second embodiment, the 1st non-video signal write period Tc1 and the 2nd non-video signal write period Tc2 are set for the 1st writing, which makes the light-emitting time of LEDs longer than those of the conventional example. For this reason, sufficient bright display can be attained even in the case where four sub-frame periods are provided in one frame period.

The more the sub-frame periods is in one frame period, the more effectively the color breaking can be reduced, and therefore five or more sub-frame periods can be provided. For example, one frame period may be composed of seven sub-frame periods in the order of red, green, blue, red, green, blue, white. The backlight may be constituted to have a light source for emitting color lights of yellow, cyan, and magenda, in addition to red, blue, and green, or adapted to emit lights of two colors of red, blue, and green to thereby emit color lights of yellow, cyan, and magenda and one frame period may be composed of six sub-frame periods in the order of red, cyan, green, magenda, blue, yellow, or otherwise, one frame period may be composed of seven sub-frame periods in the order of red, cyan, green, mageneda, blue, yellow, and white. Thus, various combinations are possible and this embodiment is applicable to any of them.

If five or more sub-frame periods are thus provided, the light-emitting time of the LEDs can be made longer than the conventional example and consequently sufficiently bright display is realized, because of the provision of the first non-video signal write period Tc1 and the second non-video signal write period Tc2 for the purpose of the first writing, which has already been described.

Instead of thus dividing the non-video signal write period into the 1st non-video signal write period Tc1 and the 2nd non-video signal write period Tc2, as a matter of course, one non-video signal write period may be provided similarly to the first embodiment.

EMBODIMENT 4

As mentioned in the first to third embodiments, the scan signals are output to all the gate lines in the non-video signal write period at the same timing, and hence, the non-video signals are written onto all the pixel electrodes at the same timing. A fourth embodiment illustrates a liquid crystal display in which the gate lines are divided into a plurality of blocks, and the scan signals are output to each of the blocks at the same timing. The constitution of the liquid crystal display is identical to that of the first embodiment except that the control circuit is not provided with the signal line through which the ON-signal is output to the gate driver, and as such description thereof is omitted.

Hereinbelow, it is assumed that the gate lines to which the scan signals are output earlier in the video signal write period is allocated for the 1st block and the gate lines to which the scan signals are output later in the video signal write period is allocated for the 2nd block. The number of gate lines allocated for each block is arbitrary. Here, ¾ of all the gate lines are allocated for the 1st block and ¼ of all the gate lines are allocated for the 2nd block. For instance, when the number of gate lines is 480, the gate lines on 1st to 360th rows are allocated for the 1st block and the gate lines on 361st to 480th rows are allocated for the 2nd block.

Figure 13A:
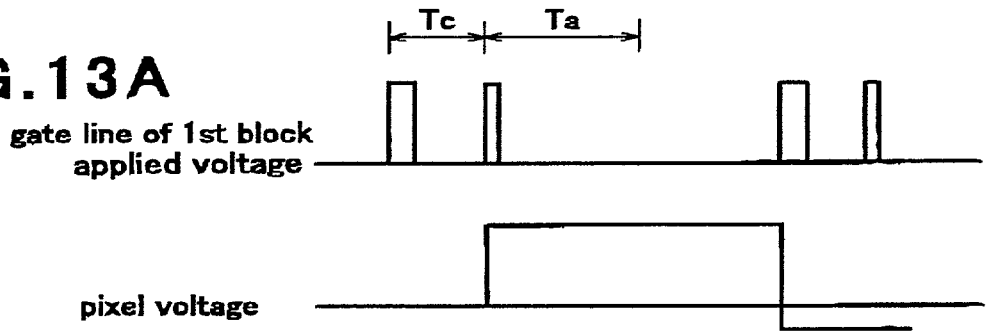
Figure 13B:
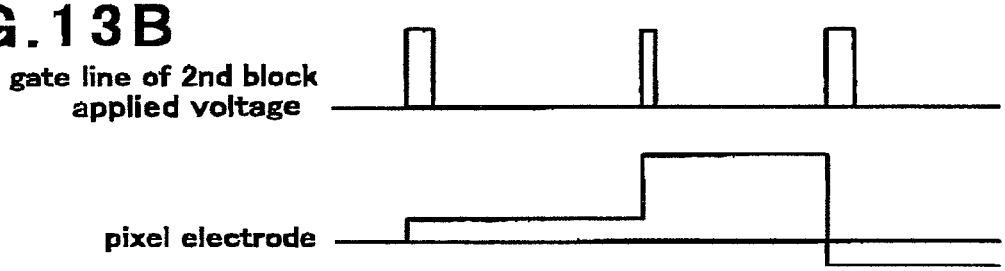
Figure 13C:
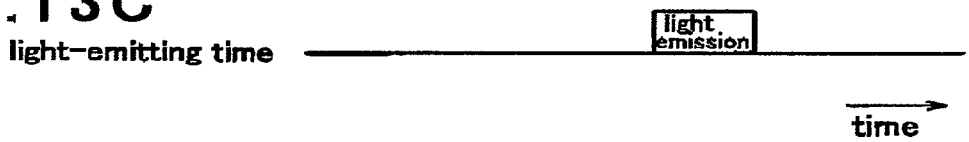

FIGS. 13A–13C are timing charts showing an example of operation of the liquid crystal display according to the fourth embodiment of the present invention. FIG. 13A shows timings at which the scan signals are output to the gate lines of the 1st block and change in the voltage (pixel voltage) applied to pixel electrodes associated with the gate lines, FIG. 13B shows timings at which the gate lines of the 2nd block are scanned and cage in the pixel voltage of the pixel electrodes associated with the gate lines, and FIG. 13C shows light-emitting time of the LEDs of the backlight.

As can be seen from FIGS. 13A, 13B, in this embodiment, the scan signals are output to the gate lines of the 2nd block in the non-video signal write period Tc. The control circuit 36 controls the source driver 35 so that the non-video signal voltage is applied only while the scan signals are output to the gate lines of the 2nd block. As a result, as shown in FIG. 13A, there is no change in the pixel voltage of the pixel electrodes associated with the gate lines of the 1st block in the non-video signal write period Tc but initial change arises in the video signal write period Ta. Meanwhile, as shown in FIG. 13B, there is some change in the pixel voltage of the pixel electrodes associated with the gate lines of the 2nd block in the non-video signal write period Tc because of application of the non-video signal voltage. This makes it possible to quicken only the response of the liquid crystal of the pixels associated with the gate lines of the 2nd block.

Figures 42A, 42B, 42C, 42D:
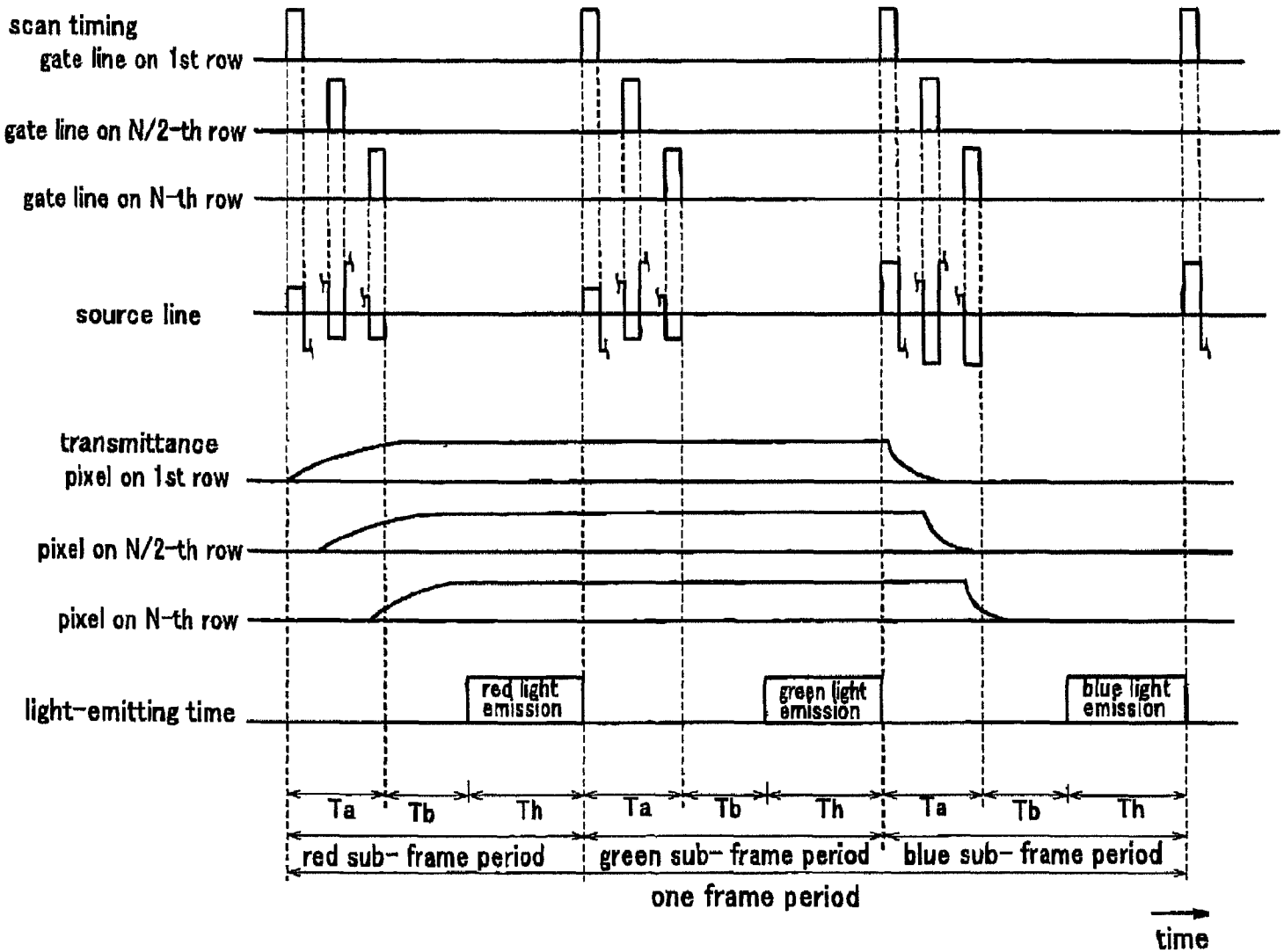
FIG.42A PRIOR ART
FIG.42B PRIOR ART
FIG.42C PRIOR ART
FIG.42D PRIOR ART
Figures 43A, 43B, 43C, 43D:
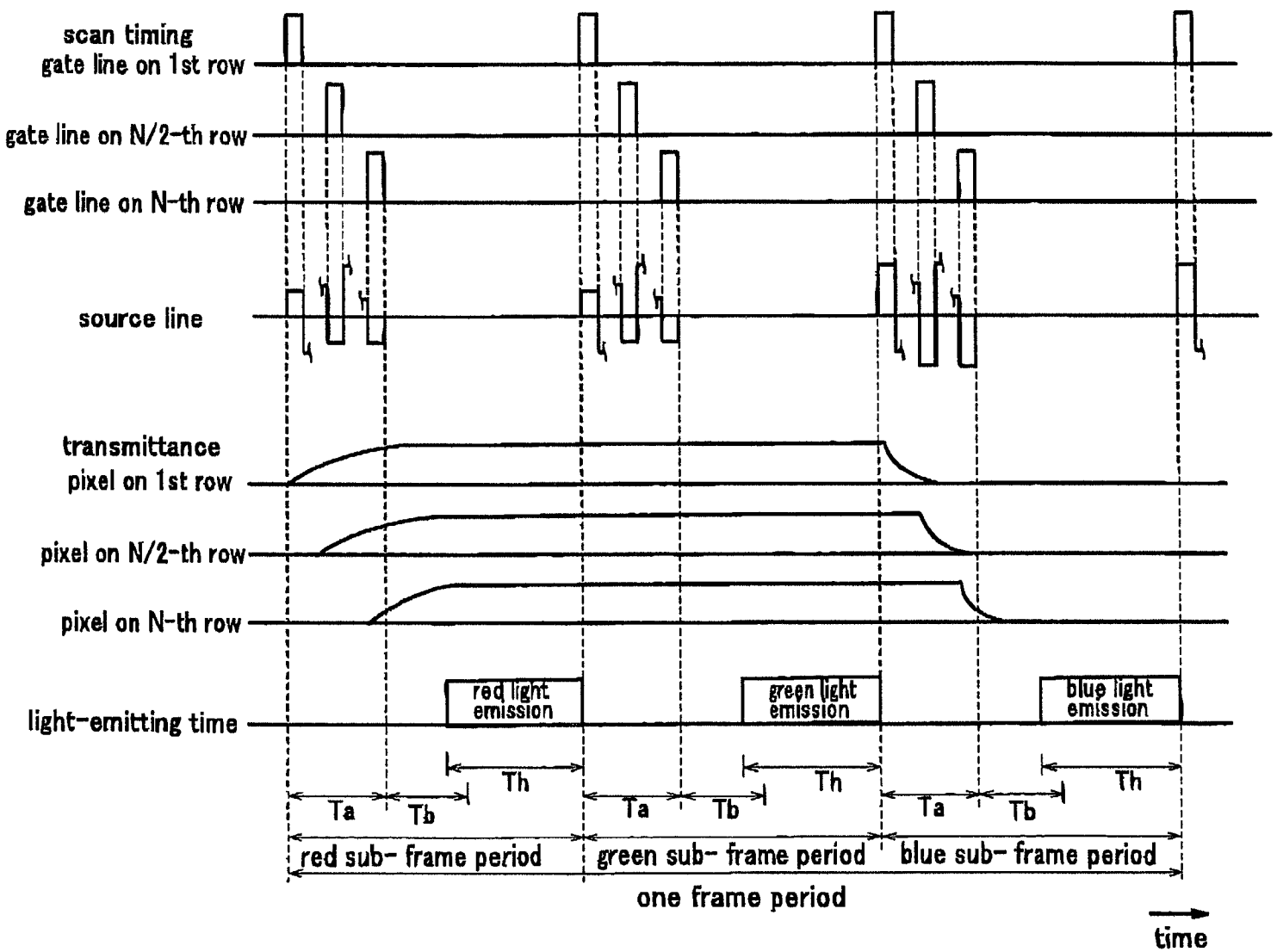
FIG.43A PRIOR ART
FIG.43B PRIOR ART
FIG.43C PRIOR ART
FIG.43D PRIOR ART

As mentioned previously with reference to FIGS. 42C, 43C, the start of the response of the liquid crystal in the pixels associated with the gate line (N-th row) to which the scan signal is output later is later. In view of this, it is desirable to quicken the response of the liquid crystal of the pixels associated with the gate lines of the 2nd block to which the scan signals are output later rather than the gate lines of the 1st block to which the scan signals are output earlier. This embodiment meets such requirement and can quicken the response of the liquid crystal in the pixels associated with the gate lines of the 2nd block. In this embodiment, the gate lines to which the non-video signal voltage is applied are less than those of the first to third embodiments, and therefore sufficient writing hardly occurs even if the current supply of the source driver is less.

It should be noted that the non-video signal voltage may be applied while the scan signals are output to the gate lines of the 1st block in the non-video signal write period Tc, although this is not performed in this embodiment. In that case, the non-video signal voltage applied to the pixel electrodes associated with the gate lines of the 1st block and the non-video signal voltage applied to the pixel electrodes associated with the gate lines of the 2nd block, could have different values. Thus, suitable voltage can be applied in the respective blocks.

Subsequently, another example of the liquid crystal display of this embodiment will be described. In this liquid crystal display, the gate lines on odd rows and the gate lines on even rows are divided into different blocks and the scan signals are output to each block at the same timing.

Figures 14A, 14B, 14C:
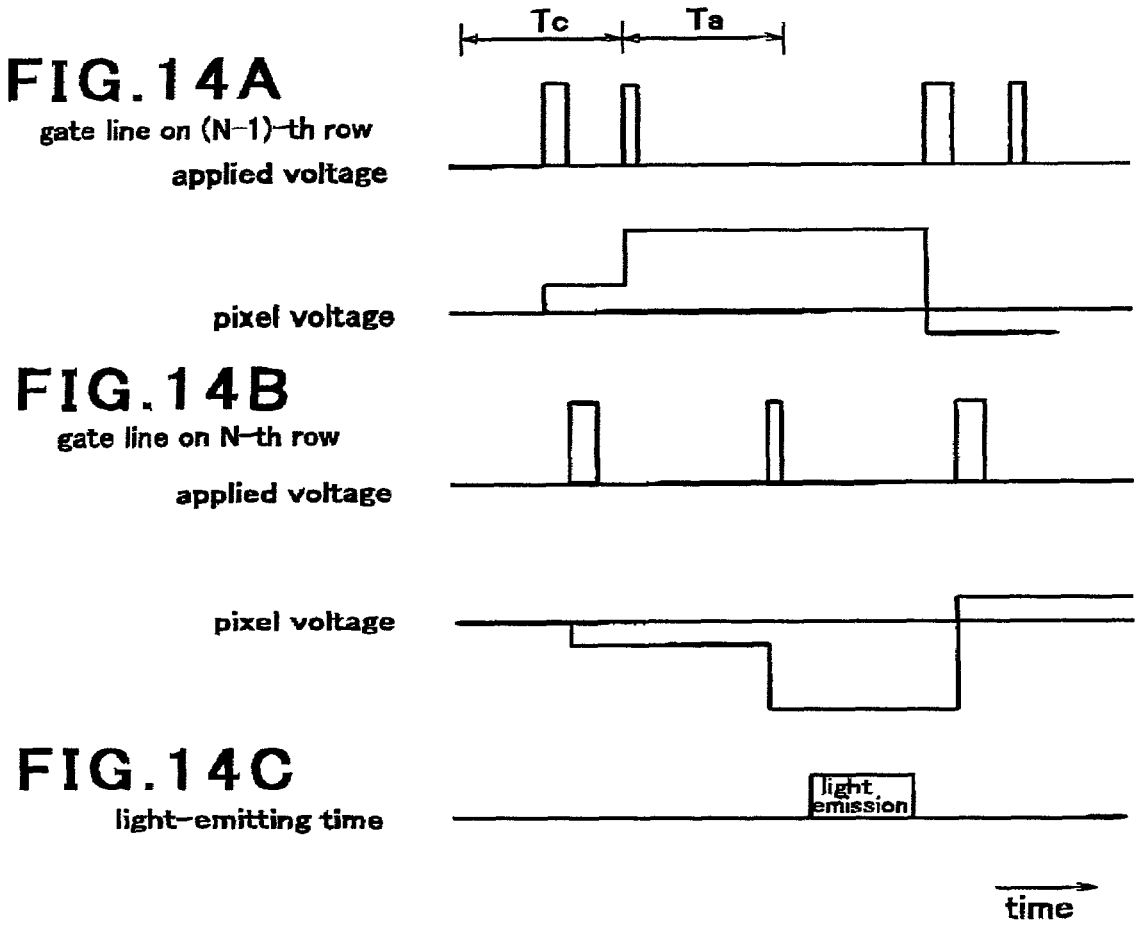

FIGS. 14A–14C are timing charts showing another example of operation of a liquid crystal display according to the fourth embodiment of the present invention. FIG. 14A shows timing at which the scan signal is output to the gate line on (N−1)-throw and change in pixel voltage of pixel electrodes (pixel electrodes on (N−1)-th row) associated with the gate line, FIG. 14B shows timing at which the scan signal is output to the gate line on N-th row and change in pixel voltage of pixel electrodes (pixel electrodes on N-th row) associated with the gate line, and FIG. 14C shows light-emitting time of LEDs of the backlight.

As can be seen from FIGS. 14A, 14B, in this embodiment, the gate line on (N−1)-th row to which the scan signal is output and then the gate line on N-th row to which the scan signal is output in the non-video signal write period Tc. Also, the non-video signal voltages reversed in polarity are applied to the pixel electrodes of the gate line on (N−1)-th row and the pixel electrodes associated with the gate line on N-th row, respectively in the non-video signal write period Tc.

In general, the liquid crystal display using the liquid crystal display panel is configured to conduct AC drive for prevention of image persistence. In the liquid crystal display according to this example, since the non-video signal voltages reversed in polarity are respectively applied to the pixel electrodes associated with the two continuous gate lines, the AC drive can be carried out in the non-video signal write period Tc as well as the video signal write period Ta.

Instead of outputting the scan signals to the plurality of gate lines at the same timing as described above, the scan signals may be sequentially output to the respective gate lines at different timings.

EMBODIMENT 5

A fifth embodiment illustrates a liquid crystal display that employs so-called capacitive coupling drive (CC drive) method. The liquid crystal display of this embodiment differs from those of the first to fourth embodiments in that the non-video signal voltage is applied through a capacitance line mentioned later. The detail of the CC drive is shown in Publication of Unexamined Patent Application No. Hei. 2-157815 or on page 59 of AM-LCD 95 Digest of technical papers.

Figure 15:
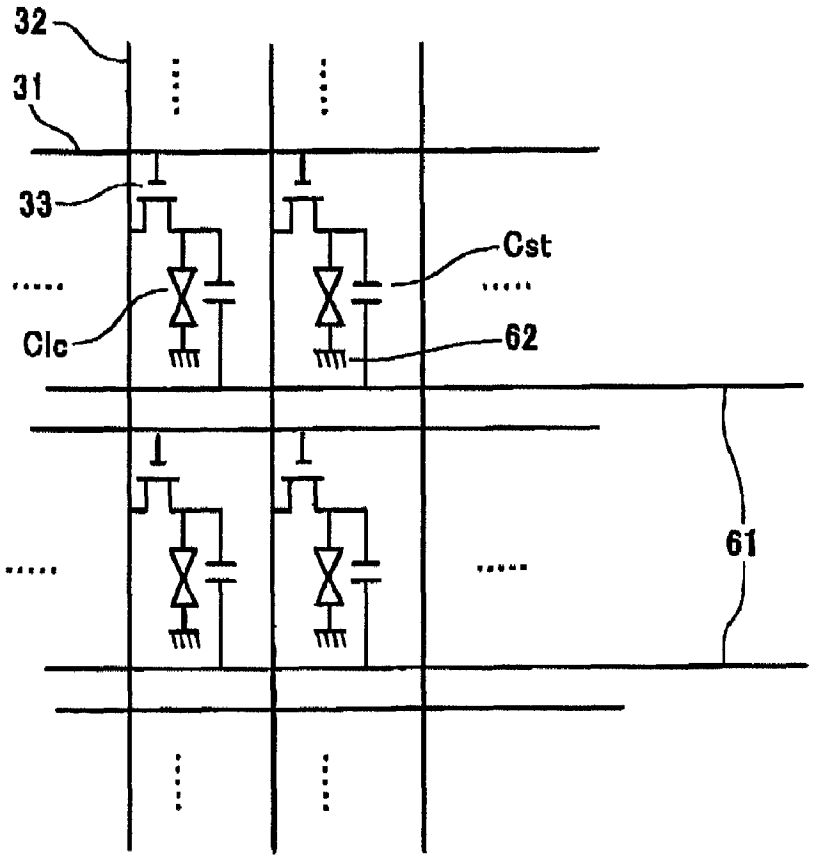
FIG. 15 is a circuit diagram showing an equivalent circuit of a liquid crystal display panel according to a fifth embodiment.

FIG. 15 is a circuit diagram showing an equivalent circuit of the liquid crystal display panel 10. As shown in FIG. 15, the liquid crystal display panel 10 is provided with capacitance lines (hereinafter referred to as common capacitance lines) parallel to the gate lines 31 on an inner surface of the array substrate. Switching device 33 are connected to source lines 32 Liquid crystal capacitor Clc is connected between the switching device 33 and a counter electrode 62 formed on the inner surface of the array substrate. Storage capacitor Cst is connected between the switching device 33 and the common capacitance line 61.

Commonly, the capacitance line is connected to the counter electrode 62, but the common capacitance line 61 is connected to a dedicated driver (not shown). The reason for this is that the common capacitance line 61 must be independently driven because a given voltage needs to be applied to the common capacitance line 61 in synchronization with the scan signal output to the gate line 31.

In CC drive, the voltage corresponding to the scan signal voltage applied to the gate line 31 is applied to the common capacitance line 61 by the dedicated driver at given timing. In the CC drive, change amount ΔVlc of the voltage applied to the liquid crystal is given by:

$$\Delta Vlc = Cst/(Cst+Clc)\times\Delta V$$

where ΔV is change amount of the voltage applied to the common capacitance line 61.

In this embodiment, the non-video signal voltages are applied through the common capacitance lines 61. As can be seen from the above formula, the voltage applied to each pixel varies depending on the liquid crystal capacitor Clc before the non-video signal voltage is applied.

Therefore, the non-video signal voltage approximating a target value is applied to the respective pixels through the common capacitance lines 61 and then the non-video signal voltage is applied to the respective pixels through the gate lines 31, thereby enabling the non-video signal voltage to be applied for a short time and properly.

As an alternative of the CC drive using the common capacitance line 61, CC drive that gives the storage capacitor onto the gate lines 31 may be employed.

EMBODIMENT 6

A sixth embodiment illustrates a liquid crystal display in which the LEDs of the backlight are adapted to emit light before the liquid crystal fully responds.

Figure 44:
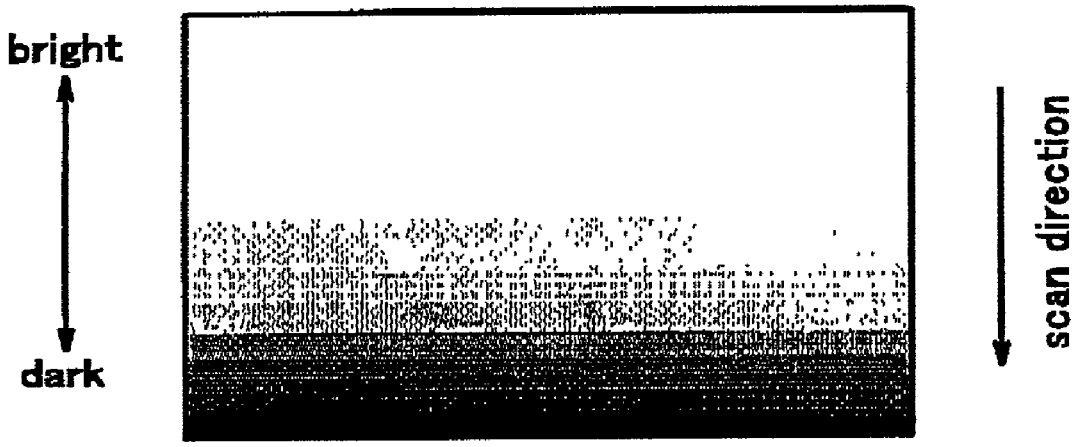
FIG.44 PRIOR ART
FIG. 44 is a conceptual view showing luminance distribution in a plane of a liquid crystal display panel included in the conventional liquid crystal display.

In actuality, in this case, luminance gradient is generated according to the order in which the scan signals are output to the respective gate lines (see FIGS. 43, 44). Accordingly, in this embodiment, such luminance gradient is corrected with the constitution of the backlight described below.

Figure 16A:
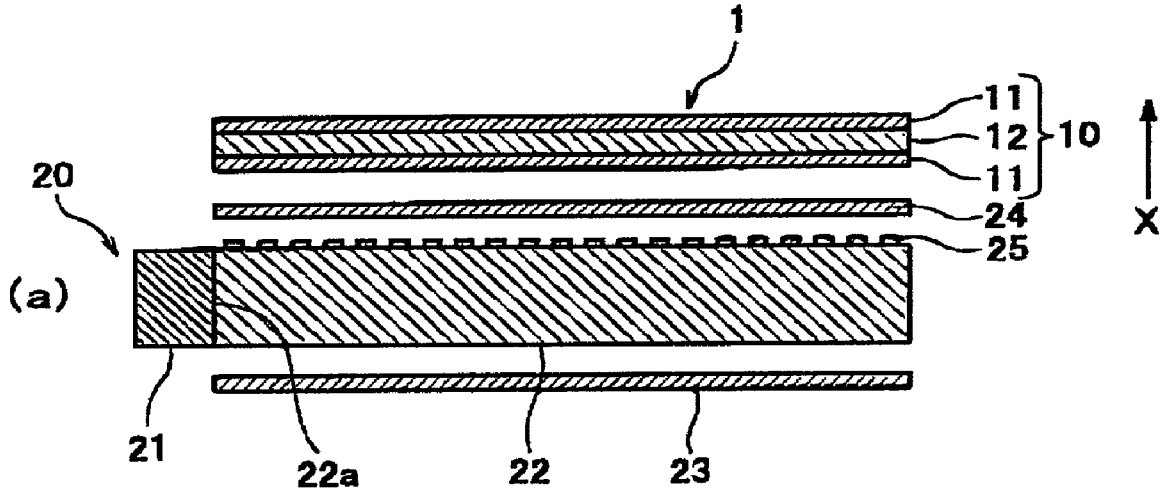
Figure 16B:
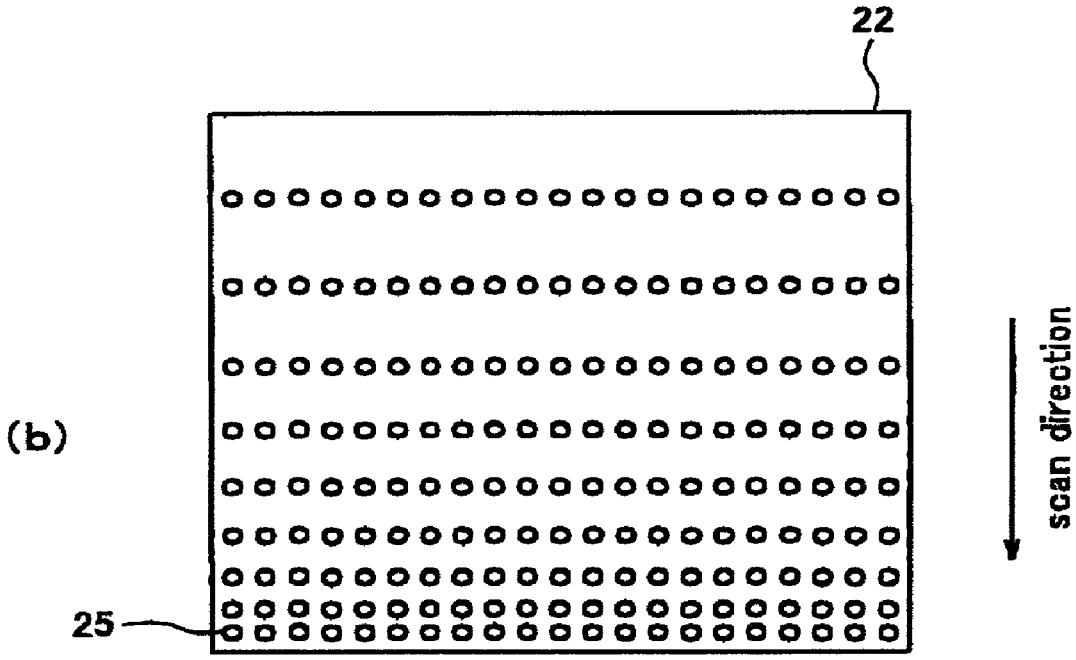

FIGS. 16A, 16B are cross -sectional views schematically showing a constitution of the liquid crystal display according to a sixth embodiment of the present invention. FIG. 16A is a cross-sectional view schematically showing the constitution of the liquid crystal display and FIG. 16B is a plan view of a light guiding plate. In this embodiment, a dot pattern 25 for scattering light is provided on the upper surface of the light guiding plate 22. Since the other elements are identical to those of the first embodiment, the same or corresponding elements are referenced by the same reference numbers, and as such, a description thereof is omitted.

The dot pattern 25 is provided on the upper surface of the light guiding plate 22 with density gradually varying so that the region corresponding to the pixel electrodes associated with the gate line to which the scan signal is lastly output is the brightest. That is, as shown in FIG. 16B, the density increases according to the direction in which the gate lines are scanned. The dot pattern 25 is created by printing white-based paint or the like.

In the backlight 20 so constituted, the light emitted from the light source 21 is incident on the light guiding plate 22 through the end face 22*a*. At this time, the light leaking downward from the light guiding plate 22 is reflected by the reflector 23 and returned to the inside of the light guiding plate 22. The light incident on the light guiding plate 22 is multiple-reflected inside of the light guiding plate 22 and emanates from the upper surface thereof. The light emanating from the upper surface of the light guiding plate 22 is scattered by the dot pattern 25, and further diffused by the light diffusing sheet 24. The liquid crystal display panel 10 is irradiated with this light.

Figure 17:
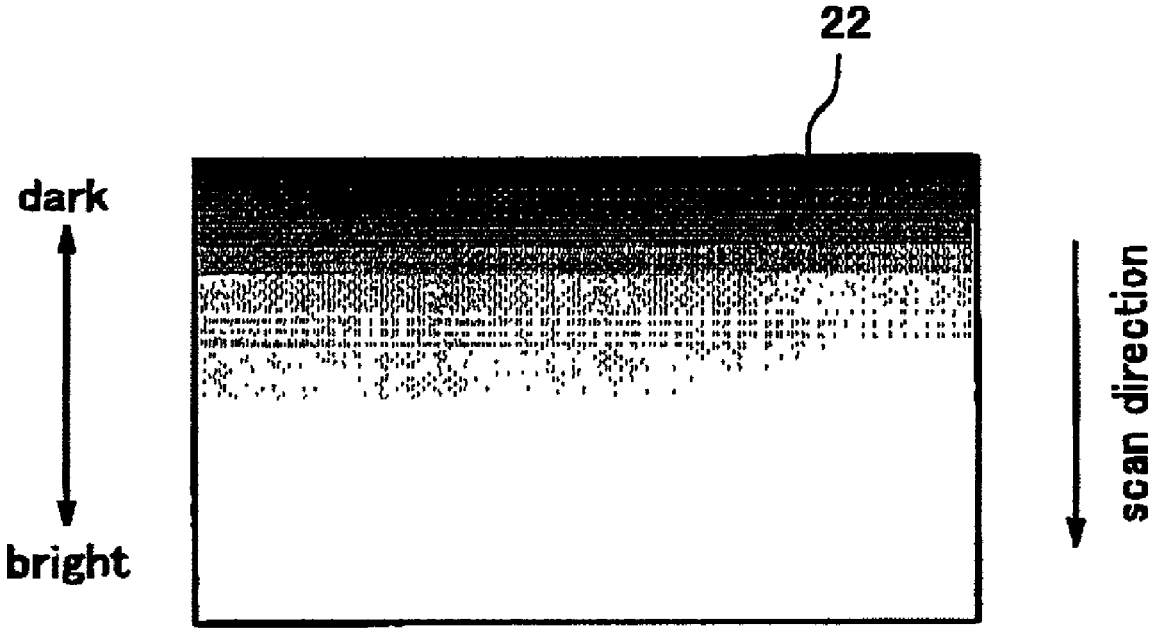
FIG. 17 is a conceptual view showing luminance distribution in a plane of a light guiding plate included in a liquid crystal display according to the sixth embodiment of the present invention.

As described above, the dot pattern 25 is provided on the upper surface of the light guiding plate 22 with higher density at the region corresponding to the pixel electrodes associated with the gate line to which the scan signal is output later. This makes it possible that luminance distribution has luminance gradient increasing according to the scan direction in a plane of the light guiding plate 22, as shown in FIG. 17.

Meanwhile, when the LEDs of the backlight 20 emit light before the liquid crystal display panel 10 fully responds, the liquid crystal display panel 10 is darker according to the scan direction as described with reference to FIGS. 43, 44. So, by setting the luminance of the backlight 20 higher according to the scan direction, it is possible to correct the gradient of the luminance distribution in the plane of the liquid crystal display panel 10. As a result, luminance variation can be lessened.

Instead of the dot pattern, lenses, prisms or grooves may be provided on the upper surface of the light guiding plate 22 for allowing adjustment of the luminance distribution.

Instead of the dot pattern 25, a light source may be divided into a plurality of blocks using, e.g., a plurality of cold cathode tubes and luminance of the respective blocks and timings of light emission may be controlled, thereby allowing correction of the gradient of the luminance distribution in the plane of the liquid crystal display panel 10. In that case, the light guiding plate 22 is omitted.

Figure 18A:
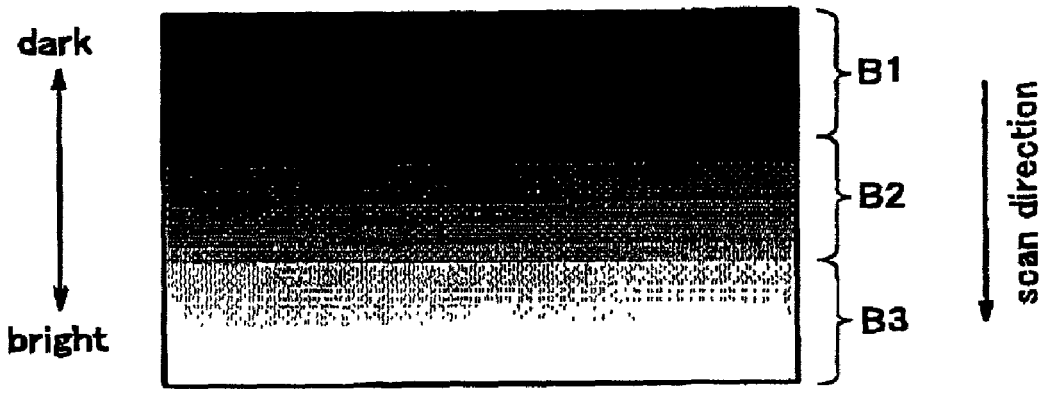
Figure 18B:
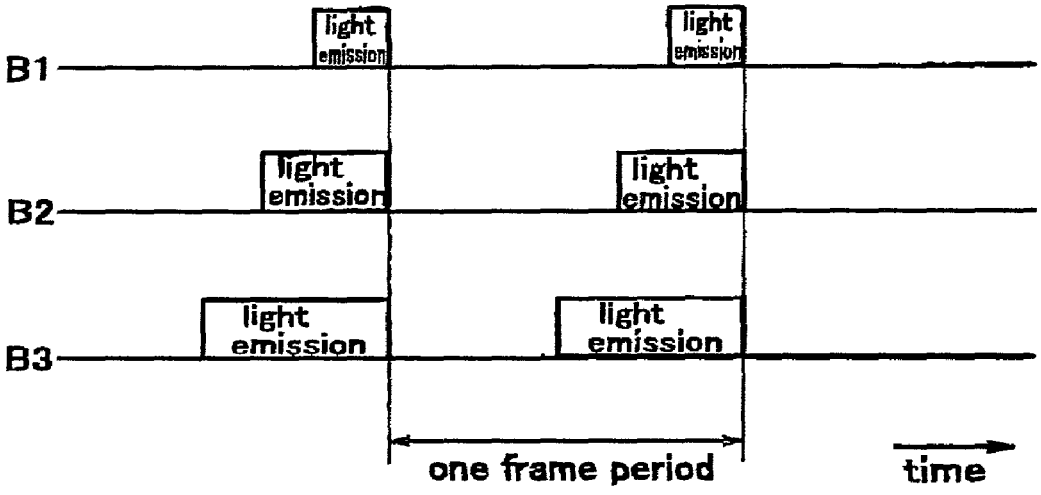

FIGS. 18A, 18B are views showing function in the case where the light source is thus divided into the plurality of blocks (here, three blocks of B1, B2, and B3). FIG. 18A shows the luminance distribution in a plane of the light source and FIG. 18B shows light-emitting time of the light source in the respective blocks.

As shown in FIG. 18A, the cold cathode tubes with different luminances are placed with luminance increasing in the order of B3, B2, B1. As shown in FIG. 18B, in respective sub-frames, light starts to be emitted earliest in the block B3 and latest in the block B1. This enables the correction of the gradient of the luminance distribution in the plane of the liquid crystal display panel 10 of FIG. 43, and therefore lessening of the luminance variation.

Furthermore, the addition of the aforesaid dot pattern to the constitution of the cold cathode tubes can make the luminance distribution have gradient in the respective blocks. Thereby, the luminance variation can be further lessened.

EMBODIMENT 7

In the first to sixth embodiments, the non-video signals irrelevant to the video signals are written to the pixel electrodes. A seventh embodiment illustrates a liquid crystal display in which the video signal write period is divided into two periods in which the video signals are written to the pixel electrodes, thereby reducing the response period of the liquid crystal.

Figure 19:
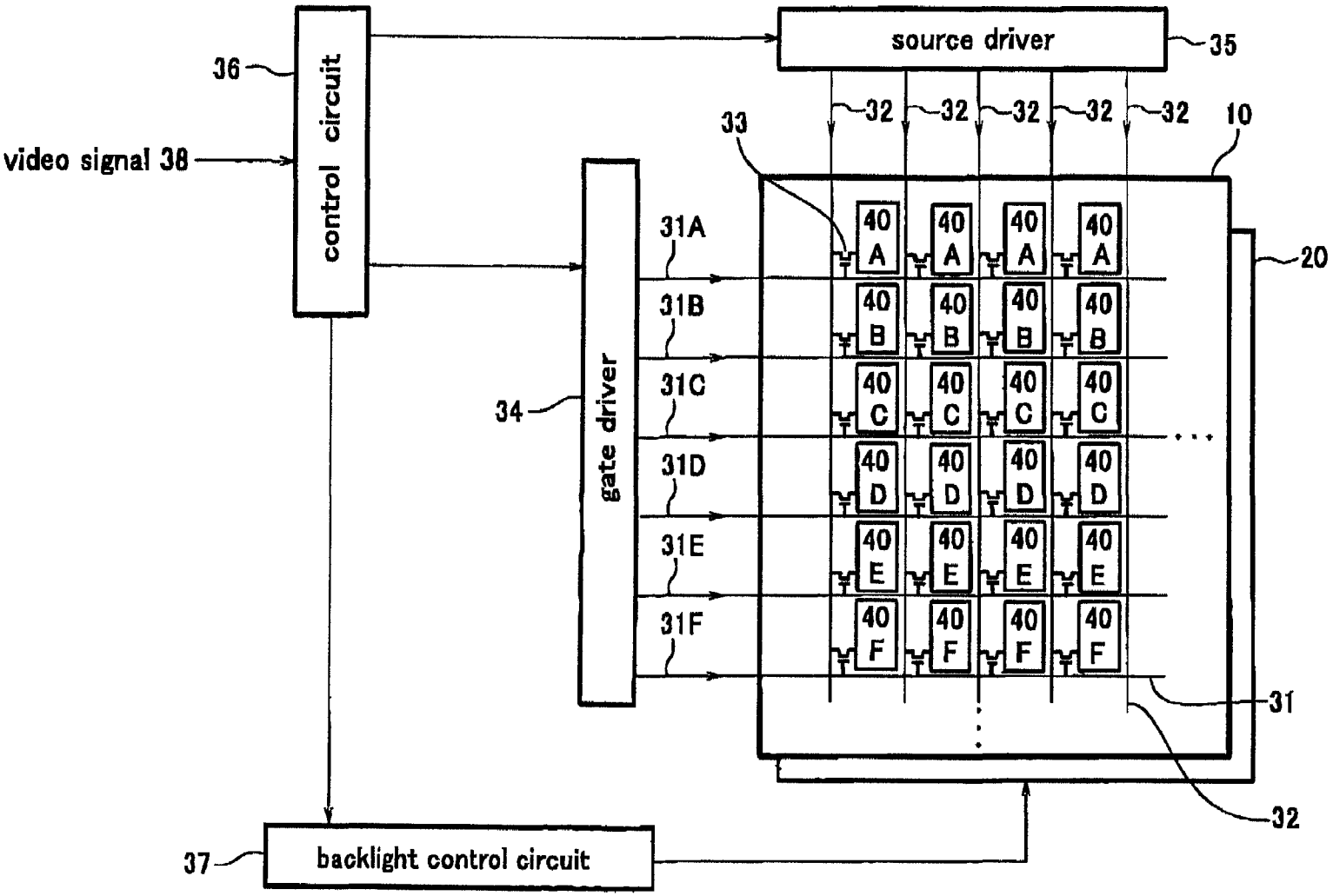
FIG. 19 is a block diagram showing a constitution of a liquid crystal display according to a seventh embodiment of the present invention.

FIG. 19 is a block diagram showing the constitution of the liquid crystal display of this embodiment. The constitution of the liquid crystal display of this embodiment is identical to that of the first embodiment except that the control circuit is not provided with the signal line through which the ON-signal is output to the gate driver. To distinguish the gate lines for the sake of convenience, the gate lines are referenced to by the reference numerals in FIG. 19. Reference numerals 31A–31F denote gate lines on 1st to 6th rows.

Hereinafter, operation of the liquid crystal display will be described.

Figure 20A:
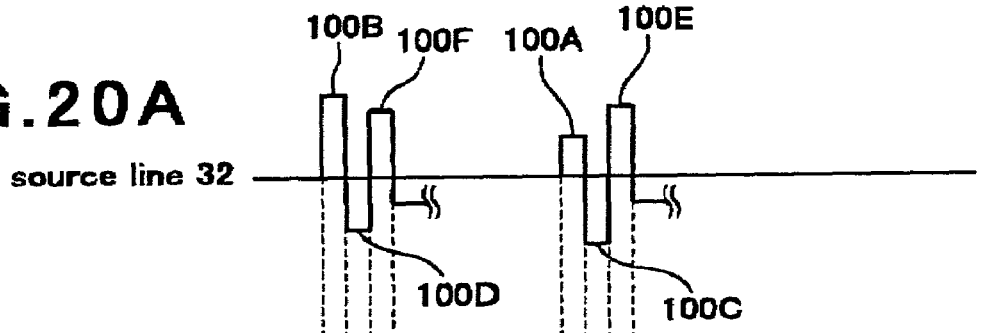
Figure 20B:
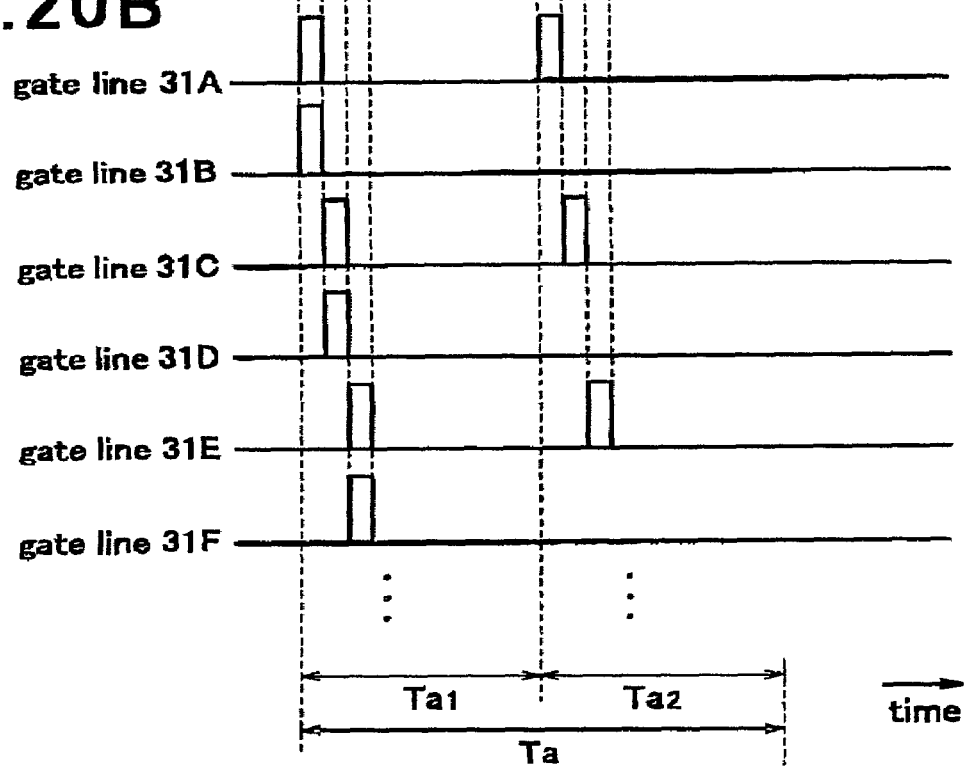

FIGS. 20A, 20B are timing charts showing an example of operation of the liquid crystal display according to the seventh embodiment. FIG. 20A is a diagram showing timings at which video signals are input to a source line 32, and FIG. 20B is a diagram showing timings at which the scan signals are output to respective gate lines.

In this embodiment, the video signal write period Ta is divided into a 1st video signal write period Ta1 and a 2nd video signal write period Ta2 and the video signals are written onto the pixel electrodes in these periods.

As shown in FIG. 20A, the video signals 100B, 100D, 100F, . . . , are sequentially input to the source line 32 in the 1st video signal write period Ta1 and the video signals 100A, 100C, 100E, . . . , are sequentially input to the source line 32 in the 2nd video signal write period Ta2. Here, the reference numerals 100A–100F represent the video signals to be written onto pixel electrodes 40A–40F associated with the gate lines 31A–31F. That is, the video signals to be written onto the pixel electrodes 40B, 40D, 40F . . . associated with the gate lines 31B, 31D, 31F, . . . on even rows, are sequentially written onto the source line 32 in the 1st video signal write period Ta1 and the video signals to be written onto the pixel electrodes 40A, 40C, 40E . . . associated with the gate lines 31A, 31C, 31E, . . . on odd rows, are sequentially written onto the source line 32 in the 2nd video signal write period Ta2.

As shown in FIG. 20B, the scan signals are output to each set of two gate lines, e.g., 31A and 31B, 31C and 31D, and 31E and 31F . . . in the 1st video signal write period Ta1 and the scan signals are sequentially output to the gate lines on odd rows, e.g., 31A, 31C, 31E, . . . in the 2nd video signal write period Ta2.

As a result, the video signals corresponding to one half of one frame are written in the 1st video signal write period Ta1 and the video signals corresponding to the other half are written in the 2nd video signal write period Ta2. Also, in the video signal write period Ta1, the video signals 100B, 100D, 100F . . . to be written onto the pixel electrodes 40B, 40D, 40F . . . associated with the gate lines 31B, 31D, 31F . . . on even rows, are respectively written onto the pixel electrodes 40A, 40C, 40E . . . associated with the gate lines 31A, 31C, 31E . . . on odd rows.

That is, the video signals 100B, 100D, 100F . . . according to image to be displayed are respectively written onto the pixel electrodes 40B, 40D, 40F . . . associated with the gate lines 31B, 31D, 31F . . . on even rows in the 1st video signal write period Ta1. The video signals 100B, 100D, 100F . . . are also respectively written onto the pixel electrodes 40A, 40C, 40E . . . associated with the gate lines 31A, 31C, 31E . . . on odd rows which are one-row before the gate lines 31B, 31D, 31F . . . , but these signals do not correspond to the image to be displayed at the pixel electrodes 40*a*, 40*c*, 40E . . . So, the video signals 100A, 100C, 100E . . . corresponding to image to be displayed are respectively written onto the pixel electrodes 40A, 40C, 40E, . . . in the 2nd video signal write period Ta2.

Figures 21A, 21B, 21C:
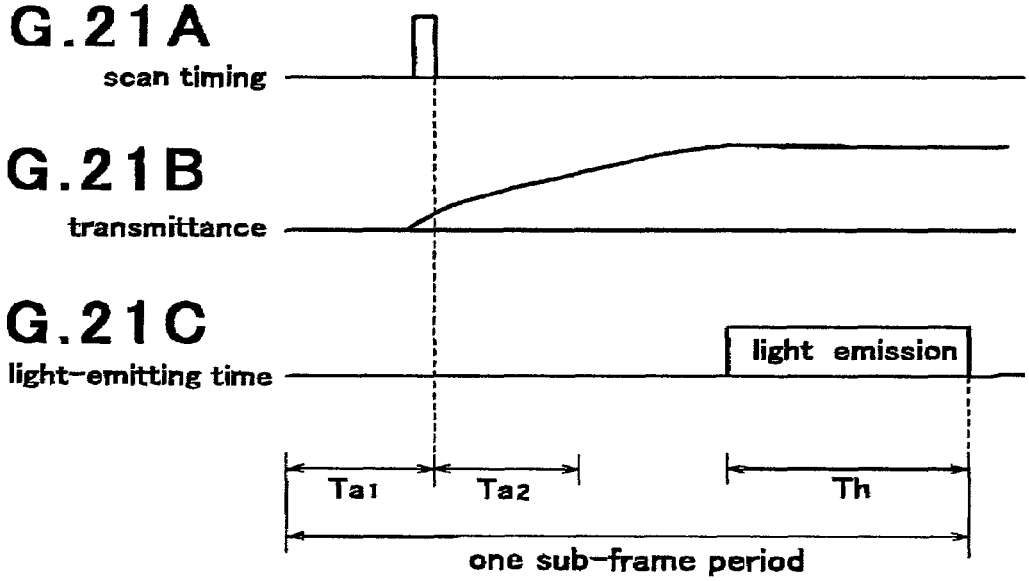

FIGS. 21A–21C are diagrams showing how the liquid crystal in the pixels associated with the last gate line responds. FIG. 21A shows timing at which the scan signal is output to the last gate line, FIG. 21B shows change in transmittance in the pixels associated with the last gate line, and FIG. 21C shows light-emitting time of LEDs of the backlight. In these Figures, since it is assumed that the liquid crystal display panel has even gate lines and therefore, the last gate line is that on even row, the scan signal is output to the last gate line only in the 1st video signal write period Ta1.

As shown in FIGS. 21A–21C, in this embodiment, the scan signal is output to the last gate line at the end of the 1st video signal write period Ta1. On the other hand, conventionally, the scan signal is output to the last gate line at the end of the video signal write period Ta as shown in FIG. 42. This follows that the liquid crystal in the pixels associated with the last gate line starts to respond earlier in this embodiment than that of the conventional example, and the light-emitting time can be made correspondingly longer. Therefore, the liquid crystal in the pixels associated with all the gate lines starts to respond earlier by the length of the 2nd video signal write period Ta2 on average.

Commonly, image is very similar in the pixels associated with two continuous gate lines. So, degradation of the image is hardly perceived even when the video signals are written as described above.

In general, the liquid crystal displays perform AC drive for prevention of image persistence due to impurity ions or the like in the liquid crystal layer in addition, flickers can be prevented by inverting polarity for every row column, or pixel. Accordingly, in this embodiment, the AC drive is adopted. The AC drive adopted here is the AC drive according to two-line inverting method in which the voltage with the same polarity is applied to the pixel electrodes associated with the two continuous gate lines. More specifically, as shown in FIG. 20A, each of the video signals 100A, 100B, the video signals 100C, 100D, and the video signals 100E, 100F corresponds to the voltage with the same polarity.

In case of a gate line the video signals corresponding to the voltage with the same polarity are written onto the pixel electrodes associated with this gate line in the 1st video signal write period Ta1 and the 2nd video signal write period Ta2. This reduces charging time of the video signals in the video signal write period Ta2.

Figures 22A, 22B:
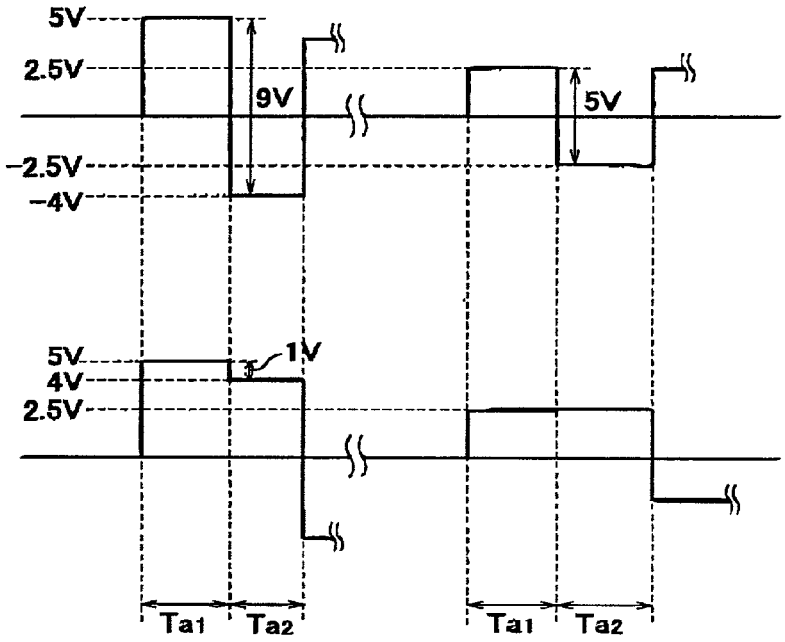

FIGS. 22A, 22B are diagrams for explaining such reduction of the charging time. FIG. 22A shows change in voltage applied to a pixel electrode in the AC drive according to one-line inverting method and FIGS. 22B shows change in the voltage applied to the pixel electrode in the AC drive according to two-line inverting method employed in this embodiment.

As shown in FIG. 22A, when 5V (absolute value) voltage and 4V (absolute value) voltage are respectively applied to the pixel electrodes in the 1st video signal write period Ta1 and the 2nd video signal write period Ta2, the one-line inverting method requires charging of 9V voltage equal to difference between +5V and −4V in the 2nd video signal write period Ta2. On the other hand, as shown in FIG. 22B, likewise, the two-line inverting method requires charging of only 1V equal to difference between +5V and +4V in the 2nd video signal write period Ta2. Likewise, when 2.5V (absolute value) voltages are applied to the pixel electrodes in the 1st video signal write period Ta1 and the 2nd video signal write period Ta2, the one-line inverting method requires charging of 5V voltage equal to difference between +2.5V and −2.5V in the 2nd video signal write period Ta2, whereas the two-line inverting method does not require charging because difference between +2.5V and −2.5V is 0V.

In this embodiment, since the voltage difference is small, the writing time shorter than that of the 1st video signal write period Ta1 is satisfactory in the 2nd video signal write period Ta2. Therefore, the video signal write period Ta2 itself can be reduced and therefore, the light-emitting time can be correspondingly increased.

While in this embodiment, the scan signals are output to each set of two gate lines in the 1st video signal write period Ta1, the scan signals may be output to each set of three or more gate lines.

Figures 23A, 23B:
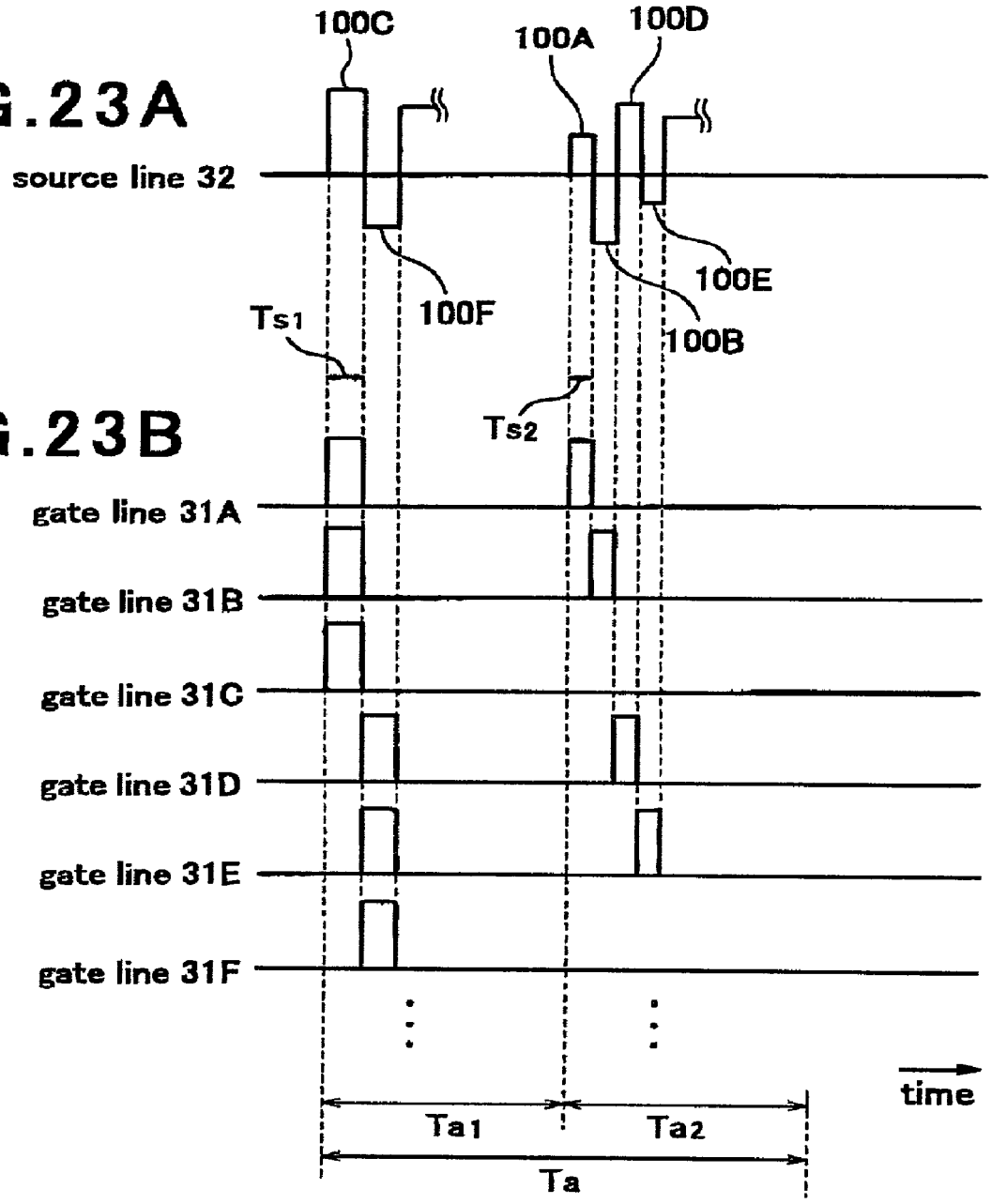

FIGS. 23A, 23B are timing charts showing another example of operation of the liquid crystal display according to a seventh embodiment of the present invention. FIG. 23A is a diagram showing timings at which video signals are input to a source line 32. FIG. 23B is a diagram showing timings at which the scan signals are output to respective gate lines.

As shown in FIG. 23A, the video signals 100C, 100F . . . are input to the source lines 32 in this order in the 1st video signal write period Ta1, and the video signals 100A, 100B, 100D, 100D . . . are input to the source lines 32 in this order in the 2nd video signal write period Ta2. Therefore the video signals to be written onto the pixels electrodes 40C, 40F . . . associated with the gate lines 31C, 31F . . . are sequentially input to the source lines 32 in the 1st video signal write period Ta1 and the video signals to be written onto the pixel electrodes 40A, 40B, 40D, 40E . . . associated with the gate lines 31A, 31B, 31D, 31E . . . are sequentially input to the source lines 32 in the 2nd video signal write period Ta2.

As shown in FIG. 23B, the scan signals are output to each set of three gate lines 31A, 31B, 31C, and three gate lines 31D, 31E, 31F . . . in the 1st video signal write period Ta1, and the scan signals are sequentially output to the gate lines 31A, 31B, 31D, 31E . . . in the 2nd video signal write period Ta2.

As in the case where the scan signals are output to each set of two lines, when the scan signals are output to each set of three gate lines in the 1st video signal write period Ta1, the liquid crystal responds earlier in the pixels corresponding to the last gate line, and the light-emitting time can be correspondingly increased.

As a matter of course, the scan signals may be output to each set of four or more gate lines in the 1st video signal write period Ta1. However, if the number of the gate lines to which the scan signals are output simultaneously, is increased to excess insufficient signal writing might occur. Accordingly, to avoid such signal insufficient writing, as shown in FIGS. 23A, 23B, it is desirable to set period Ts1 during which the scan signals continue to be output in the 1st video signal write period Ta1 longer than period Ts2 during which the scan signals continue to be output in the 2nd video signal write period Ta2.

Figures 24A, 24B:
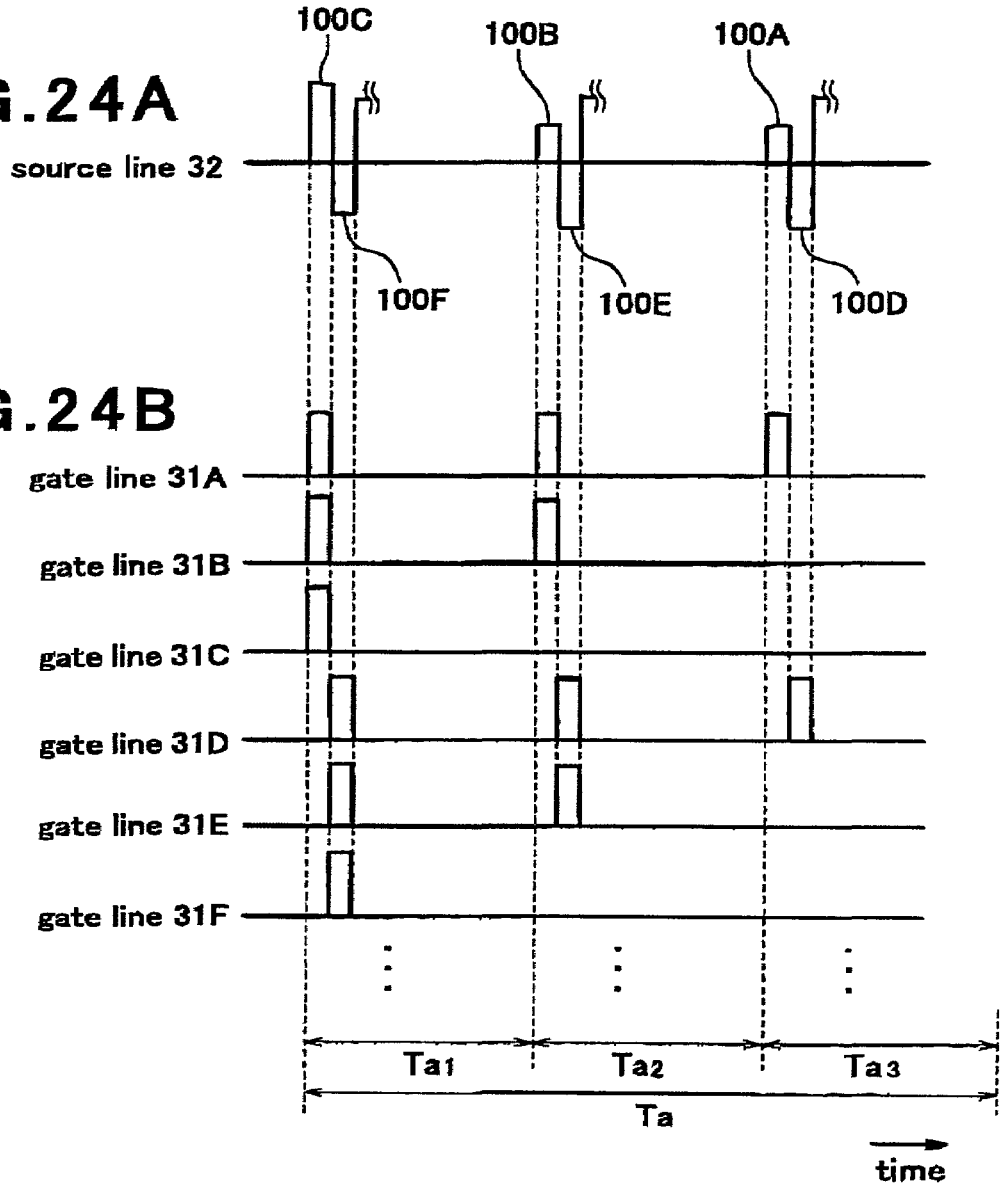

Furthermore, the video signal write period Ta may be divided into three periods as shown in FIGS. 24A, 24B instead of two periods, and under the condition, the operation is conducted in the same manner.

As shown in FIG. 24A, the video signals 100C, 100F . . . are input to the source lines 32 in this order in the 1st video signal write period Ta1 and the video signals 100B, 100E . . . are input to the source lines 32 in this order in the 2nd video signal write period Ta2. The video signals 100A, 100D . . . are input to the source lines 32 in 3rd video signal write period Ta3. Therefore, the video signals to be written onto the pixel electrodes 40C, 40F . . . associated with the gate lines 31C, 31F . . . are sequentially input to the source lines 32 in the 1st video signal write period Ta1, the video signals to be written onto the pixel electrodes 40B, 40E . . . associated with the gate lines 31B, 31E . . . are sequentially input to the source lines 32 in the 2nd video signal write period Ta2 and the video signals to be written onto the pixel electrodes 40A, 40D . . . associated with the gate lines 31A, 31D . . . are sequentially input to the source lines 32 in the 3rd video signal write period Ta3.

Meanwhile, as shown in FIG. 24B, the scan signals are output to each set of three gate lines 31A, 31B, and 31C, 31D, 31E, and 31F . . . in the 1st video signal write period Ta1, and the scan signals are output to each set of two gate lines 31A and 31B, 31D and 31E in the 2nd video signal write period Ta2. Further, in the 3rd video signal write period Ta3, the scan signals are sequentially output to the gate lines 31A, 31D . . . .

In this operation, similarly to the case where the video signal write period Ta is divided into two periods, the liquid crystal responds earlier in the pixels corresponding to the last gate line, and the light-emitting time can be correspondingly increased.

Furthermore, if the scan signals are output to each set of four gate lines in the 1st video signal write period Ta1, the scan signals are output to each set of two gate lines in the 2nd video signal write period Ta2, and the scan signals are sequentially output to the respective gate lines in the 3rd video signal write period Ta3, then the output operation of the scan signals can be carried out in a shorter time, although this is not shown. It is therefore desirable to output the scan signals to each set of $2^n$ gate lines.

Moreover, as a matter of course, the video signal write period Ta may be divided into four or more periods.

EMBODIMENT 8

An eighth embodiment illustrates a liquid crystal display in which the video signals are written in the 1st video signal write period and the 2nd video signal write period similarly to the seventh embodiment, but the video signals are respectively written to pixel electrodes associated with respective gate lines in the 2nd video signal write period differently from the seventh embodiment. The constitution of this embodiment is similar to that of the seventh embodiment, and as such, the description thereof is omitted.

Figure 25A:
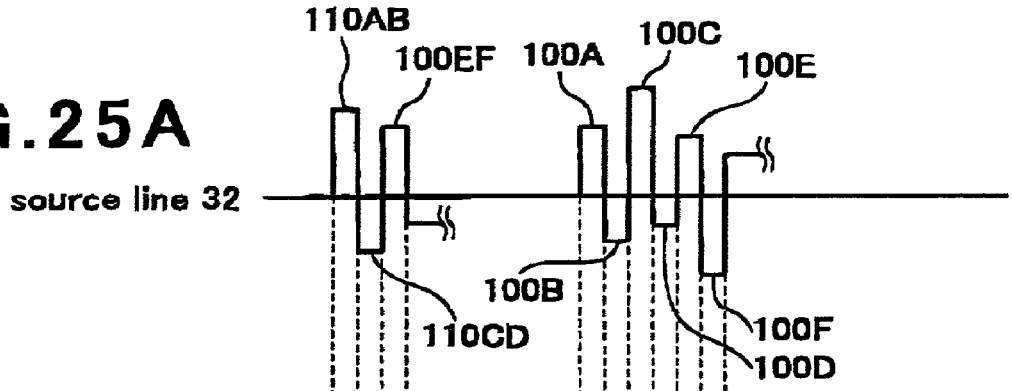
Figure 25B:
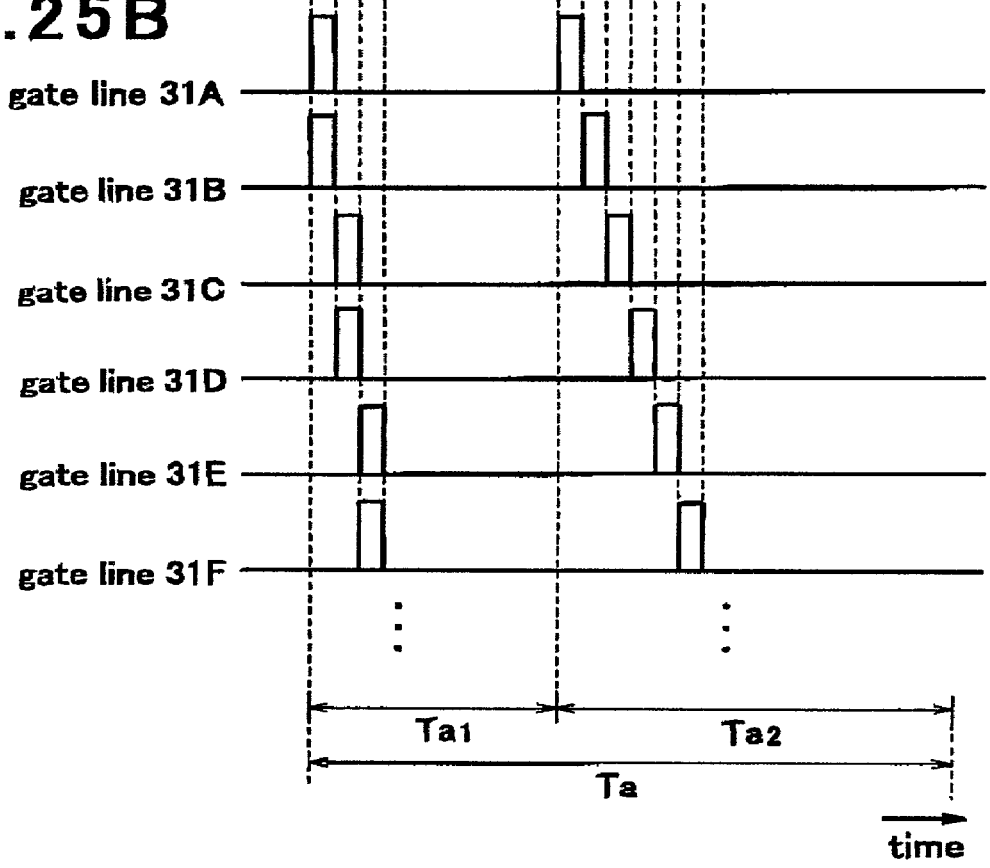

FIGS. 25A, 25B are timing charts showing an example of operation of the liquid crystal display according to the eighth embodiment. FIG. 25A is a diagram showing timings at which video signals are input to a source line 32, and FIG. 25B is a diagram showing timings at which the scan signals are output to respective gate lines.

As shown in FIG. 25A, in the 1st video signal write period Ta1, the video signals 100AB, 100CD, 100EF . . . , are input to the source line 32 in this order. Here, reference numerals 100AB, 100CD, 100EF . . . , respectively represent video signals to be written onto the pixel electrodes 40A and 40B, 40C and 40D, 40E and 40F . . . associated with the gate lines 31A and 31B, 31C and 31D, 31E and 31F . . . Meanwhile, in the 2nd video signal write period Ta2, the video signals 100A, 100B, 100C, 100D, 100E, 100F . . . , are input to the source line 32 in this order.

The video signals (hereinafter referred to as 1st write signals) written in the 1st video signal write period Ta1 are low-definition signals, as compared to the video signals to be written onto the pixel electrodes associated with the two continuous gate lines, to which the video signals are to be written. The aim of this embodiment is to put forward start of the response of the liquid crystal by writing of the low-definition video signals. Therefore, the 1st write signals are video signals with a level between a maximum value and a minimum value of a level of the video signals to be written to the pixel electrodes associated with the two continuous gate lines. The 1st write signals are determined according to use, purpose, various characteristics, etc, of the liquid crystal displays, and specifically, according to the reference mentioned later.

As shown in FIG. 25B, the scan signals are sequentially output to each set of two gate lines, e.g., 31A and 31B, 31C and 31D, and 31E and 31F . . . in the 1st video signal write period Ta1 and the scan signals are sequentially output to all the gate lines according to the order in which they are arranged, i.e., 31A, 31B, 31C, 31D, 31E, 31F, . . . in the 2nd video signal write period Ta2.

Subsequently, how the signal levels of the 1st write signals are set will be described with reference to Tables 1–6. Here, the first to fifth setting is described with reference to tables 1–6 but this embodiment is not intended to be limited to this.

Hereinbelow, original signals, i.e., signals corresponding to the video signals externally input are assumed to have levels in Table 1. The values listed in Table 1 and Tables 2–6 seen later represent signal levels of the video signals written onto the pixel electrodes 40A–40D associated with the gate lines 31A–31D in the 1st frame–4th frame. The signal levels could take values ranging from 0–100 and specifically values according to voltage values corresponding to the video signals. Since the normally-white-mode liquid crystal displays are employed herein, it is assumed that white display is conducted at signal level of 0 and black display is conducted at level of 100.

TABLE 1

| | 1st frame | 2nd frame | 3rd frame | 4th frame |
|---|---|---|---|---|
| gateline31A | 100 | 80 | 70 | 50 |
| gateline31B | 50 | 40 | 60 | 20 |

TABLE 1-continued

| | 1st frame | 2nd frame | 3rd frame | 4th frame |
|---|---|---|---|---|
| gateline31C | 100 | 90 | 80 | 100 |
| gateline31D | 50 | 60 | 90 | 30 |

In the first setting, it is assumed that the signals level of the video signals to be written onto the pixel electrode associated with the gate line on odd or even row of the two continuous gate lines is the signal level of the 1st write signal. In case of the gate lines 31A, 31B, the video signal to be written onto the pixel electrode 40A associated with the gate line 31A on odd row or the video signal to be written onto the pixel electrode 40B associated with the gate line 31B on even row is the signal level of the 1st write signal. Table 2 illustrates the signal levels according to the first setting. Herein, the video signals to be written onto the pixel electrode 40A and 40C associated with the gate lines 31A and 31C on odd rows are set as the 1st write signals.

TABLE 2

| | 1st frame | 2nd frame | 3rd frame | 4th frame |
|---|---|---|---|---|
| gateline31A | 100 | 80 | 70 | 50 |
| gateline31B | 100 | 80 | 70 | 50 |
| gateline31C | 100 | 90 | 80 | 100 |
| gateline31D | 100 | 90 | 80 | 100 |

The first setting has an advantage in that the levels can be easily set without a complicated process.

As shown in Table 2, assuming that the video signals to be written onto the pixel electrodes 40A, 40C associated with the gate lines 31A, 31C on odd rows are the 1st write signals, it is not necessary to write video signals onto these pixel electrodes 40A, 40C in the 2nd video signal write period Ta2. So, in that case, the video signals may be written onto the pixel electrodes 40B, 40D associated with the gate lines 31B, 31D on even rows in the 2nd video signal write period Ta2.

In the second setting, it is assumed that the signal level of the video signals to be written onto the pixel electrodes associated with the gate line on odd row of the two continuous gate lines and the signal level of the video signals to be written onto the pixel electrodes associated with the gate line on even row are the signal level of the 1st write signals for every frame. Table 3 illustrates the second setting in which the signal levels of the video signals to be written onto the pixel electrodes 40A, 40C associated with the gate lines 31A, 31C on odd rows are the signal levels of the 1st write signals for odd frames (1st frame, 3rd frame . . .) and the signal levels of the video signals to be written onto the pixel electrodes 40B, 40D associated with the gate lines 31B, 31D on even rows are the signal level of the 1st write signals for even frames (2nd frame, 4th frame . . . ).

TABLE 3

| | 1st frame | 2nd frame | 3rd frame | 4th frame |
|---|---|---|---|---|
| gateline31A | 100 | 40 | 70 | 20 |
| gateline31B | 100 | 40 | 70 | 20 |
| gateline31C | 100 | 60 | 80 | 30 |
| gateline31D | 100 | 60 | 80 | 30 |

The second setting has an advantage in that image degradation, if any, would not occur only in one of odd and even rows.

In this case, the video signals may be written onto only the pixel electrodes 40B, 40D associated with the gate lines 31B, 31D on even rows in the 2nd video signal write period Ta2 of an odd frame, while the video signals may be written onto only the pixel electrodes 40A, 40C associated with the gate lines 31A, 31C on odd rows in the 2nd video signal write period T2 of an even frame.

In the third setting, comparison is made between the signal levels of the video signals to be written onto the pixel electrodes associated with the two continuous gate lines and the signal level of the video signal with the liquid crystal in the pixel responding slower is assumed to be the signal level of the 1st write signal. In general, the video signal with the liquid crystal responding slower refers to the video signal with the voltage having a smaller absolute value. In case of normally-white-mode liquid crystal display panel, the liquid crystal responds more slowly in white display than in black display as described in the first embodiment. In accordance with this, the signal level of the video signal nearer to white display is assumed to be the signal level of the 1st write signal. Table 4 illustrates the third setting in which smaller signal level of the original signal is set as the signal level of the 1st write signal. For example, as can be seen from Table 1, the signal levels of the video signals to be written onto the pixel electrodes 40A, 40B associated with the gate lines 31A, 31B are respectively 100, 50 in the 1st frame. Since the signal level of the video signal to be written onto the pixel electrode 40B associated with the gate line 31B is lower, the signal level of the 1st write signal is set to 50.

TABLE 4

| | 1st frame | 2nd frame | 3rd frame | 4th frame |
|---|---|---|---|---|
| gateline31A | 50 | 40 | 60 | 20 |
| gateline31B | 50 | 40 | 60 | 20 |
| gateline31C | 50 | 60 | 80 | 30 |
| gateline31D | 50 | 60 | 80 | 30 |

The third setting has an advantage in that since the video signal to be written onto the pixel electrode with the liquid crystal responding slower is actually written to the pixel electrode, the response time of the liquid crystal can be efficiently reduced.

In the fourth setting, the average of the signal levels of the video signals to be written onto the pixel electrodes associated with the two continuous gate lines is set as the signal level of the 1st write signal Table 5 illustrates the fourth setting. As can be seen from the this table, for the 1st frame, the average "75" is set as the signal level of the 1st write signal based on the fact that the signal levels of the video signals to be written onto the pixel electrodes 40A, 40B associated with the gate lines 31A, 31B are respectively "100", "50" as shown in Table 1.

TABLE 5

| | 1st frame | 2nd frame | 3rd frame | 4th frame |
|---|---|---|---|---|
| gateline31A | 75 | 60 | 65 | 35 |
| gateline31B | 75 | 60 | 65 | 35 |
| gateline31C | 75 | 75 | 85 | 65 |
| gateltne31D | 75 | 75 | 85 | 65 |

The fourth setting has an advantage in that because the liquid crystal of the respective pixels evenly responds in the 1st video signal write period, the response time of the liquid crystal can be reduced with simple calculations and without significant image degradation.

In the fifth setting, set as the signal level of the 1st write signal is the signal level enabling reducing the liquid crystal response time and obtained by calculations for allowing display with luminance determined by the video signals written in the 2nd video signal write period. Table 6 illustrates the fifth setting.

TABLE 6

| | 1st frame | 2nd frame | 3rd frame | 4th frame |
|---|---|---|---|---|
| gateline31A | 90 | 60 | 65 | 35 |
| gateline31B | 90 | 60 | 65 | 35 |
| gateline31C | 90 | 75 | 85 | 65 |
| gateline31D | 90 | 75 | 85 | 65 |

The fifth setting has an advantage in that the image degradation is less and the response time of the liquid crystal can be reliably reduced although this requires special calculations.

Figure 26A:
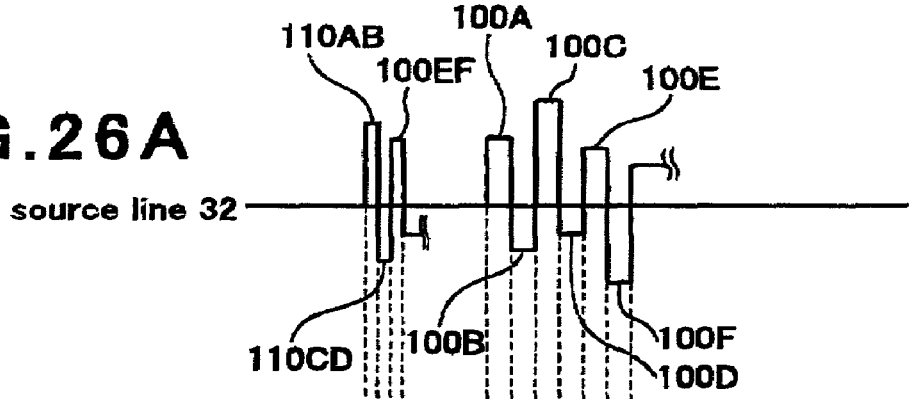
Figure 26B:
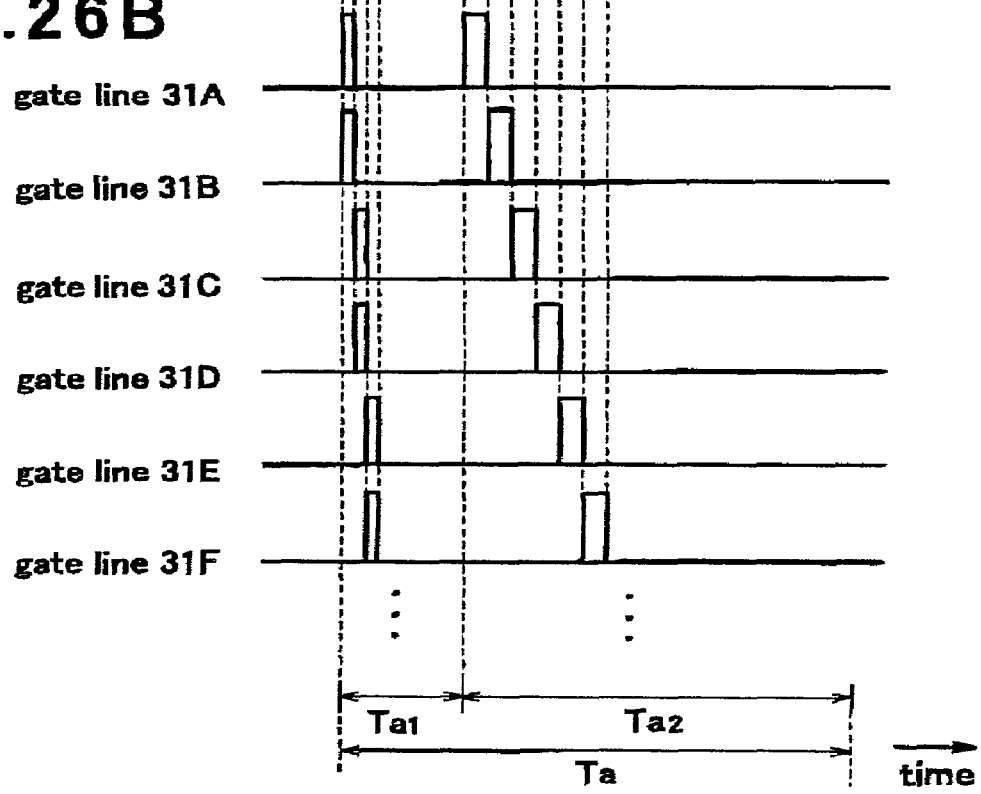

In this embodiment, in a case where image with black line and white line are alternately repeated is displayed, since the signal for white display is written onto the line for black display in the 1st video signal write period Ta1, brighter black is generated, which results in low contrast. As a solution to this, as shown in FIG. 26B, in writing of the video signal, the 1st video signal write period Ta1 may be set shorter than the 2nd video signal write period Ta2.

EMBODIMENT 9

In the seventh embodiment, the scan direction is fixed. A ninth embodiment illustrates a liquid crystal display adapted to change the order in which the scan signals are output to the gate lines for each sub-frame period. The constitution of the liquid crystal display of this embodiment is identical to that of the seventh embodiment, and as such, description thereof is omitted.

As mentioned previously with reference to FIGS. 43, 44, there is generated luminance gradient in which the luminance decreases according to the scan direction when light emission of the LEDs starts before the elapse of the response period of the liquid crystal. Accordingly, in this embodiment, the scan direction is changed for each sub-frame period to allow switching of the direction of the luminance gradient, thereby lessening the luminance gradient.

Figures 27A, 27B, 27C, 27D:
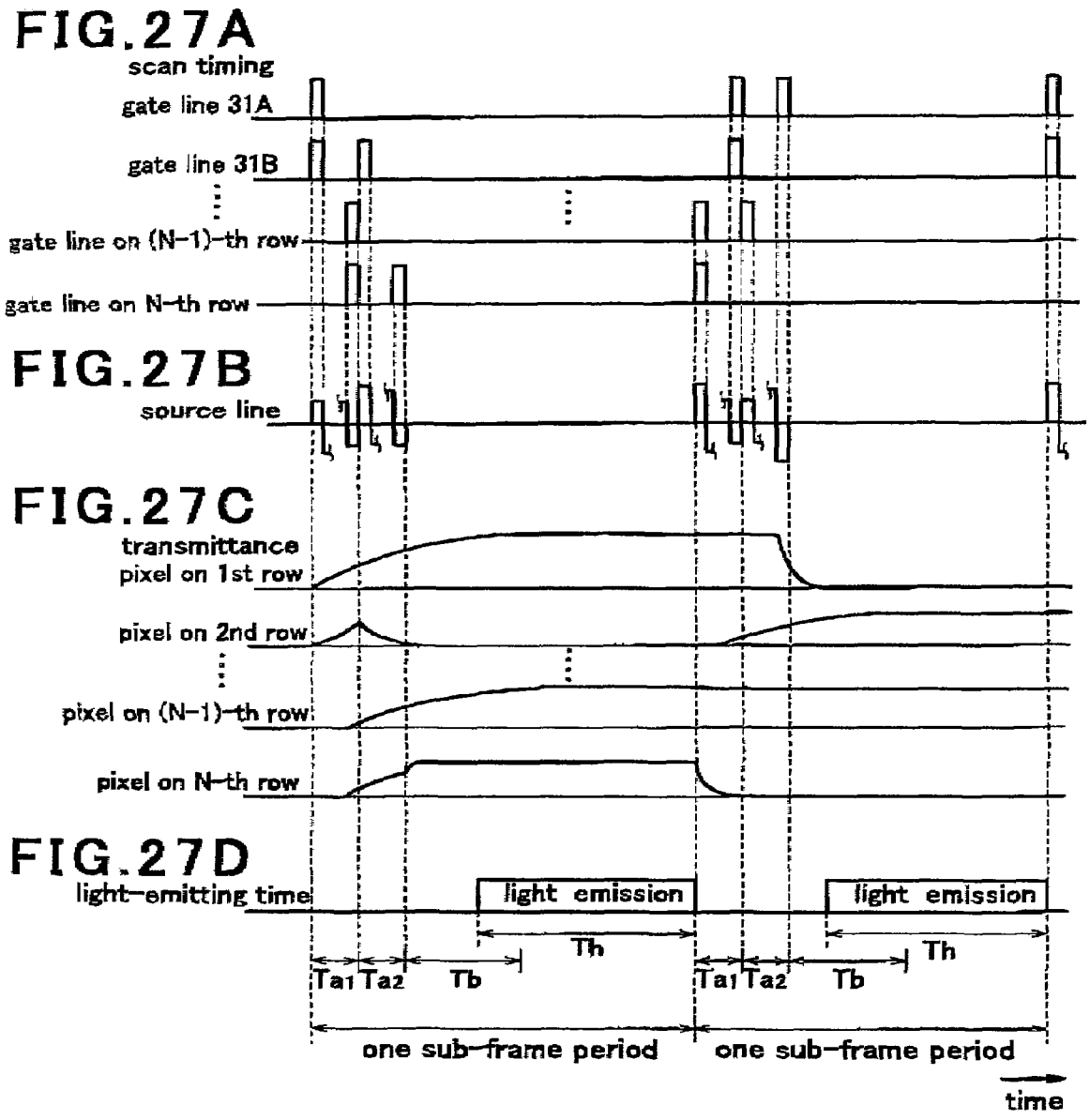

FIGS. 27A–27D are timing charts showing an example of the display's drive mechanism of the liquid crystal display according to the ninth embodiment. FIG. 27A shows timings at which the scan signals are output to the gate lines of the liquid crystal display panel, FIG. 27B shows waveforms of signals output to a source line 32 of the liquid crystal display panel, FIG. 27C shows change in transmittance of pixels on respective rows of the liquid crystal display panel, and FIG. 27D shows light-emitting time of the LEDs of the backlight. In these Figures, reference numerals 31A, 31B represent gate lines of FIG. 19 and N represents the number of rows of the pixels included in the liquid crystal display panel.

As shown in FIG. 27A, when the scan signals are sequentially output to the gate line 31A on 1st row to the gate line on N-th row in a sub-frame period, the scan signals are sequentially output to the gate line on N-th row to the gate line 31A on 1st row in a subsequent sub-frame period. In other words, the scan direction is reversed for every sub-frame period. Thereby, the signals are sequentially written onto the pixel electrodes on the 1st to N-th row in the sub-frame period and the signals are sequentially written onto the pixel electrodes on N-th to 1st row in the subsequent sub-frame period.

The liquid crystal in the pixel associated with the gate line scanned later starts to respond later than the liquid crystal in the pixel associated with the gate line scanned earlier, and therefore, the completion of the response thereof is correspondingly later. So, when the scan signals are output while reversing the scan direction for every sub-frame period, the gate line to which the scan signal is lastly output is switched for every sub-frame period, thereby switching position of the pixel with the latest response start.

Figure 28A:
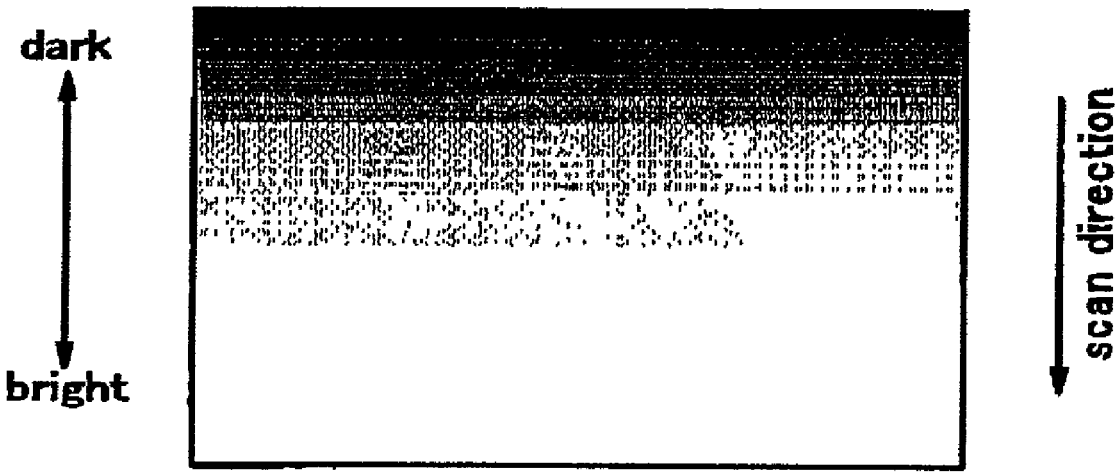
FIGS. 28A, 28B are a conceptual views showing luminance distribution in a plane of a liquid crystal display panel included in the liquid crystal display according to the ninth embodiment.
Figure 28B:
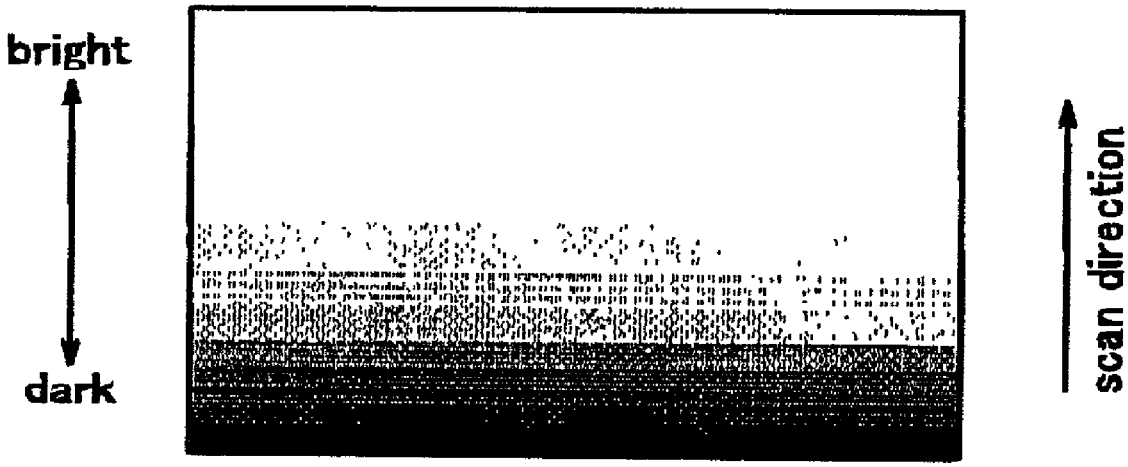

In this operation, when the LEDs start to emit light before the completion of the liquid crystal response period Tb as shown in FIG. 27D, the direction of luminance gradient is switched for every sub-frame period. Specifically, the luminance gradient of FIG. 28A is generated in a sub-frame period and the luminance gradient of FIG. 28B which is the reverse of the gradient of FIG. 28A is generated. As a result, the luminance gradient generated in the respective sub-frame periods become inconspicuous and the image degradation can be suppressed. Even if the liquid crystal response period Tb and the light-emitting time Th overlap with each other, significant image degradation does not occur.

Since in this embodiment, the scan direction is reversed for every sub-frame period as described above, continuous sub-frame periods with the same scan direction are not provided. Nevertheless, as a matter of course, there may be provided continuous sub-frame periods with the same scan direction.

EMBODIMENT 10

A tenth embodiment illustrates a liquid crystal display in which the non-video signals are written as described in the first embodiment and then the video signals are written onto the pixel electrodes in the 1st video signal write period and the 2nd video signal write period. The constitution of the liquid crystal display of this embodiment is identical to that of the seventh embodiment, and as such, description thereof is omitted.

Figures 29A, 29B, 29C, 29D:
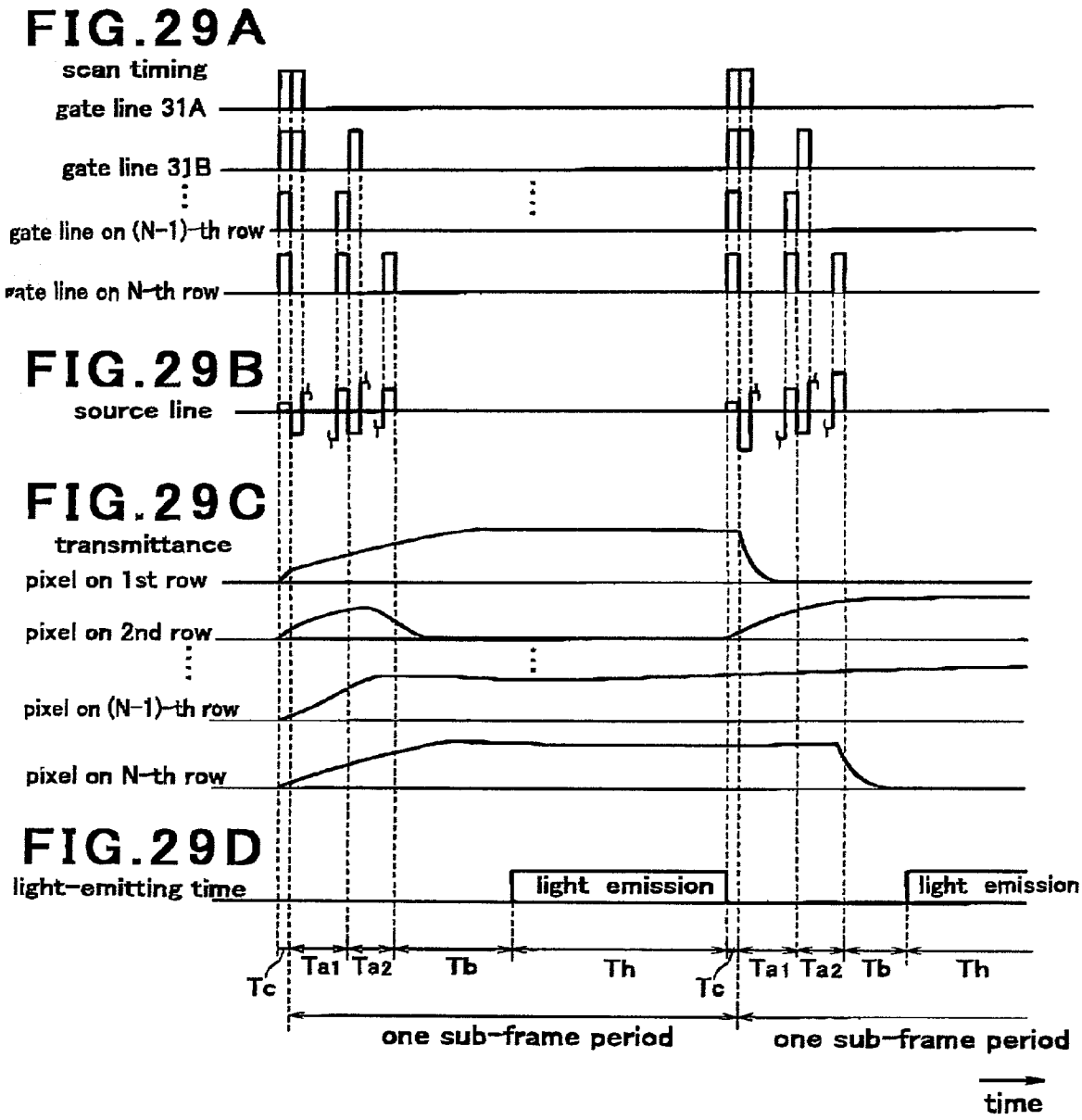

FIGS. 29A–29D are timing charts showing an example of the display's drive mechanism of the liquid crystal display according to the tenth embodiment. FIG. 29A shows timings at which the scan signals are output to the gate lines of the liquid crystal display panel. FIG. 29B shows waveforms of signals output to a source line 32 of the liquid crystal display panel, FIG. 29C shows change in transmittance of pixels on respective rows of the liquid crystal display panel, and FIG. 29D shows light-emitting time of the LEDs of the backlight. In these Figures, reference numerals 31A, 31B represent gate lines of FIG. 19 and N represents the number of rows of the pixels included in the liquid crystal display panel.

As shown in FIGS. 29A–29C, in the liquid crystal display of this embodiment, the non-video signal write period Tc is provided before the 1st video signal write period Ta1 and in the non-video signal write period Tc, the non-video signals are written as described in the first embodiment. For this purpose, the scan signals are simultaneously output to all the gate lines in the non-video signal write period Tc as shown in FIG. 29A.

By such writing of the non-video signals, the liquid crystal in pixels associated with all the gate lines starts to respond at the beginning of the non-video signal trite period Tc, and therefore, the liquid crystal response period Tb can be further reduced. This makes it possible that the light-emitting time of the LEDs of the backlight is kept sufficiently long (see FIG. 29D).

EMBODIMENT 11

An eleventh embodiment illustrates a liquid crystal display capable of preventing color breaking by providing a plurality of sub-frame periods of the same color in one frame period. The constitution of the liquid crystal display of this embodiment is identical to that of the seventh embodiment, and as such description thereof is omitted.

Subsequently, operation of the liquid crystal display of this embodiment will be described.

In the liquid crystal display of this embodiment, signal writing is conducted twice, i.e., first writing and second writing, in each sub-frame period as mentioned later. Here, the video signals are written in the first writing and black signals are written in the second writing.

Figure 30A:
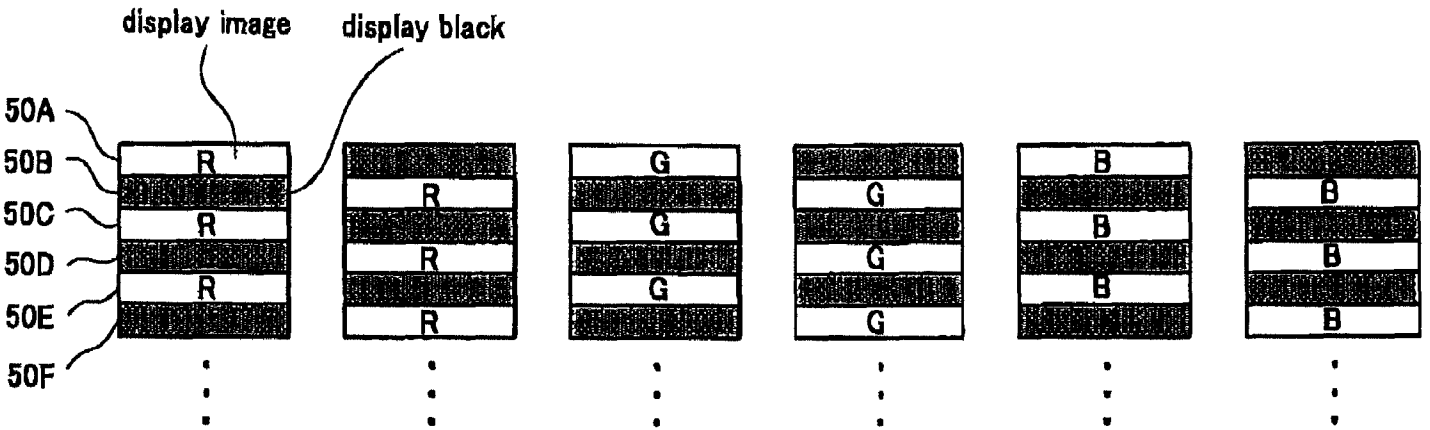
Figure 30B:
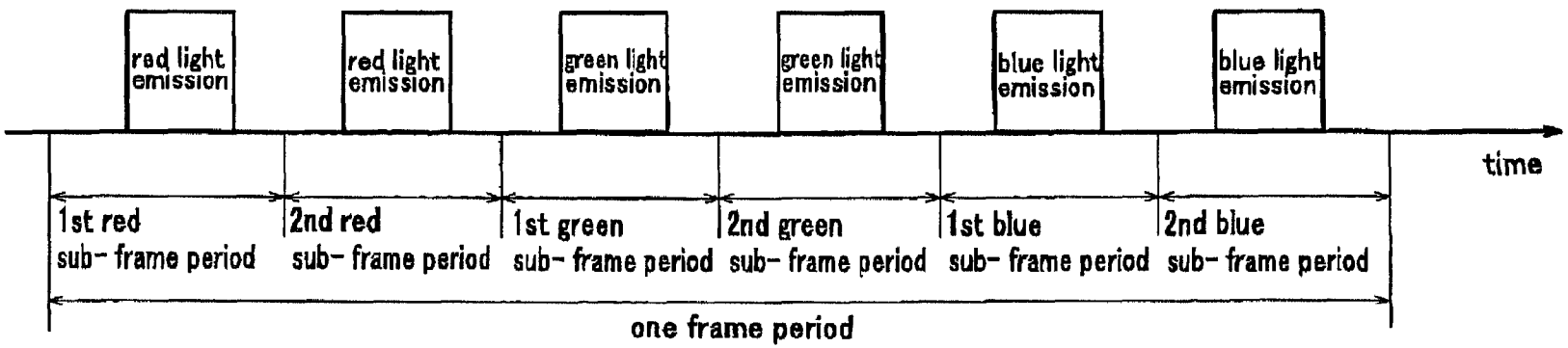

FIGS. 30A–30B are conceptual views showing an example of the operation of the liquid crystal display 1 according to the eleventh embodiment. FIG. 30A represent image displayed in pixels 50A, 50B, 50C, 50D, 50E, 50F . . . associated with the gate lines 31A, 31B, 31C, 31D, 31E, 31F . . . and FIG. 30B represents light-emitting time of LEDS of the backlight 20.

As shown in FIG. 30B, in this embodiment, one frame period is composed of six sub-frame periods, and two sub-frame periods are provided for each color. Also, the sub-frame periods with the same color are continuously provided. In FIG. 30B, sub-frame periods are provided in the order of red, red, green, green, blue, blue, but the order is not intended to be limited. As an alternative, the order may be blue, blue, green, green, red, red.

In this embodiment, the video signals are written onto the pixel electrodes 40A, 40C, 40E . . . associated with the gate lines 31A, 31C, 31E . . . on odd rows, and then the black signals are respectively written onto the pixel electrodes 40B, 40D, 40F . . . associated with the gate lines 31B, 31D, 31F . . . on even rows in the 1st red sub-frame period, the 1st green sub-frame period, and the 1st blue sub-frame period. As a result, as shown in FIG. 30A, image corresponding to the video signals is displayed in the pixels 50A, 50C, 50E . . . associated with the gate lines 31A, 31C, 31E . . . on odd rows, while black is displayed in the pixels 50B, 50D, 50F . . . associated with the gate lines 31B, 31D, 31F . . . on even rows.

Meanwhile, the video signals are written onto the pixel electrodes 40B, 40D, 40F . . . associated with the gate lines 31B, 31D, 31F . . . on even rows, and then the black signals are written onto the pixel electrodes 40A, 40C, 40E . . . associated with the gate lines 31A, 31C, 31E . . . on odd rows in the 2nd red sub-frame period, the 2nd green sub-frame period, and the 2nd blue sub-frame period. As a result, as shown in FIG. 30A, black is displayed in the pixels 50A, 50C, 50E associated with the gate lines 31A, 31C, 31E . . . on odd rows, while the image corresponding to the video signals displayed in the pixels 50B, 50D, 50F . . . associated with the gate lines 31B, 31D, 31F . . . on even rows.

In the normally-white-mode liquid crystal display panel, since the response of the liquid crystal is slower in image display than in black display, it is preferable that the video signals are first written and then the black signals are written in each sub-frame period as described above.

Figure 31:
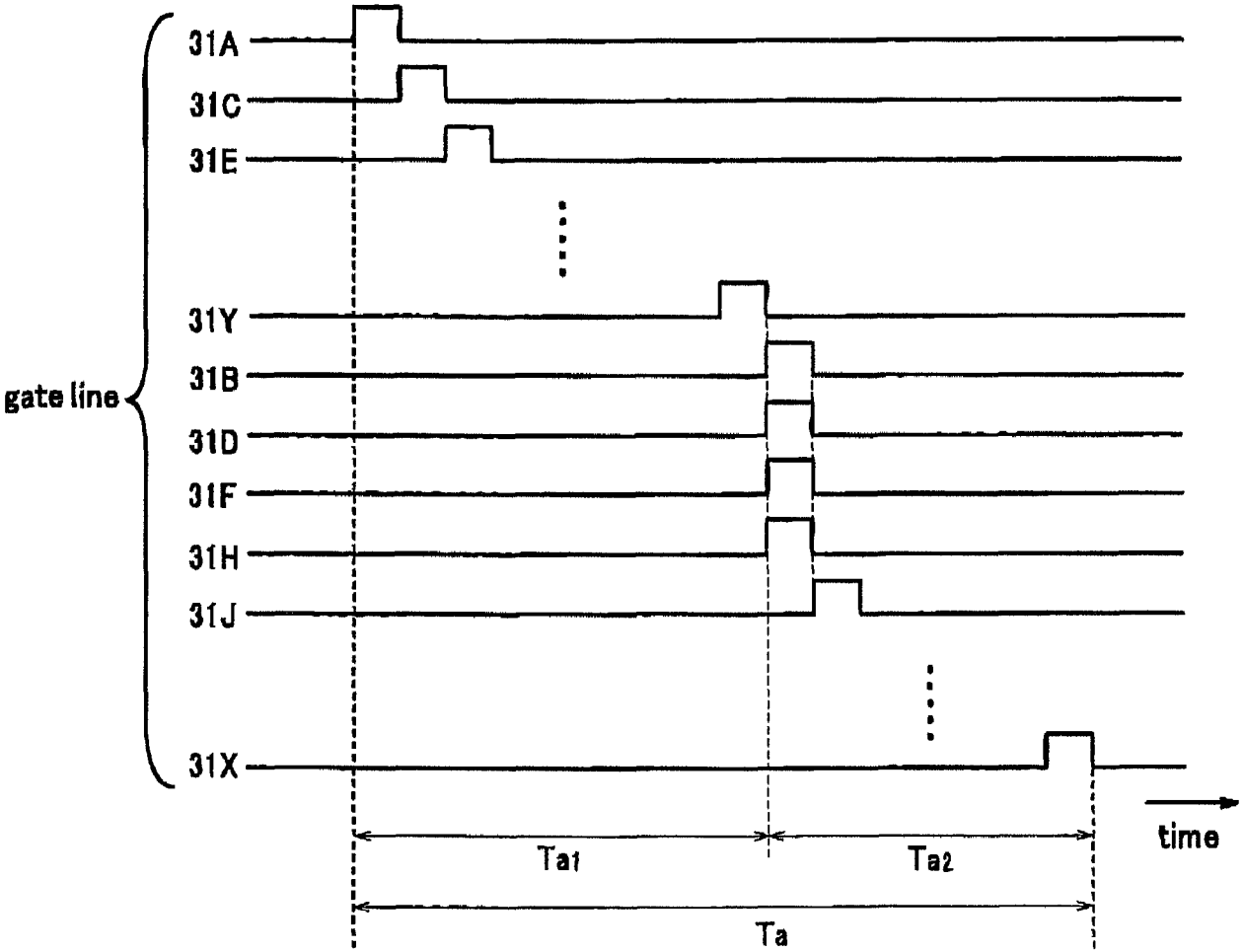
FIG. 31 is a timing chart showing timings at which the scan signals are output to respective gate lines in the liquid crystal display according to the eleventh embodiment.

Subsequently, the timings at which the scan signals are output to the respective gate lines will be described with reference to FIG. 31. FIG. 31 shows timings at which the scan signals are output in the case where the video signals are written onto the pixel electrodes 40A, 40C, 40E . . . associated with the gate lines 31A, 31C, 31E . . . won odd rows and the black signals are written onto the pixel electrodes 40B, 40D, 40F . . . associated with the gate lines 31B, 31D, 31F . . . on even rows in the 1st red sub-frame period, the 1st blue sub-frame period, and the 1st green sub-frame period. In FIG. 31, the 1st write period Ta1 and the 2nd write period Ta2 in the video signal write period Ta of one sub-frame period are respectively set for the first writing and the second writing. In FIG. 31, 31Y represents a gate line on last-odd row and 31X represents a gate line on last-even row.

As shown in FIG. 31, the scan signals are sequentially output to the gate lines 31A, 31C, 31E . . . on odd rows in the 1st write period Ta1. Thereby, the video signals are sequentially written onto the pixel electrodes 40A, 40C, 40E . . . associated with the gate lines 31A, 31C, 31E . . . on odd rows as described above. Meanwhile, the scan signals are output to the gate lines 31B, 31D, 31F . . . on even rows in the 2nd write period Ta2, in which case, the scan signals are simultaneously output to each set of four gate lines. Illustrated in FIG. 31 are the scan signals simultaneously output to the gate lines 31B, 31D, 31F, 31H. Thereby, the number of times the scan signals are output in the 2nd write period Ta2 is equal to ¼ of the number of the gate lines 31B, 31D, 31F . . . For instance, in case of the liquid crystal display panel 10 having 480 gate lines according to NTSC standard, the image is displayed in the pixels corresponding to 240 gate lines in each sub-frame period, and black is displayed in the pixels corresponding to the remaining 240 gate lines. In a normal drive method in which the scan signals are sequentially output to the respective gate lines one by one, it is necessary to output the scan signals (240+240=480) times in each sub-frame period. However, when the scan signals are output to each set of four gate lines and the black signals are simultaneously written onto the pixel electrodes associated with these four gate lines, the black display is achieved by outputting the scan signals 240/4=60 times, and the required number of times the scan signals are output in each sub-frame period is (240+60=300). Therefore, when the one frame period is composed of six sub-frame periods, the number of times the scan signals are output in each one frame period in this embodiment is (300×6=1800), although the scan signals must be output (480×6=2880) times in each frame period in the conventional normal drive method.

In this manner, the number of times the scan signals are output can be reduced, and the video signal write period Ta in each sub-frame period can be correspondingly reduced. Since the ratio of the light-emitting time of LEDs to each sub-frame period can be increased, sufficiently bright and satisfactory display is attained. Besides, since the number of the sub-frame periods composing one frame period is greater than that of the conventional example, the color breaking can be lessened.

While in this embodiment the scan signals are simultaneously output to each set of four gate lines, the effects of reducing the number of times the scan signals are output can be provided by outputting the scan signals simultaneously to each set of two lines or more. The greater the number of times the scan signals are simultaneously output is, the less the number of times the scan signals are output is, and the longer the time of one signal writing is made. It should be remembered that if the number of the gate lines to which the scan signals are simultaneously output is increased to excess, then insufficient writing occurs, which causes improper display. That is, the number of times the scan signals are simultaneously output depends on performance of the source driver.

While the video signal or the black signal is alternately written onto the pixel electrode associated with each gate line, this may be performed for each plural gate lines. The number of gate lines needs to be determined in the light of a peripheral circuit, a drive method, visibility, etc.

While in this embodiment, one frame period is composed of six sub-frame periods, the number is not limited to six. The greater number of sub-frames makes it possible that the color breaking is hardly perceived because the light-emitting time and the light-emitting interval is reduced, but makes the time required for one signal writing shorter, which places large burden on the respective circuits.

Figure 32A:
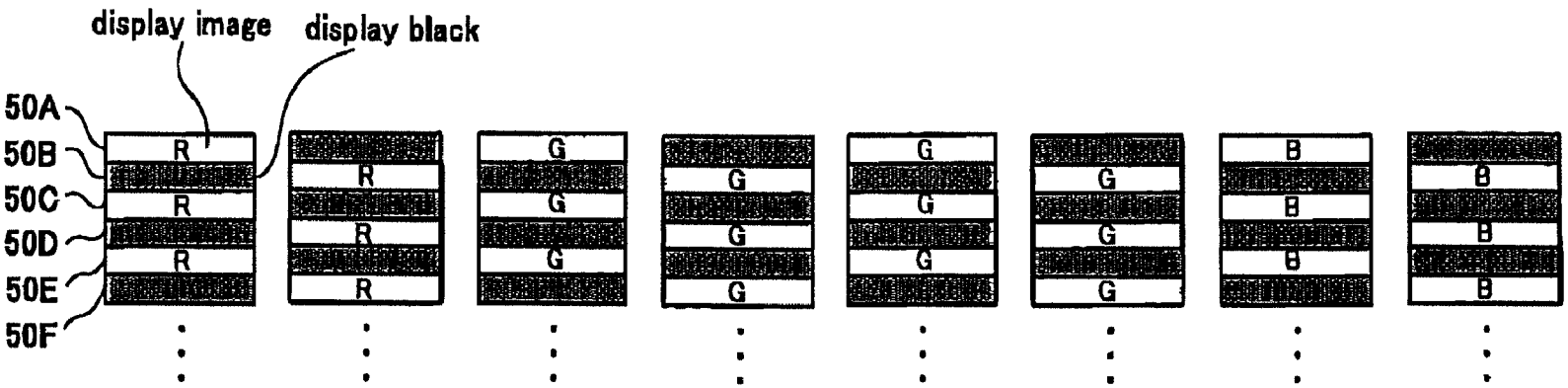
Figure 32B:
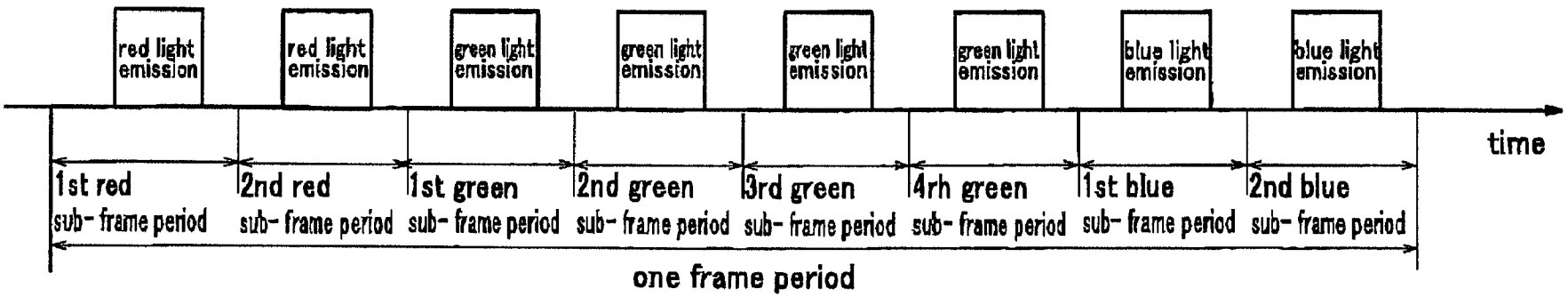

Further, while in this embodiment two sub-frame periods are provided for each color, different number of sub-frames can be provided according to color. For instance, in the light of viewing characteristic in which human beings are sensitive to green, green sub-frames may be set greater than sub-frames of the other colors, as show in FIG. 32.

Moreover, in the normally white mode, by writing of the black signals at fixed intervals as described above, the backward transition from the spray alignment to the bend alignment can be prevented. Consequently, satisfactory image can be stably displayed.

EMBODIMENT 12

A twelfth embodiment illustrates a liquid crystal display in which two continuous sub-frame periods are set as sub-frame periods of different colors, differently from the eleventh embodiment. The constitution of the liquid crystal display of this embodiment is identical to that of the seventh embodiment, and as such, description thereof is omitted.

Figure 33A:
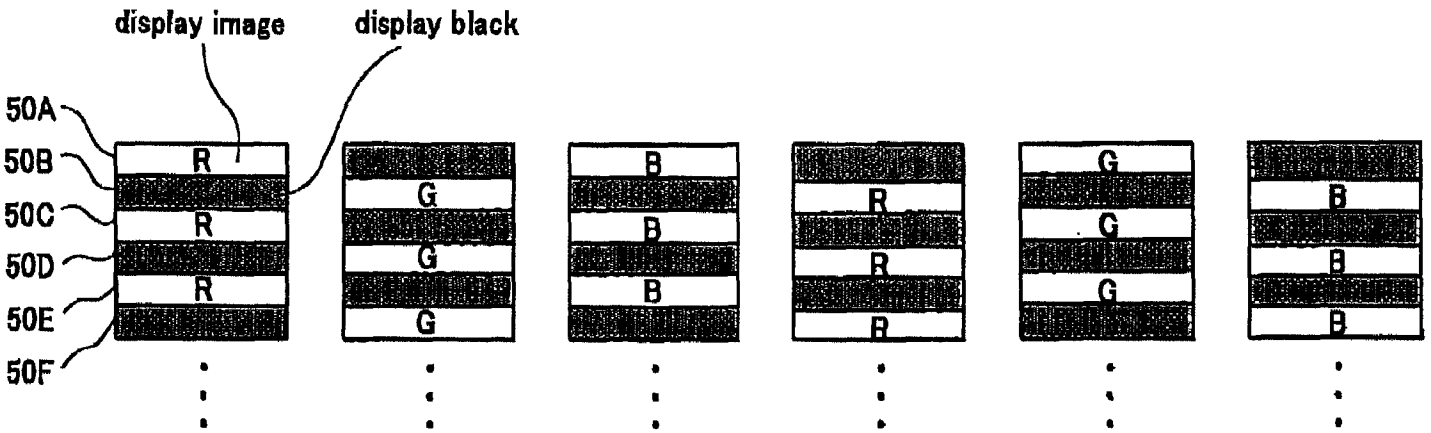
Figure 33B:
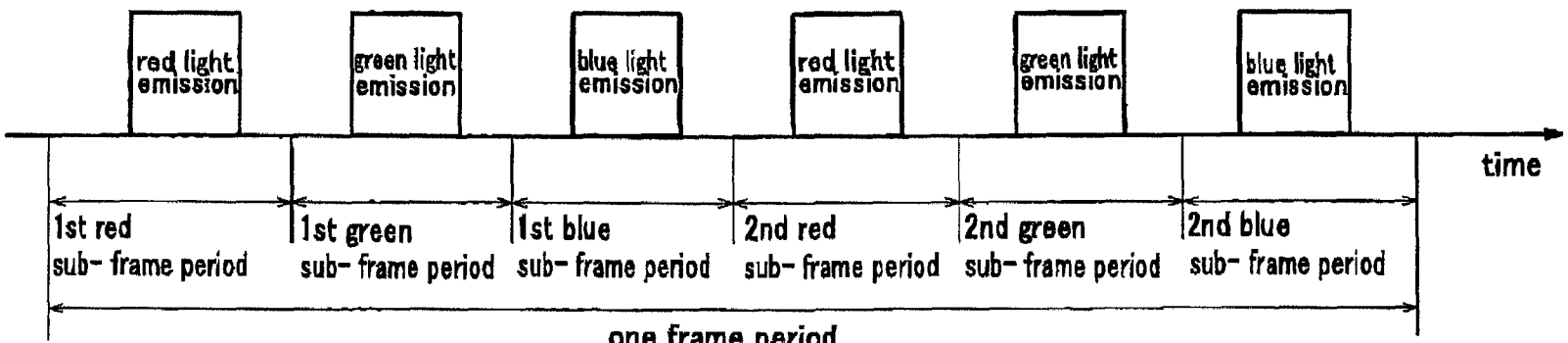

FIGS. 33A, 33B are conceptual views showing operation of the liquid crystal display 1 according to the twelfth embodiment of the present invention. FIG. 33A represents image displayed in pixels 50A, 50B, 50C, 50D, 50E, 50F . . . corresponding to gate lines 31A, 31B, 31C, 31D, 31E, 31F . . . , and FIG. 33B represents light-emitting time of the LEDs of the backlight 20.

As shown in FIG. 33B, the twelfth embodiment is similar to the eleventh embodiment in that one frame period is composed of six sub-frame periods and two sub-frame periods are provided for each color, and differs from the same in that sub-frame periods of different colors are continuously provided. While the sub-frame periods are provided in the order of red, green, blue, red, green, blue, . . . the order is not limited to this, and may be, e.g., green, blue, red, green, blue, red, . . . .

In this embodiment, in the 1st red sub-frame period, the 1st blue sub-frame period, and the 2nd green sub-frame period, the video signals are written onto the pixel electrodes 40A, 40C, 40E . . . associated with the gate lines 31A, 31C, 31E . . . on odd rows, and then the black signals are written onto the pixel electrodes 40B, 40D, 40F . . . associated with the gate lines 31B, 31D, 31F . . . on even rows. As a result, as shown in FIG. 33A, image corresponding to the video signals is displayed in the pixels 50A, 50C, 50E . . . associated with the gate lines 31A, 31C, 31E . . . on odd rows, while black is displayed in the pixels 50B, 50D, 50F . . . associated with the gate lines 31B, 31D, 31F . . . on even rows.

Meanwhile, in the 1st green sub-frame period, the 2nd red sub-frame period, and the 2nd blue sub-frame period, the video signals are written onto the pixel electrodes 40B, 40D, 40F . . . associated with the gate lines 31B, 31D, 31F . . . on even rows, and then the black signals are written onto the pixel electrodes 40A, 40C, 40E . . . associated with the gate lines 31A, 31C, 31E . . . on odd rows. As a result, as shown in FIG. 33A, black is displayed in the pixels 50A, 50C, 50E . . . associated with the gate lines 31A, 31C, 31E . . . on odd rows, while the image corresponding to the video signals is displayed in the pixels 50B, 50D, 50F . . . associated with the gate lines 31B, 31D, 31F . . . on even rows.

Similarly to the eleventh embodiment, the liquid crystal display of this embodiment is also adapted to output the scan signals to each set of plural gate lines simultaneously in writing of the black signals. This reduces the number of times the scan signals are output, and therefore reduces the video signal write period similarly to the eleventh embodiment.

Further, in this embodiment, operation is performed so that different-color light is emitted in the continuous sub-frame periods, and therefore successive one-color light emission is reduced. Consequently, color separation becomes less perceivable.

EMBODIMENT 13

A thirteenth embodiment illustrates a liquid crystal display adapted to perform black display in pixels corresponding to gate lines on the same row in continuous sub-frame periods. The constitution of the liquid crystal display of this embodiment is identical to that of the seventh embodiment, and as such description thereof is omitted.

Figure 34A:
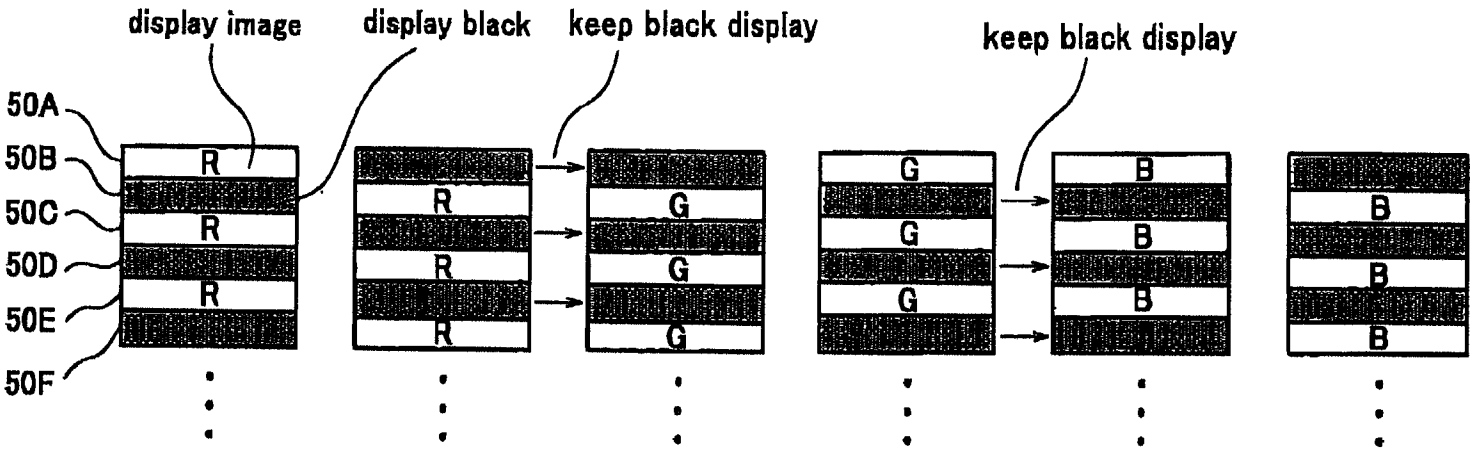
Figure 34B:
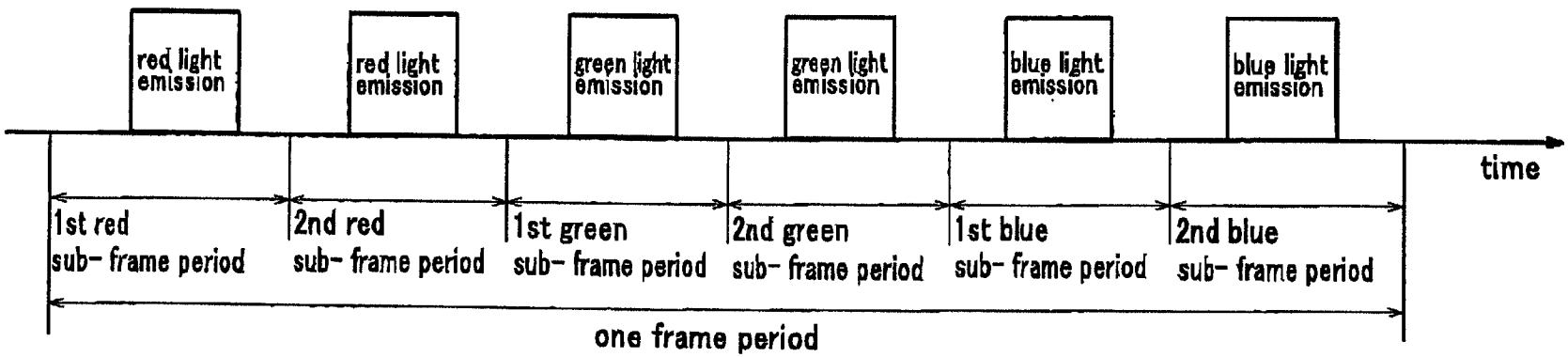

FIGS. 34A, 34B are conceptual views showing operation of the liquid crystal display 1 according to the thirteen embodiment of the present invention. FIG. 34A represents image displayed in pixels 50A, 50B, 50C, 50D, 50E, 50F . . . corresponding to gate lines 31A, 31B, 31C, 31D, 31E, 31F . . . , and FIG. 34B shows light-emitting time of the LEDs of the backlight 20.

As shown in FIG. 34B, the thirteenth embodiment is similar to the eleventh embodiment in that one frame period is composed of six sub-frame periods set in the order of red, red, green, green, blue, blue, and the order is not limited to this.

In this embodiment, in the 2nd red sub-frame period and the 1st green sub-frame period, the video signals are written onto the pixel electrodes 40B, 40D, 40F . . . associated with the gate lines 31B, 31D, 31F on even rows, and then the black signals are written onto the pixel electrodes 40A, 40C, 40E . . . associated with the gate lines 31A, 31C, 31E . . . on odd rows. As a result, as shown in FIG. 34A, black is displayed in the pixels 50A, 50C, 50E . . . corresponding to the gate lines 31A, 31C, 31E . . . , on odd rows, while the image corresponding to the video signals is displayed in the pixels 50B, 50D, 50F . . . associated with the gate lines 31B, 31D, 31F . . . on even rows.

Meanwhile, in the continuous sub-frame periods, i.e. , 2nd green sub-frame period and 1st blue sub-frame period, the video signals are written onto the pixel electrodes 40A, 40C, 40E . . . associated with the gate lines 31A, 31C, 31E . . . on odd rows, and then the black signals are written onto the pixel electrodes 40B, 40D, 40F . . . associated with the gate lines 31B, 31D, 31F . . . on even rows. As a result, as shown in FIG. 34A, image corresponding to the video signals is displayed in the pixels 50A, 50C, 50E . . . corresponding to the gate lines 31A, 31C, 31E . . . on odd rows, while black is displayed in the pixels 50B, 50D, 50F . . . corresponding to the gate lines 31B, 31D, 31F . . . on even rows.

Figure 35:
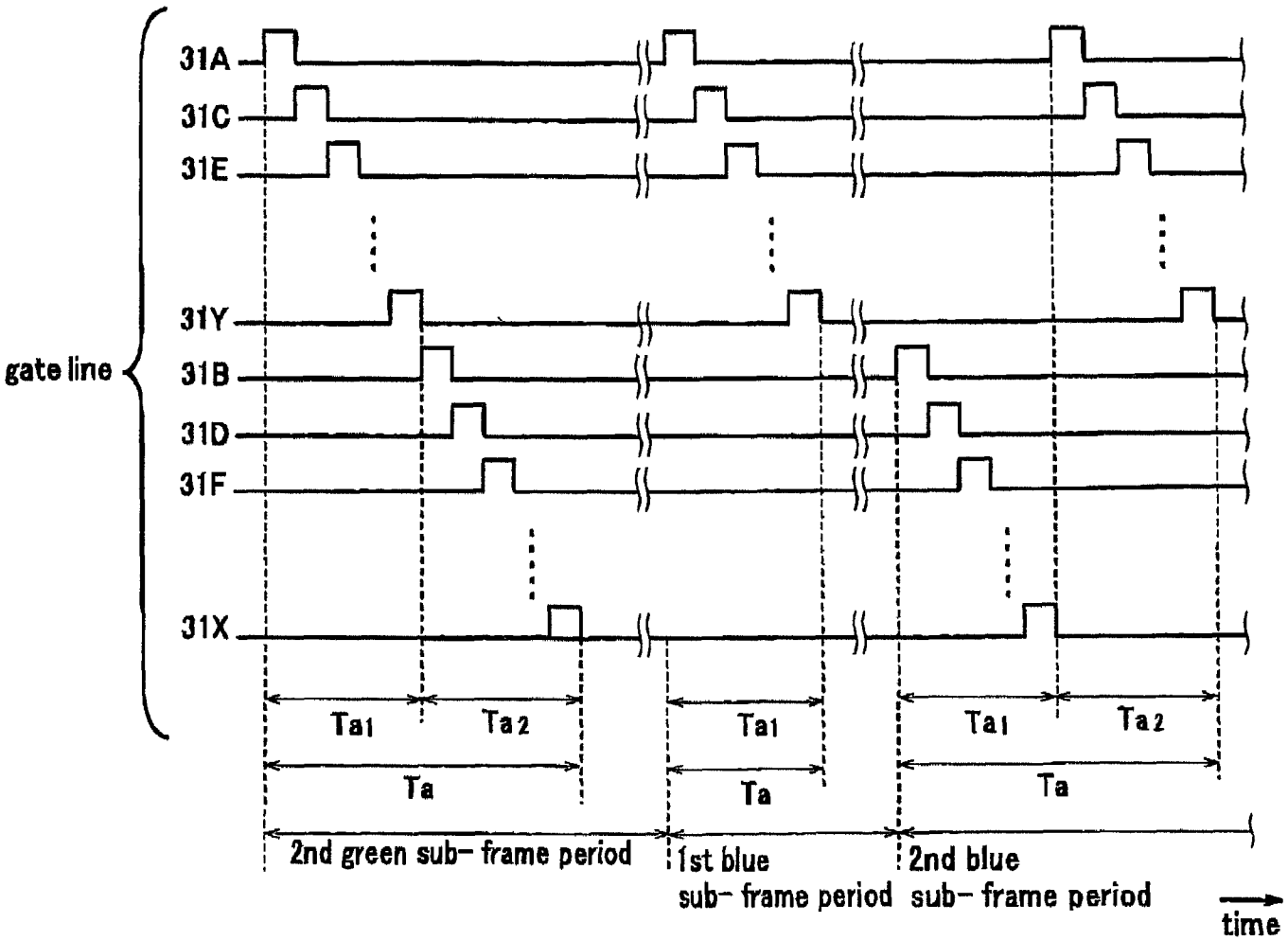
FIG. 35 is a timing cart showing timings at which scan signals are output to respective gate lines in the liquid crystal display according to the thirteenth embodiment.

Subsequently, timings at which the scan signals are output to the respective gate lines will be described with reference to timing chart of FIG. 35. FIG. 35 shows timings at which the scan signals are output when the video signals are written onto the pixel electrodes 40A, 40C, 40E . . . associated with the gate lines 31A, 31C, 31E . . . on odd rows and the black signals are written onto the pixel electrodes 40B, 40D, 40F . . . associated with the gate lines 31B, 31D, 31F . . . on even rows in the 2nd green sub-frame period and the 1st blue sub-frame period.

As shown in FIG. 35, the scan signals are sequentially output to the gate lines 31A, 31C, 31E . . . on odd rows in the 1st write period Ta1 of the 2nd green sub-frame period, thereby causing the video signals to be sequentially written onto the pixel electrodes 40A, 40C, 40E . . . associated with the gate lines 31A, 31C, 31E . . . on odd rows as described above. In the same manner, the scan signals are sequentially output to the gate lines 31B, 31D, 31F . . . on even rows in the 2nd write period Ta2, thereby causing the black signals to be sequentially written onto the pixel electrodes 40B, 40D, 40F . . . associated with the gate lines 31B, 31D, 31F . . . on even rows.

Meanwhile, in the 1st blue sub-frame period, the video signal write period Ta is composed of only 1st write period Ta1 and does not include the 2nd write period Ta2. For this reason, the scan signals are sequentially output to the gate lines 31A, 31C, 31E . . . on odd rows in the 1st write period Ta1 in the same manner as the 2nd green sub-frame period but the scan signals are not output to the gate lines 31B, 31D, 31F . . . on even rows. As a result, the black signals are not written onto the pixel electrodes 40B, 40D, 40F . . . associated with the gate lines 31B, 31D, 31F . . . on even rows but written onto the pixel electrodes 40B, 40D, 40F . . . in the 2nd green sub-frame period that is one sub-frame period before the 1st blue sub-frame period, in which state, black display is kept in the pixels 50B, 50D, 50F . . . corresponding to the gate lines 31B, 31D, 31F . . . .

In this operation, in the two sub-frame periods, i.e., the 1st green sub-frame period and the 1st blue sub-frame period, output operation of the scan signals in the 1st write period Ta1 is satisfactory. Therefore, in case of the liquid crystal display panel 10 having 480 gate lines, the required number of times the scan signals are output in these two sub-frame periods, is 240, and therefore, the number of times necessary for the whole one frame period is $480\times4+240\times2=2400$.

Similarly to the eleventh embodiment, the number of times can be further reduced by outputting the scan signals to each set of four gate lines simultaneously in writing of the black signals. In that case, the number of times is $240\times4+(240/4)\times4+240\times2=1920$.

Figure 36A:
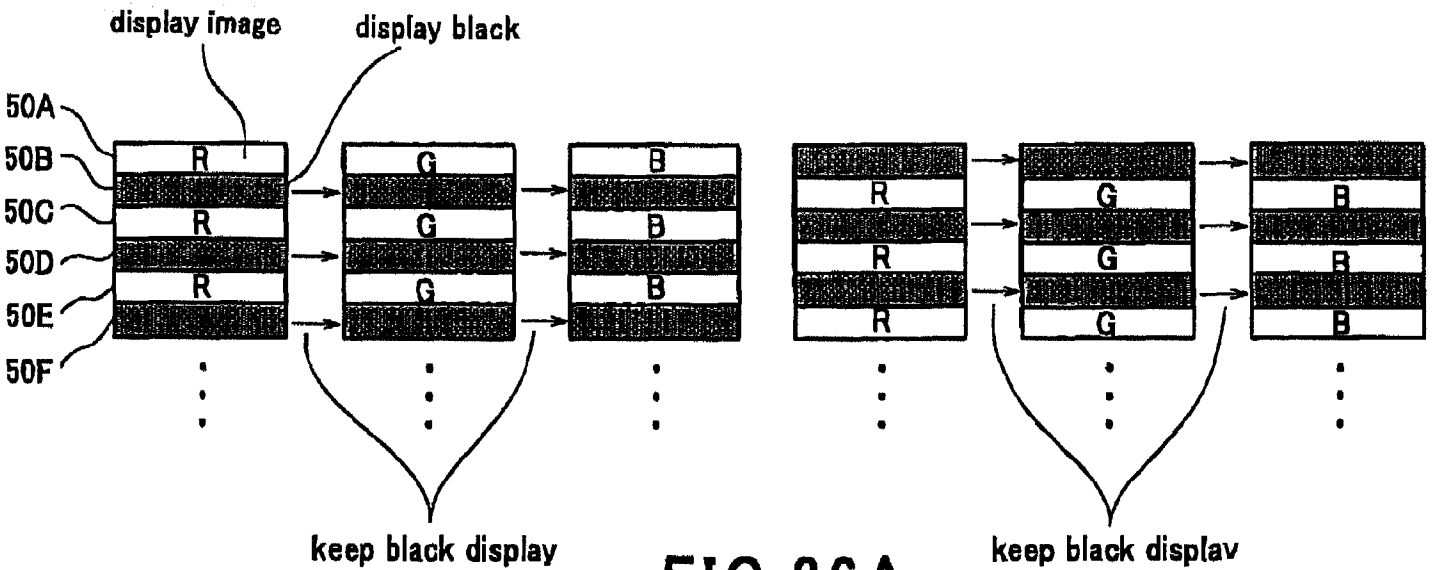
Figure 36B:
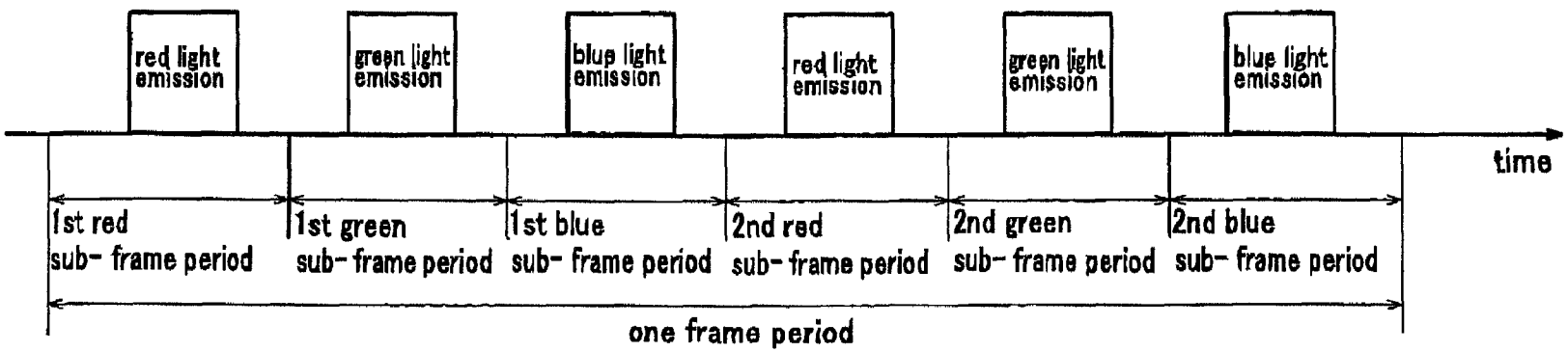

While black display is conducted in the pixels corresponding to the gate lines on the same row in the two continuous sub-frame periods, this may be conducted in the same manner in three continuous sub-frame periods as shown in FIG. 36. In FIG. 36, the black signals are written onto the pixel electrodes 40B, 40D, 40F . . . associated with the gate lines 31B, 31D, 31F . . . on even rows in the 1st red sub-frame period, the 1st green sub-frame period, and the 1st blue sub-frame period, while the black signals are written onto the pixel electrodes 40A, 40C, 40E . . . associated with the gate lines 31A, 31C, 31E . . . on odd rows in the 2nd red sub-frame period, the 2nd green sub-frame period, and the 2nd blue sub-frame period.

In this operation, in the 1st green sub-frame period and the 1st blue sub-frame period, and the 2nd green sub-frame period and the 2nd blue sub-frame period, output operation of the scan signals only in the 1st write period Ta1 is satisfactory. Therefore, in case of the liquid crystal display panel 10 having 480 gate lines, the required number of times the scan signals are output in these four sub-frame periods is 240, and therefore, the number of times necessary for the whole one frame period is 480×2+240×4=1920. Besides, similarly to the eleventh embodiment, the number of times can be further reduced by outputting the scan signals to each set of four gate lines simultaneously in writing of the black signals. In that case, the number of times is 240×2+(240/4)×2+240×4=1560.

EMBODIMENT 14

A fourteenth embodiment illustrates a liquid crystal display adapted to display image of each color in each set of three sub-frame periods. The constitution of the liquid crystal display of this embodiment is identical to that of the seventh embodiment, and as such description thereof is omitted.

In the eleventh embodiment, in one-color sub-frame period of one sub-frame period, image according to video signals and black are repeatedly displayed in each set of two sub-frame periods. That is, image is displayed only in one sub-frame period of this each set of sub-frame periods. This configuration brings about nearly half brightness as compared to the conventional example in which one frame period is composed of three sub-frame periods of respective colors.

Figure 37A:
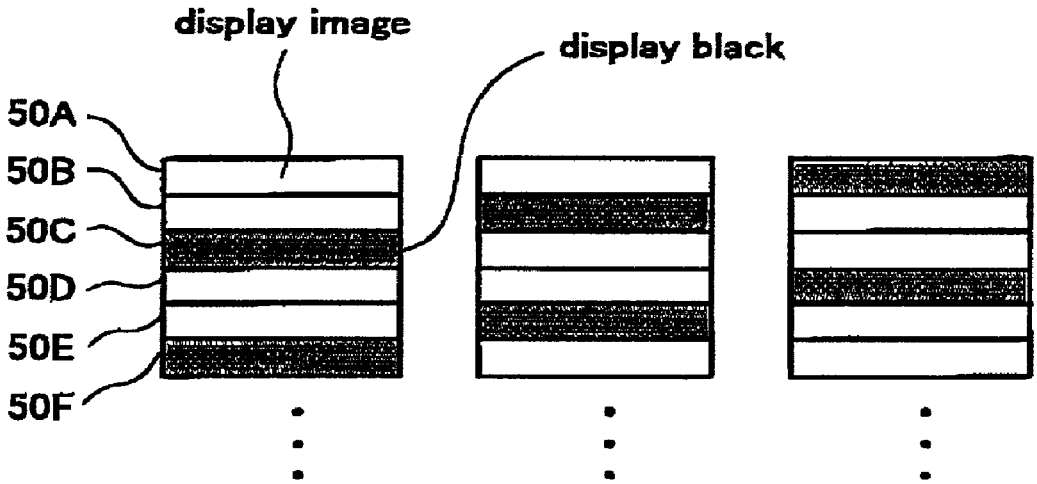
Figure 37B:
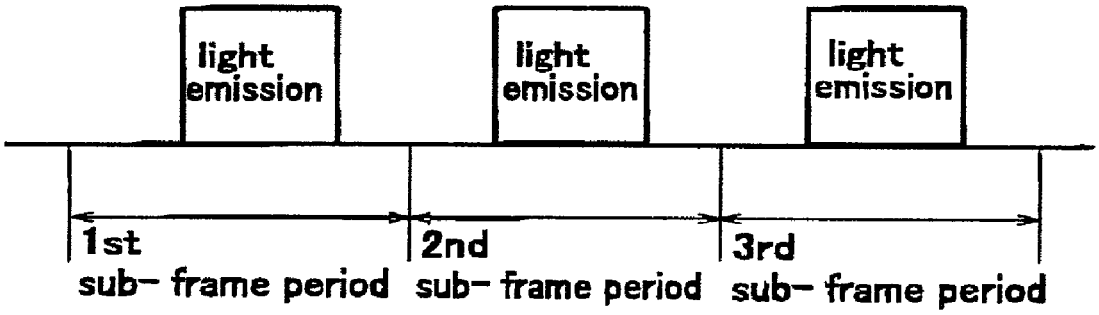

Accordingly, in this embodiment, image of each color is displayed in each set of three sub-frame periods. FIGS. 37A, 37B are conceptual views showing an example of operation of the liquid crystal display 1 according to the fourteenth embodiment in three sub-frame periods of an arbitrary color. FIG. 37A represents image displayed in pixels 50A, 50B, 50C, 50D, 50E, 50F . . . associated with the gate lines 31A, 31B, 31C, 31D, 31D, 31E, 31F . . . and FIG. 37B represents light-emitting time of LEDs of the backlight 20.

As shown in FIG. 37B, in the 1st sub-frame period, the video signals are written onto the pixel electrodes 40A, 40B respectively associated with the gate line 31A on 1st row and the gate lines 31B on 2nd row and the black signal is written onto the pixel electrode 40C associated with the gate line 31C on 3rd row, while the video signals are written onto the pixel electrodes 40D, 40E respectively associated with the gate line 31D on 4th gate line 31D and the gate line 31E on 5th row and the black signal is written onto the pixel electrode 40F associated with the gate line 31F on 6th row. Thereafter, the video signal and the black signal are repeatedly written in the same manner. As a result, the image corresponding to the video signals is displayed in the pixels associated with two gate lines of the three continuous gate lines and the black is displayed in the pixel corresponding to the remaining one gate line. In case of the gate lines 31A, 31B, 31C, the image corresponding to the video signals is displayed in the pixels 50A, 50B corresponding to gate lines 31A, 31B and black is displayed in the pixel 50C corresponding to the gate line 31C.

In the 2nd sub-frame period, the video signals are written onto the pixel electrodes 40A, 40C respectively associated with the gate line 31A on 1st row and the gate lines 31C on 3rd row and the black signal is written onto the pixel electrode 40B associated with the gate line 31F on 2nd row, while the video signals are written onto the pixel electrodes 40D, 40F associated with the gate line 31D on 4th row and the gate line 31F on 6th row, and the black signal is written onto the pixel electrode 40E associated with the gate line 31E on the 5th gate line 31E on the 5th row. Thereafter, the video signal and the black signal are repeatedly written in the same manner. As a result, as shown in FIG. 37A, black is displayed in the pixel associated with one gate line of three continuous gate lines and image corresponding to video signals is displayed in pixels corresponding to two gate lines with the one gate line disposed therebetween. In case of the gate lines 31A, 31B, 31C, image corresponding to the video signals is displayed in the pixels 50A, 50C corresponding to the gate lines 31A, 31C and black is displayed in the pixel 50B corresponding to the gate line 31B.

Further, in the 3rd sub-frame period, the black signal is written onto the pixel electrode 40A associated with the gate line 31A on 1st row and the video signals are written onto the pixel electrodes 40B, 40C respectively associated with the gate line 31B on 2nd row and the gate line 31C on 3rd row. Also, the black signal is written onto the pixel electrode 40D associated with the gate line 31D on 4th row and the video signals are written onto the pixel electrodes 40E, 40F respectively associated with the gate line 31E on 5th row and the gate line 31F on 6th row. Thereafter, the video signal and the black signal are repeatedly written in the same manner. As a result, the black is displayed in the pixel corresponding to the 1st gate line of the three continuous gate lines and the image corresponding to the video signals is displayed in the pixels associated with the following two gate lines. In case of the gate lines 31A, 31B, 31C, the image corresponding to the video signals is displayed in the pixels 50B, 50C associated with the gate lines 31B, 31C and black is displayed in the pixel 50A corresponding to the gate line 31A.

Similarly to the eleventh embodiment, the video signals may be first written and then the black signals may be written in each sub-frame period.

In accordance with this display's drive mechanism, in pixels corresponding to a gate line, black is displayed in one sub-frame period and image is displayed in the other two sub-frame periods. Consequently, brightness about 1.5 times higher is attained as compared to the eleventh embodiment.

While the image of each color is displayed in each set of three sub-frame periods, this may be performed in each set of 4 or more sub-frames. In that case, much brighter display is achieved.

Figure 38A:
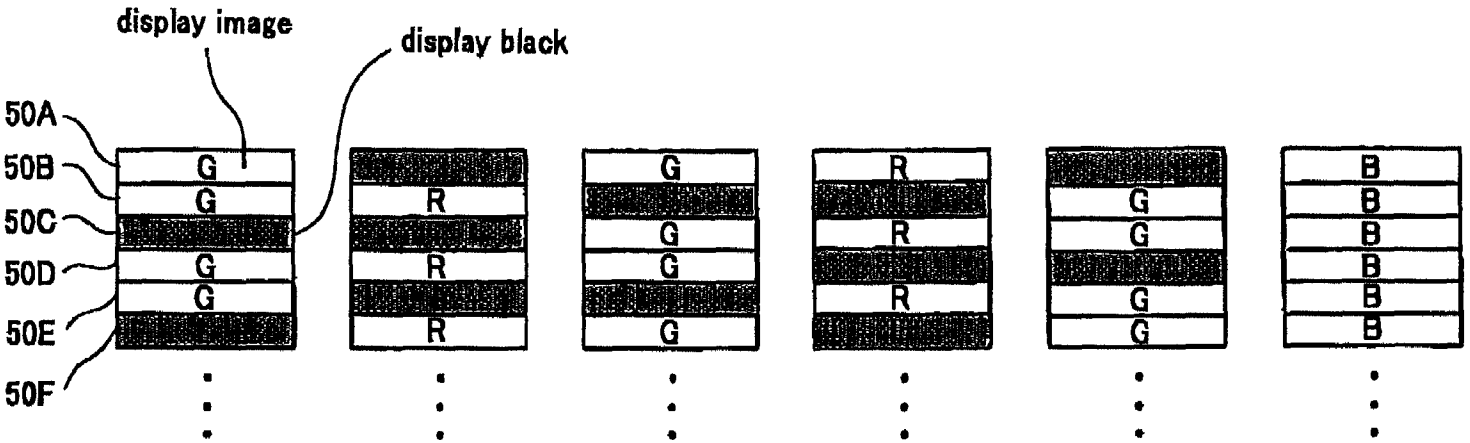

FIG. 38 is a conceptual view showing an example of operation of the liquid crystal display 1 according to the fourteenth embodiment of the present invention in the case where one frame period is composed of three green sub-frame periods, two red sub-frame periods, and one blue sub-frame period. In this case, the 1st, 2nd, and 3rd green sub-frame periods respectively correspond to the 1st, 2nd, and 3rd sub-frame periods shown in FIG. 37. Thereby, green image is brighter than that of the eleventh embodiment. As mentioned previously, in the light of viewing characteristic of human beings, it is essential that green image be displayed satisfactorily, and it is therefore desirable to ensure brightness of green image. Nevertheless, as a matter of course, brightness of image of the other colors may be ensured.

As in the case of the eleventh embodiment, in the liquid crystal display of this embodiment, in writing of the black signals, the scan signals may be output simultaneously to each set of plural gate lines. Since this reduces the number of times the scan signals are output, the video signal write period can be reduced similarly to the eleventh embodiment.

EMBODIMENT 15

A fifteenth embodiment illustrates a liquid crystal display adapted to display image with resolution varying according to color The constitution of the liquid crystal display of this embodiment is identical to that of the seventh embodiment, and as such description thereof is omitted.

As mentioned previously, vision of human beings is sensitive to green, red and blue in this order, and highly sensitive to green. Accordingly, in this embodiment, the vertical resolution is varied according to color and image is displayed so that resolution becomes higher in the order of green, red, and blue. For example, in case of the liquid crystal display panel 10 having 480 gate lines, the vertical resolutions of green, red, and blue are respectively set to 480, 320, and 240.

Figure 39A:
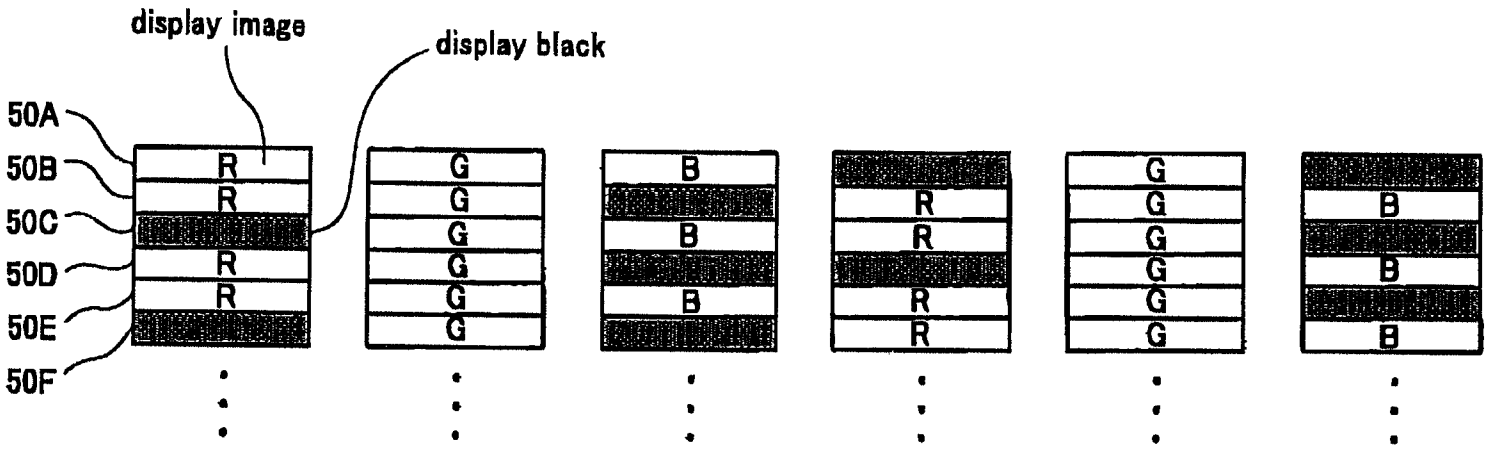
Figure 39B:
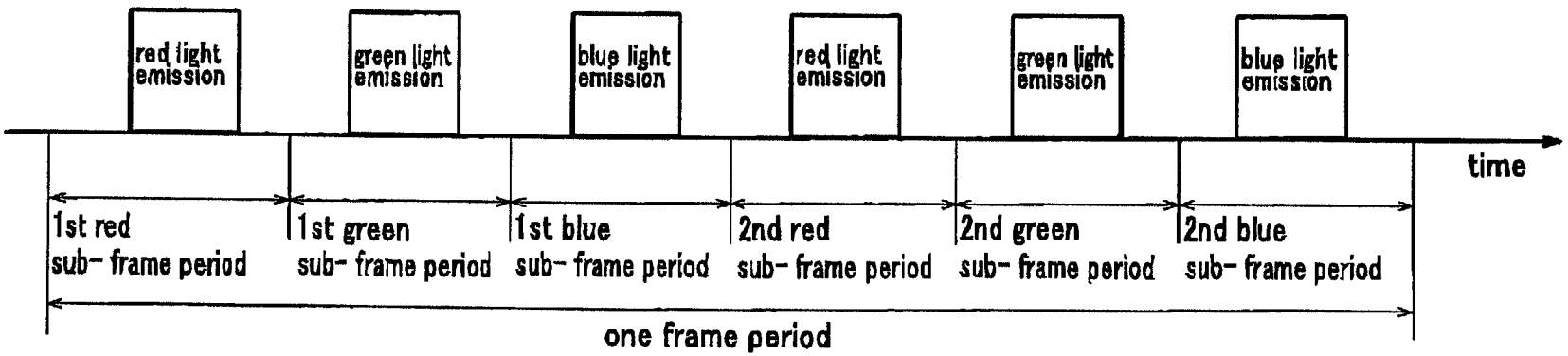

FIGS. 39A, 39B are conceptual views showing an example of the operation of the liquid crystal display according to the fifteenth embodiment. FIG. 39A represents image displayed in pixels 50A, 50B, 50C, 50D, 50E, 50F . . . corresponding to the gate lines 31A, 31B, 31C, 31D, 31E, 31F . . . and FIG. 37B represents light-emitting time of LEDS of the backlight 20.

As shown in FIGS. 39A, 39B, in the 1st and 2nd green sub-frame periods, the video signals are written onto the pixel electrodes 40A, 40B, 40C, 40D, 40E, 40F . . . associated with all the gate lines 31A, 31B, 31C, 31D, 31E, 31F . . . . As a result, in these sub-frame periods, the vertical resolution of green image is equal to the number of the gate lines included in the liquid crystal display panel 10.

Meanwhile, in the 1st and 2nd red sub-frame periods, video signals are written onto the pixel electrodes associated with the two gate lines of three continuous gate lines and the black signal is written onto the pixel electrode associated with the remaining one gate line. For instance, in the 1st red sub-frame period, the video signals are written onto the pixel electrodes 40A, 40B associated with the gate lines 31A, 31B and the black signal is written onto the pixel electrode 40C associated with the gate line C. As a result, in these sub-frame periods, the vertical resolution of red image is equal to ⅔ of the number of the gate lines of the liquid crystal display panel 10.

In the 1st blue sub-frame period, the video signals are written onto the pixel electrodes 40A, 40C, 40E . . . associated with the gate lines 31A, 31C, 31E . . . on odd rows and the black signals are written onto the pixel electrode 40B, 40D, 40F . . . associated with the gate lines 31B, 31D, 31F . . . on even rows . . . . Conversely, in the 2nd blue sub-frame period, the black signals are written onto the pixel electrodes 40A, 40C, 40E . . . associated with the gate lines 31A, 31C, 31B . . . on odd rows and the video signals are written onto the pixel electrode 40B, 40D, 40F . . . associated with the gate lines 31B, 31D, 31F . . . on even rows . . . . As a result, in these sub-frame periods, the vertical resolution of blue video is equal to ½ of the number of the gate lines of the liquid crystal display panel 10.

Also, in writing of the black signals in the red sub-frame period and the blue sub-frame period, the scan signals are simultaneously output to each set of several gate lines similarly to the eleventh embodiment. This reduces the number of times the scan signals are output in one frame period.

Furthermore, by writing of the black signals to the pixel electrodes associated with the same gate line over continuous sub-frame periods like the thirteenth embodiment, the number of times the scan signals are output in one frame period can be further reduced.

In the sub-frame periods in which the video signals and the black signals are written, the video signals are first written and then the black signals are written as in the case of the eleventh embodiment.

EMBODIMENT 16

In the eleventh through fifteenth embodiment, the resolution is equal in the sub-frame periods of the same color. A sixteenth embodiment illustrates a liquid crystal display adapted to display image with different resolutions in the sub-frame periods of the same color. The constitution of the liquid crystal display of this embodiment is identical to that of the seventh embodiment, and as such description thereof is omitted.

Figure 38B:
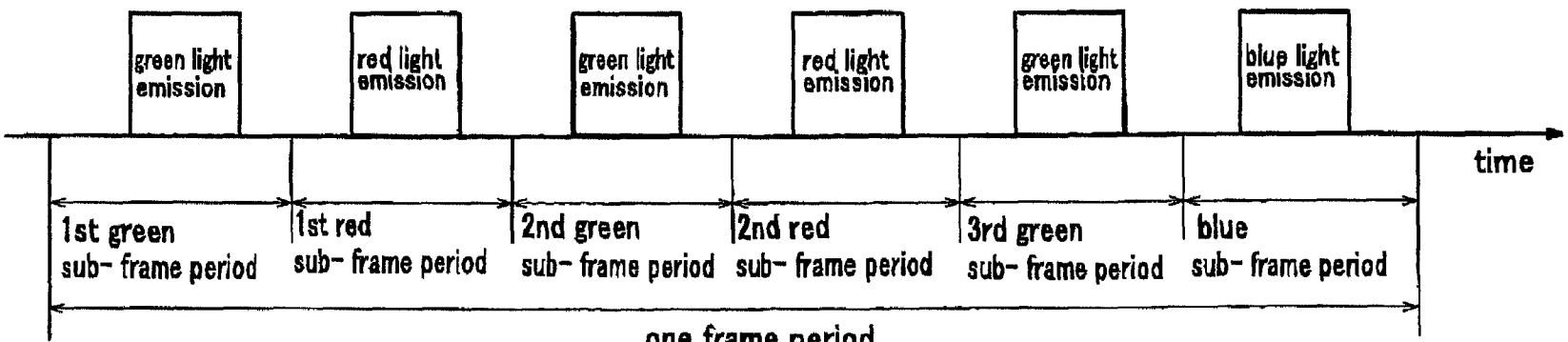
Figure 40A:
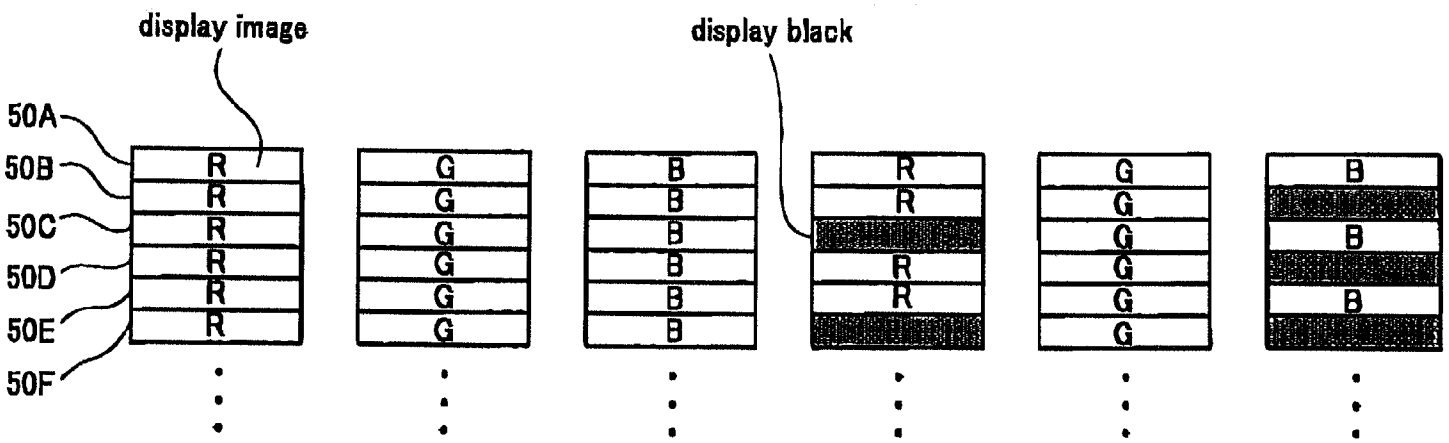
Figure 40B:
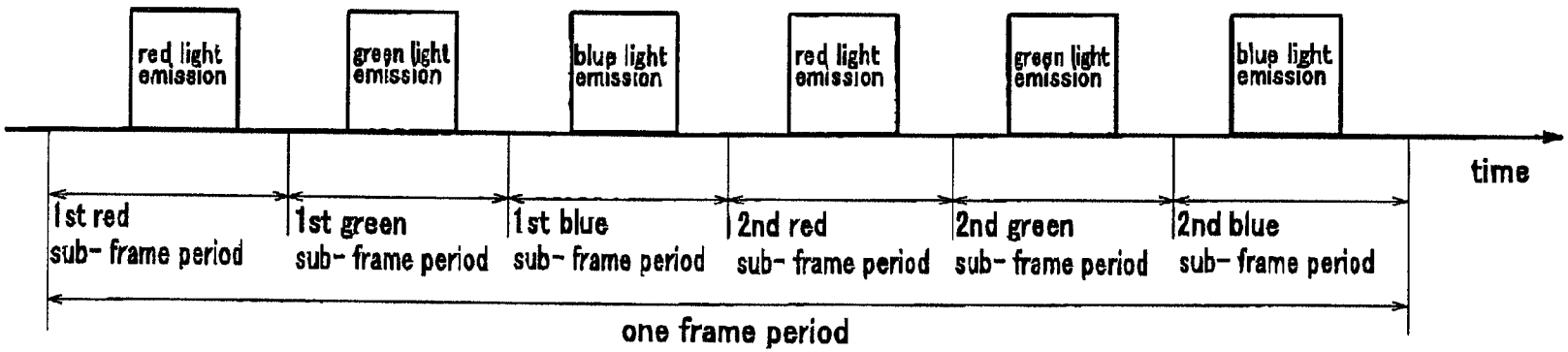

FIGS. 40A, 40B are conceptual views showing an example of the operation of the liquid crystal display 1 according to the sixteenth embodiment. FIG. 40A represents image displayed in pixels 50A, 50B, 50C, 50D, 50E, 50F . . . corresponding to the gate lines 31A, 31B, 31C, 31D, 31E, 31F . . . and FIG. 38B represents light-emitting time of LEDS of the backlight 20.

As shown in FIGS. 40A, 40B, in the 1st red sub-frame period, the 1st and 2nd green sub-frame periods, and the 1st blue sub-frame period, the video signals are written onto the pixel electrodes 40A, 40B, 40C, 40D, 40E, 40F . . . associated with all the gate lines 31A, 31B, 31C, 31D, 31E, 31F . . . . As a result, in these sub-frame periods, the vertical resolution of image of each color is equal to the number of the gate lines included in the liquid crystal display panel 10.

Meanwhile, in the 2nd red sub-frame period, video signals are written onto the pixel electrodes associated with the two gate lines of three continuous gate lines and the black signal is written onto the pixel electrode associated with the remaining one gate line. For instance, in case of the gate lines 31A, 31B, 31C, the video signals are written onto the pixel electrodes 40A, 40B associated with the gate lines 31A, 31B and the black signal is written onto the pixel electrode 40C associated with the gate line 31C. As a result, in the 2nd red sub-frame period, the vertical resolution of red image is equal to ⅔ of the gate lines of the liquid crystal display panel 10.

In the 2nd blue sub-frame period, the video signals are written onto the pixel electrodes 40A, 40C, 40E . . . associated with the gate lines 31A, 31C, 31E . . . on odd rows and the black signals are written onto the pixel electrode 40B, 40D, 40F . . . associated with the gate lines 31B, 31D, 31F . . . on even rows . . . . As a result, in the 2nd blue sub-frame period, the vertical resolution of blue image is equal to ½ of the number of the gate lines of the liquid crystal display panel 10.

Further, in writing of the black signals in the red sub-frame period and the blue sub-frame period, the scan signals are simultaneously output to each set of several gate lines similarly to the eleventh embodiment. This reduces the number of times the scan signals are output in one fame period. Also, advantageously, resolution of the whole image is higher than that of the fifteenth embodiment.

Moreover, by writing of the black signals to the pixel electrodes associated with the same gate line over continuous sub-frame periods like the thirteenth embodiment, the number of times the scan signals are output in one frame period can be further reduced as in the case of the fifteenth embodiment.

In the sub-frame periods in which the video signals and the black signals are written, the video signals are first written and then the black signals are written as in the case of the eleventh embodiment.

EMBODIMENT 17

A seventeenth embodiment Illustrates a liquid crystal display adapted to write the same video signal onto pixel electrodes associated with a plurality of gate lines. The constitution of the liquid crystal display of this embodiment is identical to that of the eleventh embodiment, and as such, description thereof is omitted.

In the eleventh to sixteenth embodiments, the black signals are written onto the pixel electrodes associated with specified gate lines. In that case, the number of times the scan signals are output in one frame period can be reduced but there is a possibility that luminance is reduced. Accordingly, this embodiment is directed to reducing the number of times the scan signals are output while ensuring sufficient luminance.

Figure 41A:
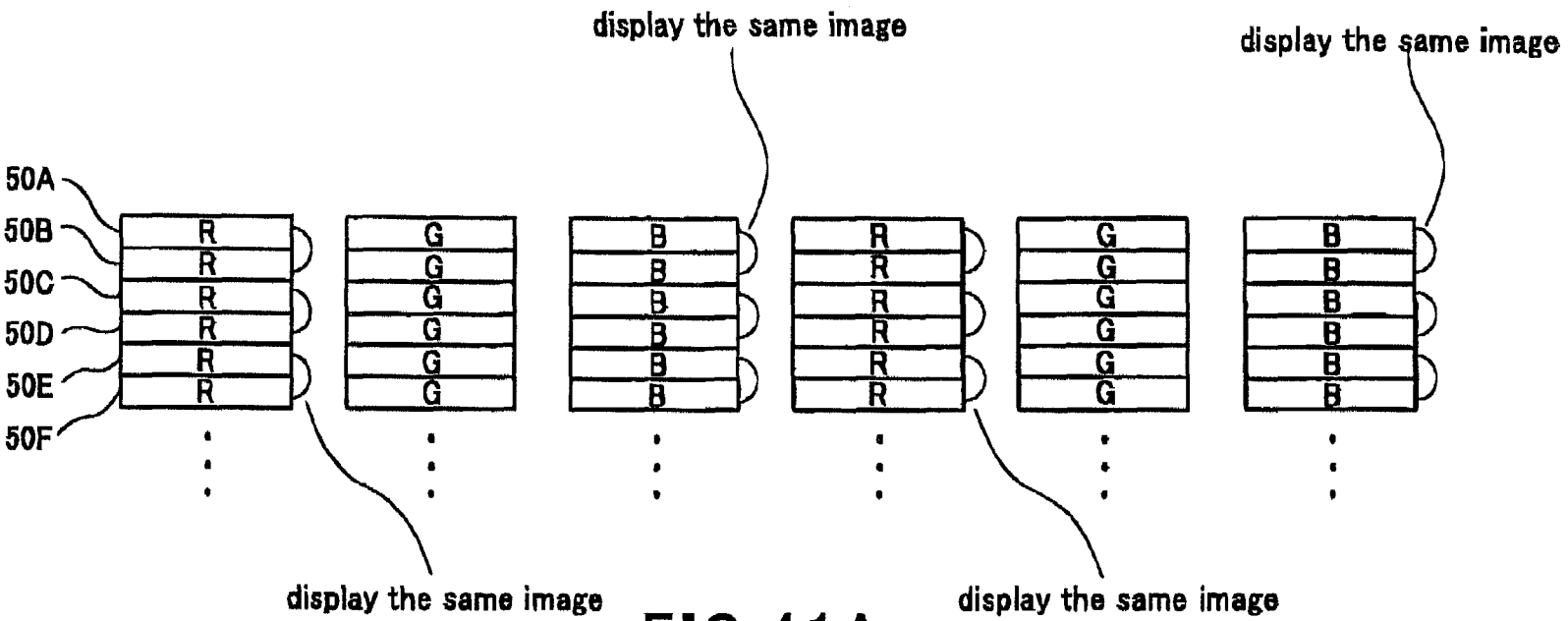
Figure 41B:
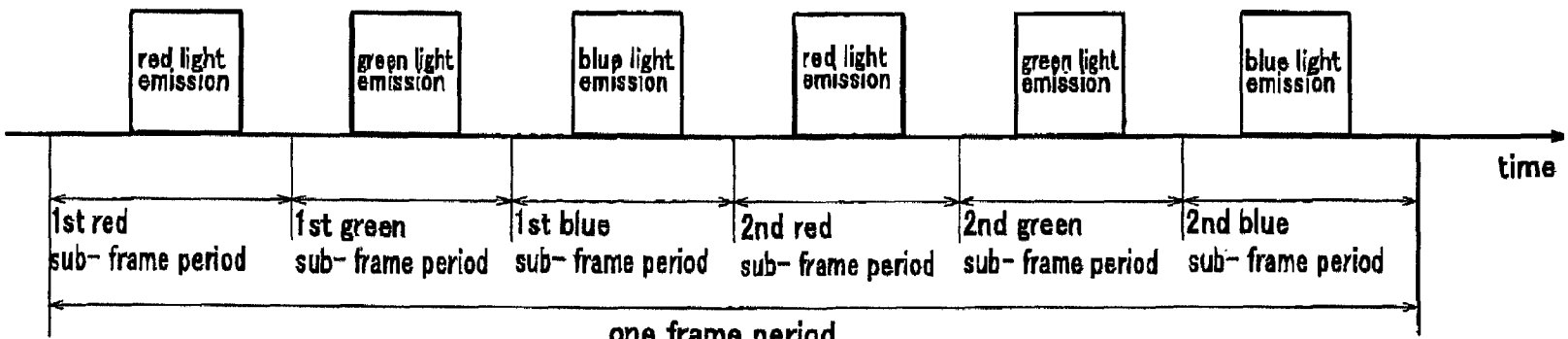

FIGS. 41A, 41B are conceptual views showing an example of the operation of the liquid crystal display 1 according to the seventeenth embodiment. FIG. 41A represents image displayed in pixels 50A, 50B, 50C, 50D, 50E, 50F . . . associated with the gate lines 31A, 31B, 31C, 31D, 31E, 31F . . . and FIG. 41B represents light-emitting time of LEDS of the backlight 20.

As shown in FIGS. 41A, 41B, in the 1st and 2nd green sub-frame periods, the video signals are sequentially written onto the pixel electrodes 40A, 40B, 40C, 40D, 40B, 40F . . . associated with the gate lines 31A, 31B, 31C, 31D, 31E, 31F . . . . As a result, as shown in FIG. 41A, the image corresponding to the video signals is displayed in the pixels 50A, 50B, 50C, 50D, 50E, 50F . . . corresponding to all the gate lines 31A, 31B, 31C, 31E, 31F . . . .

Meanwhile, in the 1st and 2nd red sub-frame periods and the 1st and 2nd blue sub-frame periods, the same video signal is written onto each set of pixel electrodes 40A and 40B, 40C and 40D, 40E and 40F . . . associated with two continuous gate lines 31A and 31B, 31C and 31D, 31E and 31F . . . . In that case, the scan signals are simultaneously output to the respective sets of the gate lines 31A and 31B, 31C and 31D, 31E and 31F . . . . As a result, as shown in FIG. 41A, image corresponding to the same signal is displayed in respective set of pixels 50A and 50B, 50C and 50D, 50E and 50F . . . associated with the respective set of the gate lines 31A and 31B, 31C and 31D, 31E and 31F . . . . In this case, e.g., in the 1st red sub-frame period and the 1st blue sub-frame period, video signals to be written are actually written to the pixel electrodes 40A, 40C, 40E . . . associated with the gate lines 31A, 31C, 31E . . . on odd rows, while in the 2nd red sub-frame period and the 2nd blue sub-frame period, video signals to be written are actually written to the pixel electrodes 40B, 40D, 40F . . . associated with the gate lines 31B, 31D, 31F . . . on even rows. Consequently, image is normally displayed as the whole.

In this operation, in the 1st and 2nd red sub-frame periods and the 1st and 2nd blue sub-frame periods, the required number of times the scan signals are output is half of the number of gate lines included in the liquid crystal display panel 10. Also, display is not darken because the black signals are not written.

As mentioned previously, in the light of viewing characteristic of human beings, the same video signal is not written in the green sub-frame period. Nevertheless, the color of the sub-frame periods in which the same video signal is written is not intended to be limited.

While in this embodiment, the same video signal is written onto the pixel electrodes associated with two continuous gate lines, the number of such gate lines may be three or more.

ANOTHER EMBODIMENT

In the above-mentioned embodiments, normally-white-mode liquid crystal display panels are employed. The present invention is applicable to normally-black-mode liquid crystal display panel adapted to perform black display during application of relatively low voltage and white display during application of relatively high voltage.

While the liquid crystal displays of the above-mentioned embodiments include backlights having three-primary-color light sources, the backlights may alternatively have light sources emitting light of more colors. By way of example, the backlights may have light sources emitting color light such as yellow, cyan, magenda, white, in addition to red, blue, and green, the light sources of the respective colors may be adapted to emit light by time division for color display.

In addition to the field sequential color method, the present invention may be applied to. e.g., blinking backlight method. In the blinking backlight method, color filters of three primary colors and a light source emitting white light are provided and the light source is adapted to blink in each frame period, thereby performing color display. This method is identical to the field sequential color method in that color display is performed by blinking the light source. In other words, the blinking backlight method is considered to be the field sequential color method without divided sub-frame periods of respective colors. It is desirable to use LEDs capable of easy control for blinking operation because of the necessity of blinking of the light source. As an alternative, cold cathode tube can be used.

Further, instead of the transparent liquid crystal displays in the above-described embodiments, the present invention is applicable to reflective liquid crystal displays such as DMD (Digital Mirror Device).

Moreover, for the purpose of achievement of high-speed response of the liquid crystal display panel, liquid crystal molecules having spontaneous polarization, such as ferrolectric liquid crystal or anti-ferroelectric liquid crystal may be used. The response time of the general nematic liquid crystal is approximately 30 ms, whereas the response time of the liquid crystal molecules having spontaneous polarization is extremely high, e.g., 1 ms or less. Accordingly, the use of such liquid crystal molecules having spontaneous polarization can ensure sufficient light-emitting time and achieve more satisfactory display.

Some of the above-described embodiments can be combined according to use or the like of the liquid crystal displays to thereby provide various types of liquid crystal displays.

Numerous modifications and alternative embodiments of the invention will be apparent to those skilled in the art in the light of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

What is claimed is:

1. A liquid crystal display comprising:

an array substrate having a plurality of gate lines and a plurality of source lines arranged to cross each other, pixel electrodes provided in matrix, and switching devices respectively provided as corresponding to the pixel electrodes, for switching between a conductive state and a non-conductive state between the pixel electrodes and the source lines according to scan signals supplied through the gate lines to allow writing of video signals supplied through the source lines to the pixel electrodes;

an opposing substrate disposed opposite to the array substrate;

a liquid crystal layer disposed between the array substrate and the opposing substrate and containing filled liquid crystal;

a counter electrode provided on one of the opposing substrate and the array substrate, for generating potential difference between the counter electrode and the pixel electrodes, thereby driving the liquid crystal; and an illuminating device including a light source for emitting lights of a plurality of colors, wherein one frame period of the video signals is composed of a plurality of sub-frame periods, the illuminating device is controlled to emit light of one of the plurality of colors to the liquid crystal layer in each sub-frame period, and predetermined signals are written onto the pixel electrodes in the order of first writing and second writing in at least one sub-frame period, for allowing video signals associated with the at least one sub-frame period to be supplied to the pixel electrodes to cause the liquid crystal to be driven to thereby allow image corresponding to the video signals to be displayed, and first non-video signals near voltage for black display and second non-video signals near voltage for white display are written to at least part of the pixel electrodes in this order in the first writing, and the video signals are written to the pixel electrodes in the second writing.

2. The liquid crystal display according to claim 1, wherein the liquid crystal is OCB-mode liquid crystal.

3. The liquid crystal display according to claim 1, wherein the liquid crystal has spontaneous polarization.

4. The liquid crystal display according to claim 1, wherein voltage corresponding to the non-video signals is 0 V or larger and not larger than an intermediate voltage between voltage for white display and voltage for black display.

5. The liquid crystal display according to claim 1, wherein the non-video signals are written onto the pixel electrodes associated with all the gate lines substantially at the same timing in the first writing.

* * * * *